United States Patent [19]

Boettge et al.

[11] 4,236,639

[45] Dec. 2, 1980

[54] METHOD OF AUTOMATICALLY SORTING THIN SHEET ARTICLES

[75] Inventors: Horst Boettge, Gartenberg; Wilhelm Mitzel, Neu-Keferloh; Herbert Bernardi, Haag; Josef Geier, Munich; Norbert Osswald, Hochbruck; Gerd von Aschwege; Robert Schaetz, both of Munich, all of Fed. Rep. of Germany

[73] Assignee: G.A.O. Gesellschaft für Automation und Organisation mbH, Fed. Rep. of Germany

[21] Appl. No.: 867,011

[22] Filed: Jan. 5, 1978

[30] Foreign Application Priority Data

Jul. 1, 1977 [DE] Fed. Rep. of Germany ..... 2729830

[51] Int. Cl.[3] ..... B07C 5/342

[52] U.S. Cl. ..... 209/534; 209/548; 209/565;198/503

[58] Field of Search ..... 209/534, 564, 563, 565, 209/559, 548; 194/DIG. 26; 93/93 R, 93 M, 93 D

[56] References Cited

U.S. PATENT DOCUMENTS

| | | | |
|---|---|---|---|
| 3,976,198 | 8/1976 | Carnes et al. | 209/534 |
| 4,025,420 | 5/1977 | Horino | 209/534 |

*Primary Examiner*—Joseph J. Rolla

*Attorney, Agent, or Firm*—McGlew and Tuttle

[57] ABSTRACT

A method and apparatus for automatically sorting packets of thin sheet articles such as securities, bank notes and the like which are bound in a stack by a band. A series of modular units are provided in which the band and the stack are mechanically separated, each sheet of the stack is conveyed independent of the band, each sheet is tested and directed to a target location dependent upon the results of the test. The transport of sheets having predetermined characteristics is coordinated with the transport of the band.

42 Claims, 47 Drawing Figures

| Z | E | U- Bst. | NU-Bst. | HN-Bst. | SD-Bst. |
|---|---|---|---|---|---|
| 0 | 0 | 0 | 0 | 1 | 0 |
| 0 | 1 | 0 | 1 | 0 | 0 |
| 1 | 0 | 0 | 0 | 1 | 0 |
| A-Byte 1 | 1 | 1 | 0 | 0 | 0 |

370 381

METHOD OF AUTOMATICALLY SORTING THIN SHEET ARTICLES

FIELD AND BACKGROUND OF THE INVENTION

The present invention relates to a method of automatically sorting thin sheet articles, particularly securities, bank notes, and the like, wherein the individual sheets are withdrawn one after the other from a stack, tested according to different criteria, and assigned to given categories on the basis of the test.

German Published Patent Application (DT-OS) 2,446,280 corresponding to U.S. Pat. No. 4,025,420, discloses a bank-note sorter with which large quantities of bank notes of a predetermined value and of predetermined currency can be tested as to whether they are still usable for circulation or are to be withdrawn from circulation and destroyed. Bank notes of a different currency or of a different value are recognized as being invalid and rejected.

To perform these sorting operations, the bank notes, supplied by the banks in packets of 100 and with revenue stamps affixed thereto, are manually freed from the revenue stamps, placed into an input station, fed from the stack, tested, and placed into different stackers according to their nature.

To be able to reconstruct any irregularities in a packet at a later time or to assign any faults in the packet to the associated revenue stamp on which the bank from which the packet comes is marked, 1. the packets of 100 bank notes are separated in the input station of the sorter by means of so-called separating cards;
2. the revenue stamps are provided with machine-internal information during the manual removal of the revenue stamps, and are entered into a mechanical, serial store in the sequence in which they are processed, and
3. the machine-internal data of the revenue stamp is recorded on a magnetic strip of the associated separating card (only packet number in hopper).

By reading the data on the separating cards and finding the revenue stamps, the reconstruction of packets is thus possible in principle. To largely automate the sorting process, the packet number of the entered stack, the number of invalid bank notes (false currency, false value), and with the aid of binary information, an indication as to whether the pass could be completed without irregularities, are additionally marked on the separating card.

After the sorting, during which the non circulable bank notes were provided with a corresponding imprint, the bank notes, collected in stacks of 100, are transported with a conveyor belt to a revenue-stamp-affixing station where new revenue stamps are affixed to the stacks and where the stacks are put into circulation again or eliminated according to nature. Although the sorting process, carried out only manually so far, is considerably automated in the known sorter, the latter has a few essential disadvantages.

For example, by the sorting into "invalid, non-circulable bank notes" and "circulable bank notes", automatic processing is possible, but in view of the expensive manual preparatory work, the inadequate documentation, and the very expensive revenue stamp assignment, only a facilitation of individual partial steps of the sorting process can be achieved with this known sorter. Automation of the separate bank-note processing is not possible, however.

For instance, the complicated removal of the revenue stamps and the storing of the revenue stamps still entail considerable personnel expenditure because of the manual preparatory work and the expensive packet reconstruction.

The provision of separating cards makes it possible to keep the input packets separated in the input stack, but the preparatory work necessary therefor and the subsequent processing of the separating cards unnecessarily complicate the sequence of operations in the individual phases, which is particularly disadvantageous in those cases where the usual sequence of operations is interrupted by some mechanical or personnel error.

Since the bank-note packets to be sorted may contain counterfeit bank notes in addition to incorrect bank notes (false value, etc.), and since such counterfeit money cannot be detected by the known sorter with certainty, that sorter, besides still requiring much personnel for the processing of the bank notes, involves a factor of uncertainty which does not allow bank-note sorting by that known sorter alone.

Another bank-note sorter which is known from German Published Patent Application (DT-OS) 2,328,126 and with which the bank notes are to be tested for circulability and sorted without assignment to the revenue stamps, is, according to the specification, capable of detecting counterfeit bank notes, but apart from the general statement that the test results are evaluated with electronic equipment, that application gives no technical teaching with which the bank-note sorting could be made largely independent of manual operations. In addition, the sorter has no safeguards whatsoever which could detect or prevent any fraudulent manipulations by the operating personnel.

SUMMARY OF THE INVENTION

Therefore, an object of the invention is, besides avoiding the disadvantages of the known sorting methods and sorting apparatus, to provide a sorting method and an apparatus for carrying out the same which insures fully automatic processing and sorting safeguarded against fraudulent manipulation. In addition, quick and efficient processing of bank-note packets with irregularities is to be possible, since in case of irregularities, it is of particular importance that the bank-note packets can be traced back to the depositor via the revenue stamp or band bounding the stack of notes of the packet.

Thus, the subject matter of the invention is a method of automatically sorting thin sheet articles, particularly securities, bank notes, and the like, wherein the individual sheets are withdrawn one after the other from a stack, tested according to different criteria, and assigned to given categories on the basis of the test.

The general idea of the invention is characterized in that the sheet articles, united in several packets having revenue stamps affixed thereto and containing a predetermined number of sheets, are introduced into the sorter, that the packets are mechanically freed from the revenue stamps one after the other, that the sheet articles of the packet freed from the revenue stamp are separated from the packet, that the separated sheets are fed to a conveyor system which conveys them to different destinations dependent upon the test results of a measuring section and on additional criteria independent of the test results of the measuring section, that, parallel thereto, the revenue stamps belonging to the bank-note packets being processed are conveyed by a second conveyor system to waiting positions from which they are stacked, without any interruption of the general sorting procedure, in a reject magazine in case of irregularities in the associated packet, with the revenue stamps being assigned to this packet, or in a general collecting receptacle in the case of packets without irregularities, and that all operations are recorded in logs.

The invention offers a number of advantages. For example, the packtes are processed so that at any time, direct material assignment of revenue stamp and packet is possible for those bank notes of a packet for which the revenue stamp information is required. To further increase the machine capacity, the method according to the invention also minimizes the time required to process the sorted bank notes by delivery of directly usable packets having revenue stamps affixed thereto and containing circulable bank notes, and of fully invalidated, noncirculable bank notes. By the material assignment of bank notes having irregularities to the revenue stamps belonging thereto, and by means of logs documenting all operations, the whole testing sequence is recorded so that even after the completion of a bank-notes pass, any important phase of the test can be checked at any time. The system-variable concept of the mechanical and data handling equipment allows easy adaptation to nearly all wishes of customers (banks) and to any types of bank notes.

Another advantage is that the automatic bank-note processing is protected against fraudulent manipulation by a number of measures. For instance, access to the bank-note packets and, consequently, to the bank notes after the loading of the magazines and during the withdrawal of the bank-note packets in the sorter is impossible. Immediately after the individual bank notes have been separated and fed from the stack, each bank note is registered so that no bank note can become lost unidentified, e.g. by manual removal.

Since all external instructions and all technical faults during the sequence of operations are recorded together with the name (code number) of the operator, the processed packets and all sequences of operations can be reconstructed at any time, i.e. also at later dates.

A preferred embodiment as well as further features of the invention will be apparent from the subclaims and from the following description, in which the invention is described with respect to a bank-note sorter.

BRIEF DESCRIPTION OF THE DRAWINGS

In the accompanying drawings.

DETAILED DESCRIPTION OF PREFERRED EMBODIMENT

Figure 1:
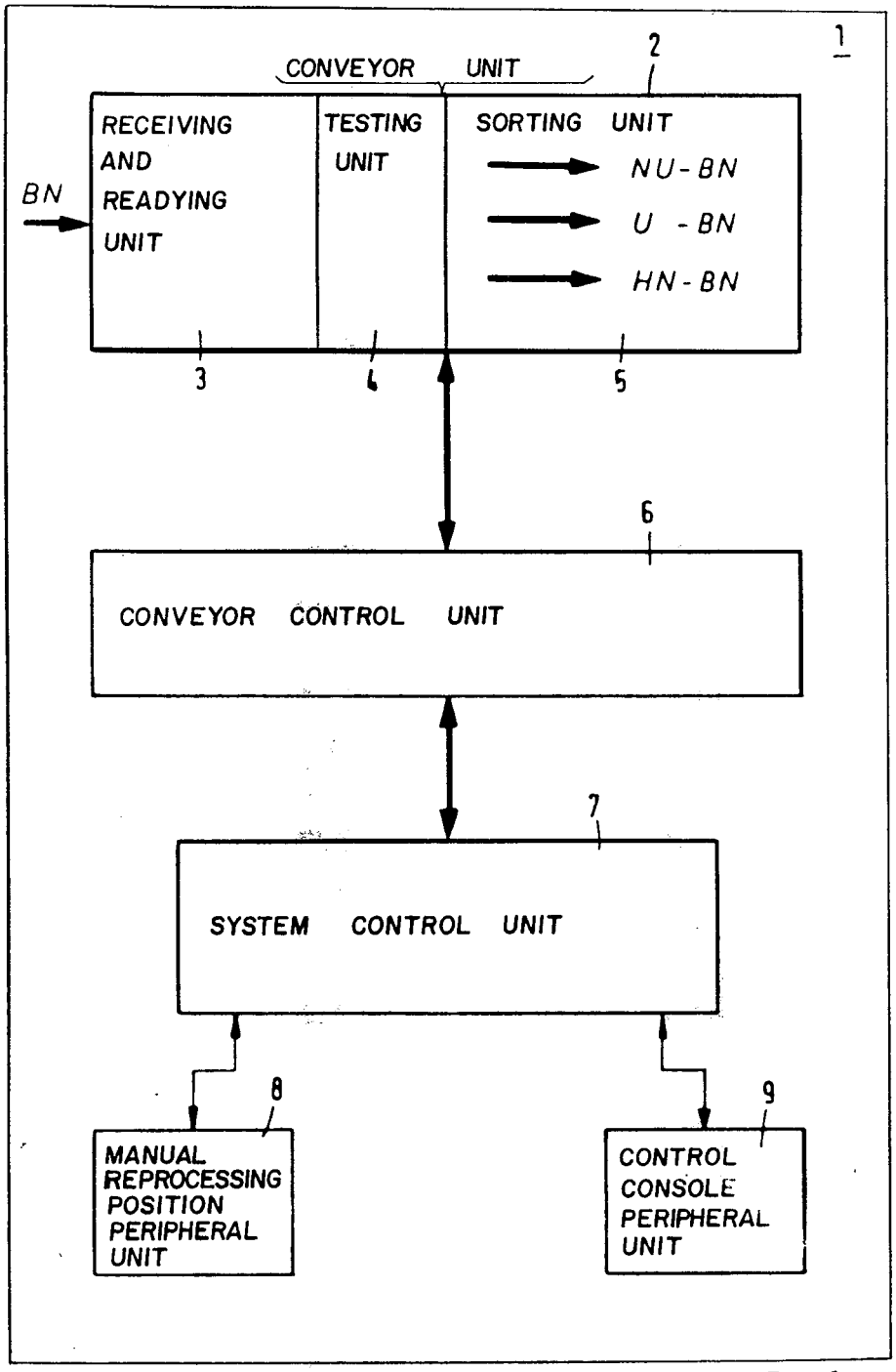
FIG. 1 is a block diagram of an associated novel sorter with the information-processing system, according to the invention.

As shown in FIG. 1, a novel bank-note sorter 1 comprises three essential system units: a conveyor unit 2, a conveyor control unit 6, and the system control unit 7 with the peripheral units 8, 9.

The conveyor unit 2 is a purely mechanical system unit and responsible for the movement of the bank-note packets, bank notes and revenue stamps. In a receiving and readying unit 3, it receives the input packets of one hundred bank notes (BN) each, for example packed in magazines and having revenue stamps affixed thereto, withdraws the packets one at a time from the magazine, and removes the revenue stamps. The bank notes are then separated and fed from the stacks freed from revenue stamps and are passed, by means of a bank note conveying system, through a testing unit 4 where each bank note is individually verified and tested for its condition with the aid of several testing devices. The testing unit 4 is followed by a sorting unit 5 which sorts the sheets into three different categories: a category for non circulable bank notes (NU-BN), a category for circulable bank notes (U-BN), and a category for irregular bank notes requiring manual reprocessing (HN-BN). The last-named category includes bank notes which are suspected of being counterfeits, heavy damaged, or unidentifiable. Besides the irregularities with respect to bank notes, irregularities regarding the number of packets are possible.

The sorting unit 5 includes gates in the bank note conveying system which assign the individual bank notes to the aforementioned categories dependent upon the result of the testing unit 4.

The revenue stamps obtained during the above-mentioned removal of the revenue stamps from the packets are received in a revenue stamp conveying system which is independent of the bank note conveying system and in which they are assigned to the associated packet by intermediate storage until the associated packet has been completely dealt with, i.e., until all bank notes of the packet have left the bank note conveying system and, thus, have been sorted into the above-mentioned categories. Even if there was only one irregularity with respect to the packet dealt with, the revenue stamp will be assigned to the category for bank notes requiring manual reprocessing, and conveyed to the corresponding receptacle via the revenue stamp conveying system. Thus the direct physical assignment of the revenue stamp to the packet in which an irregularity was present is always guaranteed.

Besides the just described mechanical system (conveyor unit 2), there is a second component of the sorter 1, the information-processing system with the conveyor control unit 6 (S) and the system control unit 7. The conveyor control unit 6 monitors and controls the passage of the bank-note packets, the bank notes, and the revenue stamps through the conveyor unit 2.

The conveyor control unit 6 processes the results obtained from test signals generated in the testing unit 4, determines the categories for the tested bank notes with the aid of the results, follows each bank note in the bank note conveying system with respect to the route determined by the testing unit 4, and sees to it that the assignment of the bank notes to the corresponding input packet and to the corresponding revenue stamp is preserved at any time.

In contrast to the conveyor control unit 6, which monitors and controls the bank-note packets, bank notes, and revenue stamps being in the conveyor unit 2, the system control unit 7 with its peripheral units, i.e., the manual reprocessing position 8 and the control console 9, takes care of the entire organization of the bank-note processing over a protracted processing period (shift).

The system control unit 7 receives and manages all data resulting during a processing period and insures compliance with a sequence of operations determined according to organization rules.

If required, it produces logs (e.g. a manual reprocessing log on the manual reprocessing position 8) from the received data, and it is capable of communicating with the operating personnel of the sorter 1 via the console 9. After the general description of the bank-note sorter 1, the conveyor unit 2, the conveyor control unit 6, and the system control unit 7 with its peripheral units 8, 9 will now be explained in greater detail.

The conveyor unit 2 of the exemplary embodiment shown in FIG. 2 consists of nine building blocks designated by reference numerals 10–18, each of which may be more particularly described as follows:

- the building block 10 for feeding the bank-note packets supplied in bolted packet magazines 19 from these magazines and for removing the revenue stamps from the packets;
- the building block 11 for feeding the bank notes from the revenue-stamp-free bank-note stacks by means of a feeder 20 as well as for pretesting and, if necessary, reconstructibly rejecting those bank notes into a first reject magazine **29*a* whose passage through the conveyor unit 2** may result in damage to subsequent units;
- the building block 12 for testing the bank notes for circulability (general state, e.g. degree of dirtiness) in a first test section 22, and for genuineness (bank notes are suspected of being counterfeits if genuineness marks are faulty or missing) in a second test section 23;
- the building block 13 for irreversibly destroying genuine non-circulable bank notes (NU-BN) by means of a double-shredder system 24, and for collecting shreds in a shred container 25;
- two building blocks 14, 15 identical in construction and operating in tandem for stacking non-circulable, revenue-stamp-free bank notes (NU-BN) in containers 26, 27;
- two building blocks 16, 17 identical in construction and also operating in tandem for stacking and affixing revenue stamps to circulable bank notes (U-BN) in a bank-note affixing station 28, and
- the building block 18 for reconstructibly stacking bank notes to be processed seperately, including the corresponding revenue stamp, in a second reject or manual reprocessing magazine (HN-magazine) **29*b*** and for collecting those revenue stamps which belong to bank-note packets not objected to.

The whole system is modular in construction. All building blocks 10–18, which perform conveying, testing, and sorting operations on the bank notes, revenue stamps, or bank-note packets are of uniform design, i.e., standardized with respect to both their mechanical and electrical interfaces. This permits, on the one hand, an individual selection and combination of the conveyor unit and, thus, an adaptation to different requirements with respect to the organization of the bank-note processing and, on the other hand, an adaptation to the specific characteristics of different bank-note types and currencies.

Figure 2:
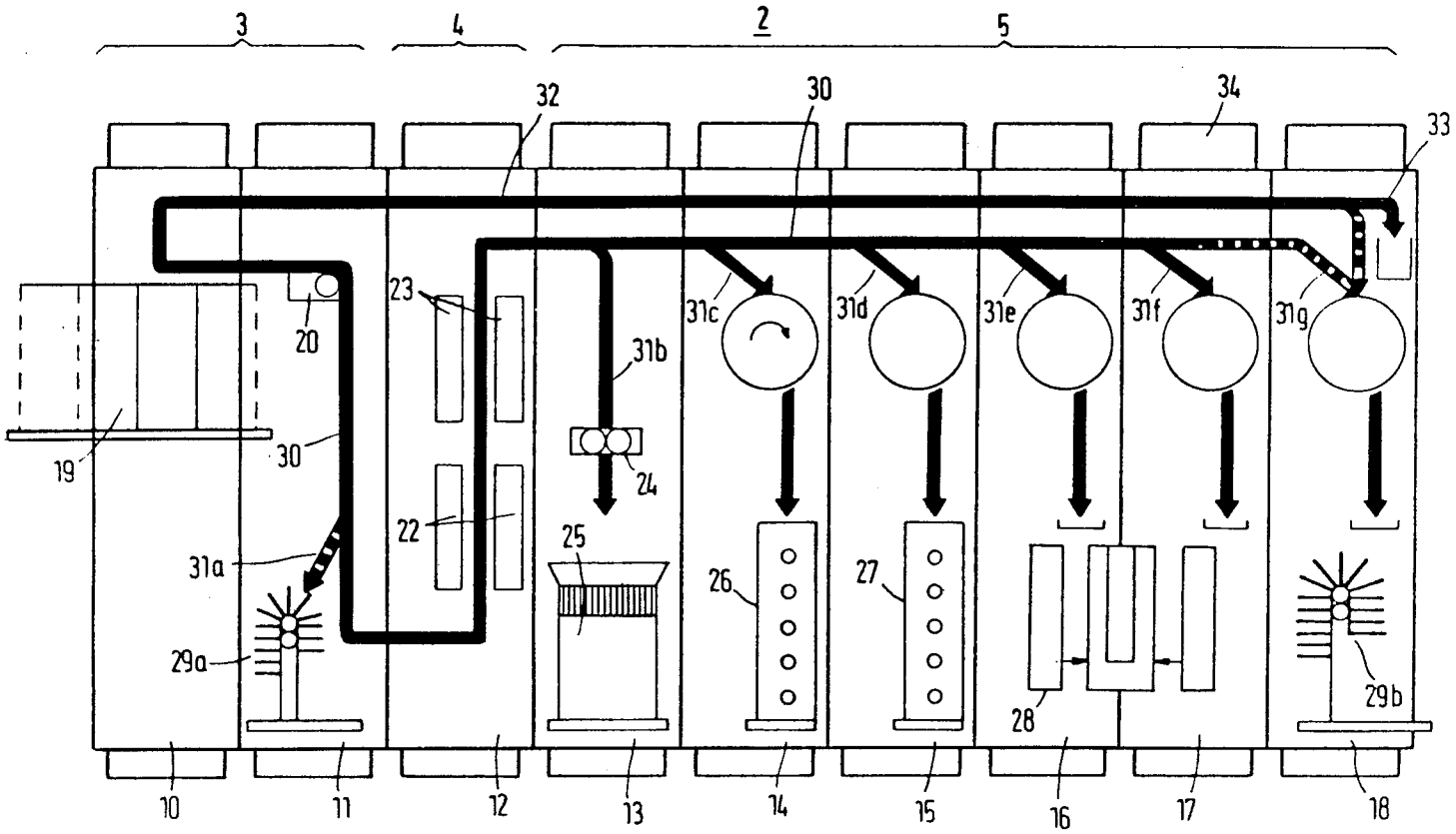
FIG. 2 schematically illustrates the conveyor unit with individual building blocks.

As indicated in FIG. 2 by flowlines, the conveyor unit 2 comprises two conveying systems - a bank note conveying system 30 and a revenue stamp conveying system 32 - which are independent of each other and extend through all building blocks 10–18.

The bank note conveying system 30, starting from the building block 10 for feeding the packets from the packet magazines 19, transports the bank notes through the building block 11 and the testing stations 22, 23 of the building block 12 to the respective destinations in the sorting blocks 13–18, which destinations are determined in the testing stations. Because of the branches **31*b*–31*g* within the sorting blocks 13–18**, respectively, the transport paths of the individual bank notes may be very different in length depending upon the sorting block in which they are stacked. This places particular requirements on transport control and supervision.

In addition to the sorting branches **31*b*–31*g* provided in the sorting blocks 13–18, there is a branch 31*a* in the building block 11** at the beginning of the bank-note transport. This is where those bank notes which may cause damage to subsequent units are eliminated.

The revenue stamp conveying system 32, which, as shown in FIG. 2, is disposed above the bank note conveying system 30, also starts at the building block 10. Unlike the bank note conveying system 30, however, it has a branch 33 only in the last building block 18.

For selective heat and dust removal, each building block 10–18 has an exit air duct system 34 (shown schematically).

The construction and operation of the individual building blocks shown in FIG. 2 will now be explained in detail.

Figure 3:
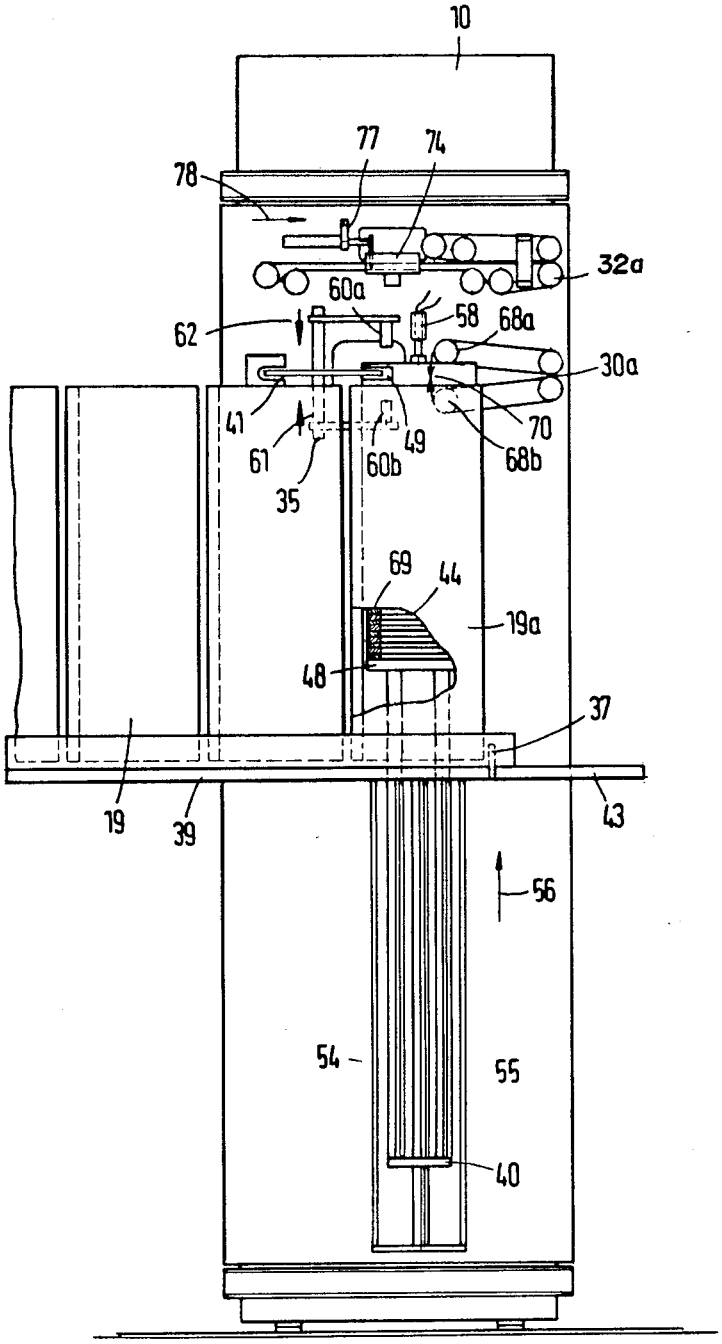
FIG. 3 shows the building block "packet withdrawal and revenue stamp removal"

BUILDING BLOCK 10 FOR FEEDING THE BANK-NOTE PACKETS FROM THE MAGAZINES AND FOR REMOVING THE REVENUE STAMPS FROM THE PACKETS (FIG. 2, FIG. 3)

The building block 10 (FIGS. 2 and 3) for feeding the packets, one at a time, from the packet magazines 19 and for removing the revenue stamps from the packets makes available the necessary supply of bank notes for continuous feeding into the sorter. The building block comprises the following specific functional units:

- a plurality of packet magazines 19 which are capable of being supplied and delivered continuously and in which the bank notes to be processed are united in packets 44 of one hundred bank notes by means of revenue stamps 69;
- a feed/delivery table 39, 43 with a means (not shown in the drawing) for the automatic supply and delivery of the packet magazines 19;
- a packet-feeding and revenue-stamp-removing station 35 for feeding the bank-note packets 44, one at a time, from the packet magazines 19 and for removing the revenue stamps from the packets, and
- two conveying sections **30*a*, 32*a*** for advancing the revenue-stamp-free bank-note packets and their revenue stamps.

The automatic processing of the bank notes is initiated by placing the packet magazines 19, loaded by an operator and subsequently bolted (locked) on the feed table 39, which is capable of receiving several magazines at the same time in a waiting position. A packet magazine 19 is then transported to the packet-feeding and revenue-stamp-removing station 35 and unlocked by a lifting device 40. Thereafter, the lifting device moves the bank-note packets, one after the other, in front of an ejector, such as an ejector arm or lever 41, which pushes the packets out of the magazine 19 into the building block 10. Then, each of the packets, pushed out of the magazine 19, is freed from the revenue stamp and transported over the bank note conveying section **30*a* to the subsequent building block 11, where the bank notes are separated and fed from the packet. The revenue stamp removed from the packet is routed into the conveying section 32*a* above the packet conveying section via a deflection mechanism (not shown). After a packet magazine 19 has been emptied, the lifting device 40 moves down and the empty magazine 19 reaches the delivery table 43. The next full magazine 19** is automatically reloaded and unlocked and emptied as described above.

Figure 4:
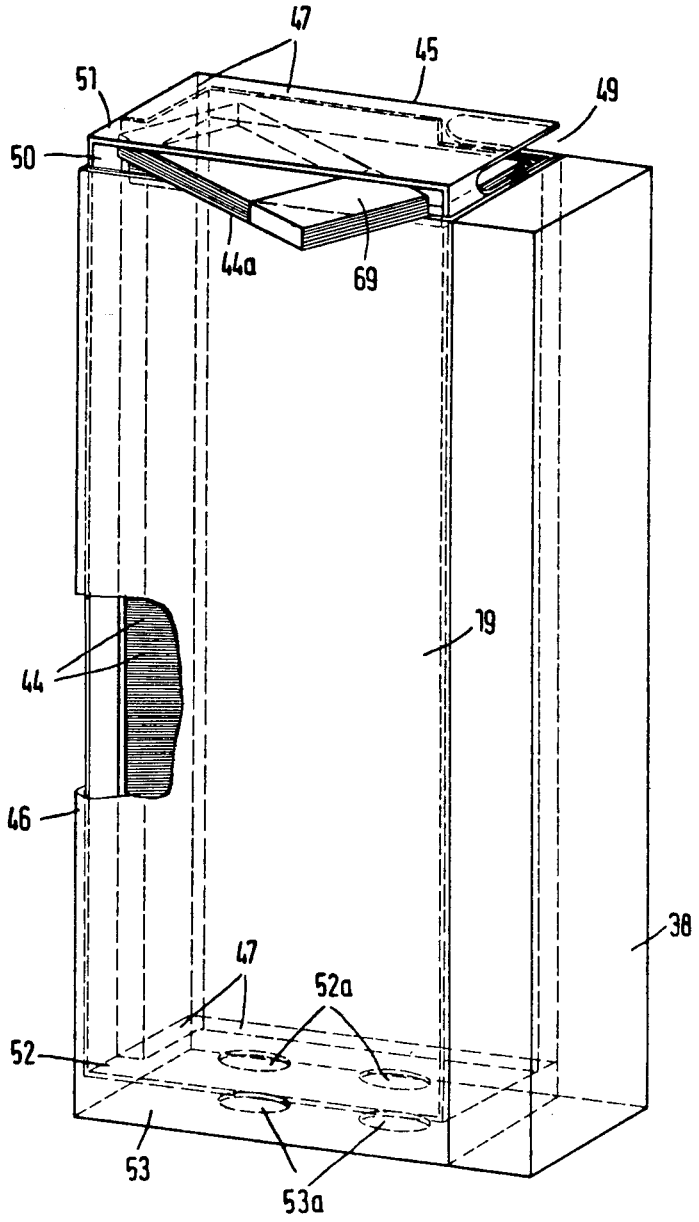
FIG. 4 is a perspective, partly in section, of a packet magazine.

FIG. 4, in a three-dimensional representation, shows a packet magazine 19 which affords safety from undetected and unauthorized access by its special construction and by an integrated bolting mechanism (not shown). Once the magazine 19 has been loaded with bank-note packets 44 by an operator and bolted, manual access to the bank-note packets is impossible without visible destruction of the magazine. Only the sorter is able to unlock the magazine in order to push the individual bank-note packets 44 out of the magazine through a slot having the width of a packet (packet-feeding slot 50). Since this slot 50 is only as wide as a packet, the contents remaining in the magazine cannot be reached with the hands during the emptying process, either.

FIG. 4 shows the packet magazine 19, which consists of two elements, a drawer-type slide-in element 45 and a receiving element 46 receiving the slide-in element 45, in its working phase. In this phase, the slide-in element 45, which, for being loaded with bank-note packets 44, can be completely pulled out of the receiving element 46 similarly to a drawer, has been lifted in relation to the receiving element 46 with the aid of the lifting device to such an extent that the open side of the slide-in element is exposed by about the width of one packet. Through the feed slot 50 so obtained, the respective uppermost packet **44*a* of the stack of packets can be swivelled out of the slide-in element as will be explained below. The packets therebelow remain in the slide-in element 45**.

For adaptation to the size of the respective bank-note type to be processed, the interior space of the slide-in element 45, which corresponds in principle to the standard size of the receiving element 46, is variable in size by the use of a suitable matching piece 47.

The ejection of the packet **44*a* lying on top in the slide-in element 45 is performed by means of the ejector arm 41 shown in FIG. 3, which is moved into an ejection slot 49 located opposite the feed slot 50 and extending across one corner. That side of the uppermost packet 44*a* (FIG. 4) which is provided with a revenue stamp 69 is swivelled out of the slide-in element 45. To permit the swivelling of the packet during the ejection phase, the matching piece 47 has a recess 51 on the narrow side opposite the ejection slot 49. The respective bottoms 52, 53 of the two elements 45, 46 have two holes 52*a*, 53*a* which are disposed one above the other and aligned and through which the two bars 54, 55 (FIG. 3) of the lifting device 40 push the stacked bank-note packet 44 and, thus, the slide-in element 45 out of the receiving element 46 via a supporting plate 48. Thus, after each removal of a packet from the stack, the respective uppermost bank-note packet 44*a* of the stack is moved in front of the ejector lever 41**.

To load the slide-in element 45 with bank-note packets 44, slide-in element 45 is unlocked and completely withdrawn from the receiving element 46 in a loading device (not shown). After the loading, the slide-in element 45 is reinserted into the receiving element 46 and bolted with the aid of a bolting mechanism not shown in the figure. This bolting mechanism is housed in the hollow space 38 provided on the narrow side of the receiving element 46. The two elements 45, 46 are so adapted to each other in length that in the telescoped condition, both the ejection slot 49 and the feed slot 50 of the slide-in element 45 are completely covered by the respective long sides of the receiving element 46. From now on, the bolting mechanism, which is operated when the two elements are being slid one within the other, prevents any manual access to the bank-note packets 44. Without the specially designed unlocking device, which is provided both in the loading device and in the packet-feeding station of the building block 10, the slide-in element 45 cannot be pulled out again.

A possible design of the magazine bolting mechanism as well as a few further steps to safeguard the magazine contents against unauthorized access are disclosed in German Published Patent Application (DT-OS) 2,202,930. The bolting mechanism is not a subject matter of this application, so it will not be described here. Since the unauthorized removal of individual bank note or bank-note packets without damage to the magazine is impossible, any undetected manipulation of the magazine contents between the loading of the magazine and the sorting of the bank notes is impossible. Thus the total system, from the loading of the magazine until the delivery of the sorted bank notes, represents a continuously supervisible unit which can be handled without additional personnel expenditure.

The sequence of operations during the feeding of packets from the stack will now be described in detail with the aid of FIGS. 3, 4, and of the schematic representations of FIGS. 5*a* to 5*f*.

First, a magazine 19 loaded with bank-note packets 44 and bolted is transported from the feed table 39 to the packet-feeding station 35 of the building block 10 (FIG. 3) by means of a suitable conveying system (not shown). This is done when the preceding magazine has been emptied and transported to the delivery table 43. When the full magazine, after having hit a stop 37 capable of being retracted, is in the emptying position (position of the magazine 19*a* in FIG. 3), and after the locking mechanism has been released, the bars 54 and 55 of the lifting device 40 are moved upwards in the direction of the arrow 56. Having passed through the holes 52*a*, 53*a* of the slide-in and receiving elements 45, 46, they strike against the supporting plate 48 and, consequently, the bank-note packets 44 lying thereon, and push both the stacked packets 44 and the slide-in element 45 out of the receiving element 46 until the ejection slot 49 and the feed slot 50, in whose plane the uppermost packet 44*a* of the stack is lying, are exposed. As shown in FIG. 3, this is the position of the magazine 19*a* in the packet-feeding and revenue-stamp-removing stations 35 of the building block 10. Compared to FIG. 4, the magazine has been turned about its longitudinal axis, so in FIG. 3 the ejection slot 49 faces the viewer.

Figure 5A:
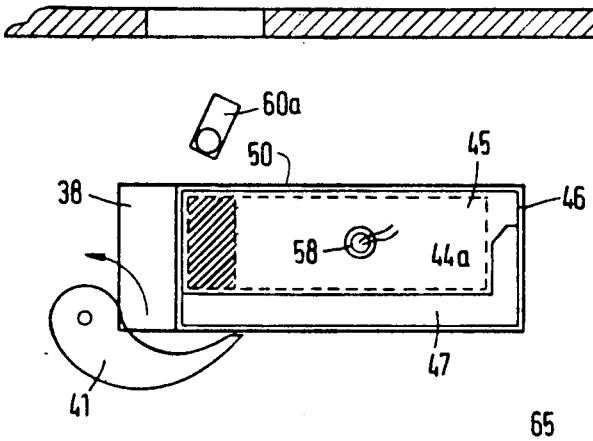
FIG. 5*a*–5*f* show the phases of the packet withdrawal.
Figure 5B:
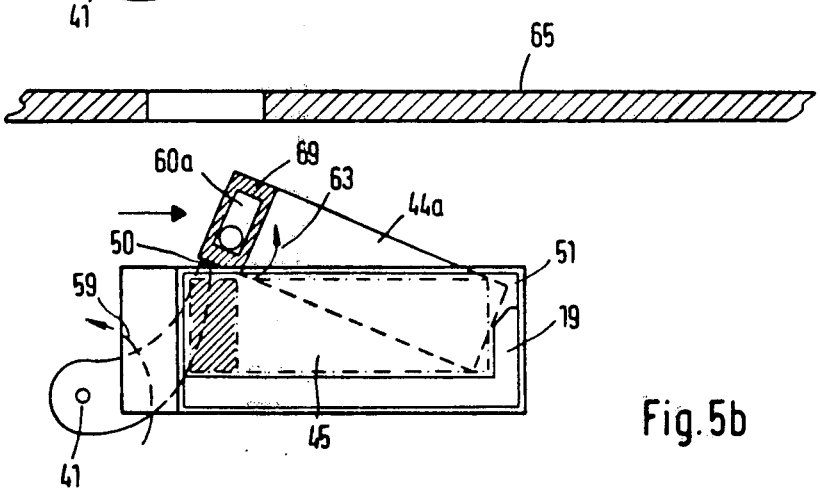

To be able to control the insertion of the bars 54, 55 into the packet magazine 19 dependent upon the height of the stack, use is made of the signal of a pressure sensing device 58 mounted above the magazine in the revenue-stamp-removing station 35 and operated by the slide-in element 45 in order to bring the lifting device 40 to rest when the pressure exerted by the slide-in element on the pressure sensing device reaches a predetermined value (see also FIG. 5*a*). As a result, the ejector arm 41 pivotally mounted on a level with the ejection slot 49 turns, as shown in FIG. 5*b*, in the direction of the arrow 59 to the point that that side of the uppermost packet 44*a* provided with the revenue stamp 69 is completely swivelled out of the slide-in element 45. Since the feed slot 50 is only as wide as a packet (FIG. 4), the packet lying there below remains in the slide-in element 45. When the packet is in the half-ejected position shown in FIG. 5*b*, which incidentally illustrates the neccessity of the abovementioned recess 51, the ejection lever 41 is returned to the starting position shown in FIG. 5*a*. Subsequently two suction plungers 60*a*, 60*b* (see FIG. 3) of the revenue-stamp-removing unit 35 are moved toward each other in the directions indicated by the arrows 62, 61, respectively until they compress the packet 44*a*, swivelled out of the magazine 19*a* on one side, at the side provided with the revenue stamp 69. In addition, intake air is admitted to both suction plungers as they are connected to a vacuum pump (not shown in FIGS. 3 and 5).

Figure 5C:
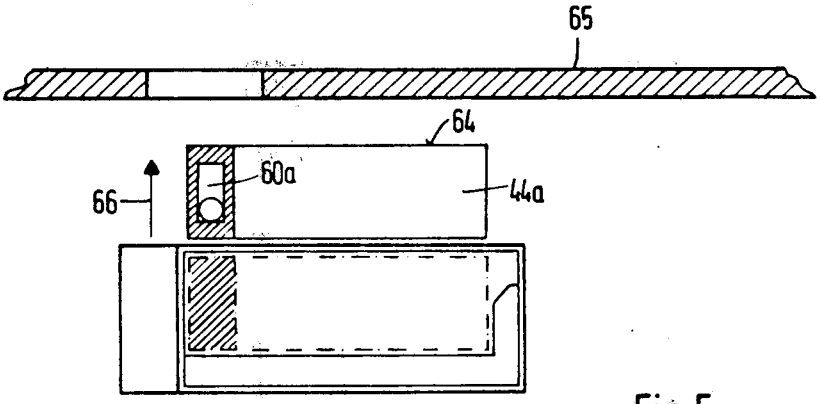

When the packet 44*a* has been clamped in place by the contact pressure, both suction plungers 60*a*, 60*b* are synchronously turned about their own axes in the direction of the arrow 63 (FIG. 5*b*) until they have turned the packet into the position shown in FIG. 5*c*.

Figure 5D:
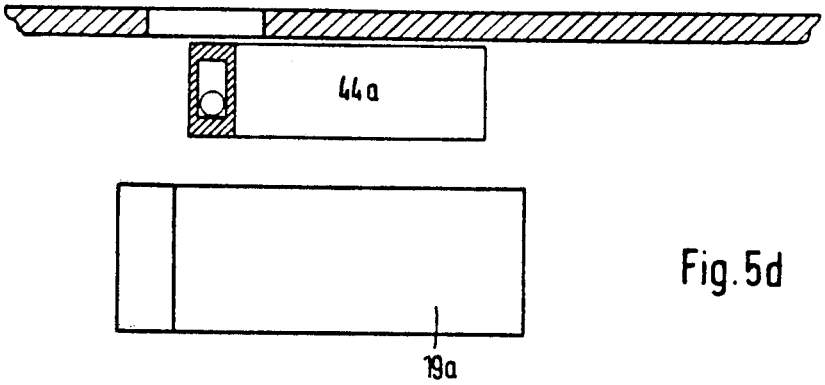
Figure 5E:
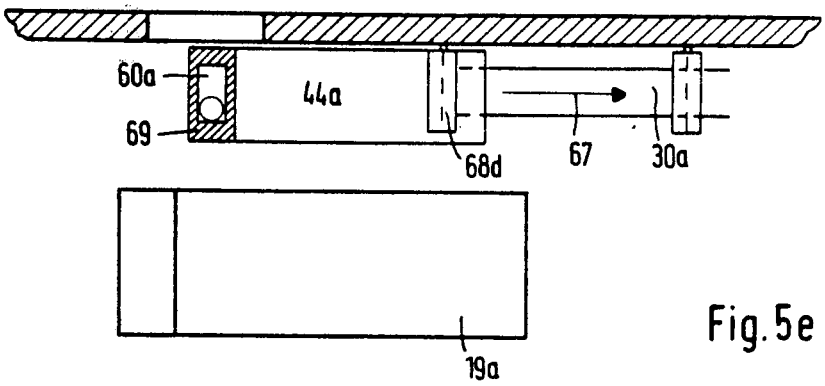
Figure 5F:
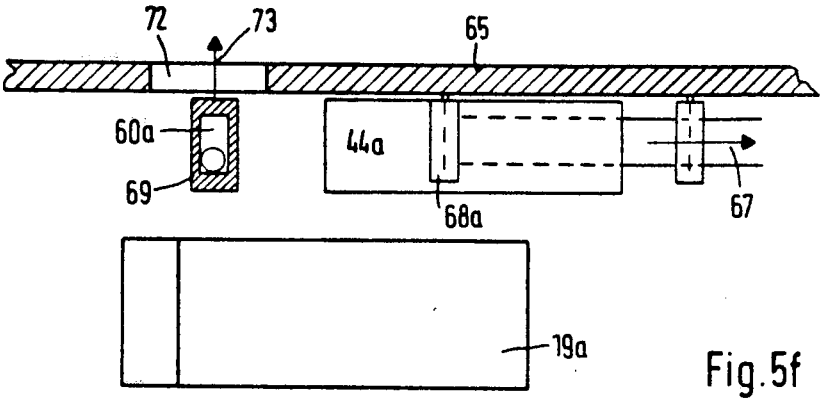

Depending on the size of the packet, in the position reached in FIG. 5*c*, the longitudinal edge 64 of the packet 44*a* is more or less distant from a wall 65 of the building block 10. To obtain a uniformly defined position for any size of packet, a final movement of both suction plungers 60*a*, 60*b* toward the wall (arrow 66) is necessary. This defined position of the packet 44*a* is shown in FIG. 5*d*. In this position, shown again in FIG. 5*e*, the leading edge of the packet 44*a*, pointing in the direction of transport (arrow 67), is located between the first two movable pulleys 68*a*, 68*b* of the packet conveying section 30*a* (see FIG. 3). After the last-mentioned movement, the compressive force of the suction plungers 60*a*, 60*b* is cancelled, so the packet side provided with the revenue stamp 69 is held only by the suction of the two suction plungers 60*a*, 60*b*. When the signal for freeing the packet from the revenue stamp is provided, the first pulleys 68*a*, 68*b* of the packet conveying section 30*a*, which are disposed above and below the packet, are moved toward each other (arrows 70 in FIG. 3) until the they firmly clamp the packet in place after a short rotary motion. After this, the pulleys 68*a*, 68*b* are driven, whereby the packet 44*a* is withdrawn from the revenue stamp 69 being held by the suction plungers 60*a*, 60*b*, and moved in the direction of the arrow 67 to a waiting station in the subsequent unit. The freed revenue stamp 69 is moved through an opening 72, shown in FIG. 5*f*, in the wall 65 into a deflecting conveying system (not shown) with the aid of the suction plungers 60*a*, 60*b*. Via the deflecting conveying system the revenue stamp 69 is transported to a revenue stamp table 74 (FIG. 3) located above the packet conveying section 30*a*. From the revenue stamp table 74 the revenue stamp 69 is then moved, by means of a slider 77 disposed on the left-hand side of the table 74 in FIG. 3, into the revenue stamp conveying section 32*a* following the table. To accomplish this, the slider 77, which may be pneumatically operated, is moved horizontally over the table in the direction of the arrow 78, thereby sliding the revenue stamp 69 from the table into the subsequent revenue stamp conveying section 32*a*. Under the action of the slider 77, the revenue stamp is always introduced into the revenue stamp conveying section 32 in alignment, i.e., at right angles to the conveyor belts.

The above-described packet-feeding and revenue stamp-removing system is designed as a sequence control system. It is linked with the remaining information-processing system only via a start instruction and a "finished" back indication.

BUILDING BLOCK 11 FOR FEEDING THE BANK NOTES FROM THE STACK (FIG. 2, FIG. 6)

Figure 6:
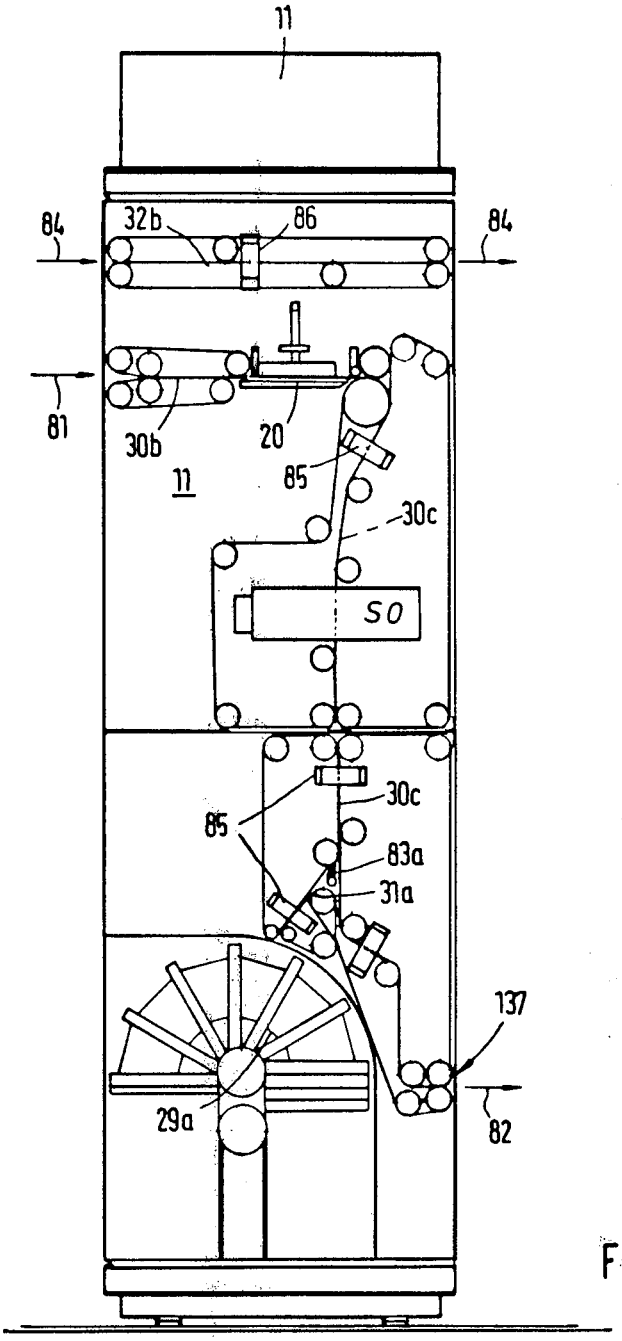
FIG. 6 shows the building block "bank-note feeding"

The building block 11 for feeding the bank notes from the stack, shown in FIGS. 2 and 6, insures that the sorter is continuously fed with bank notes. It comprises the following functional units:

- the bank-note feeder 20, the bank-note conveying systems 30*b*, 30*c*, the revenue stamp conveying system 32*b*;
- the reject sensor S O for determining whether bank notes have to be rejected, and
- the reject magazine 29*a* (R-Mag.).

The bank-note stacks supplied from the packet-feeding building block 10 in the direction of the arrow 81 and freed from revenue stamps are received by the conveying section 30*b* of the building block 11 and held (stored) until all bank notes have been fed from the preceding stack. This insures a high rate of utilization of the sorter. In the bank-note feeder 20, the bank notes are withdrawn, one at a time, from the stack and fed at a high speed into the bank note conveying section 30*c* following the feeder. Immediately after the feeding, the bank notes pass through the reject sensor S O, which senses whether the bank notes meet all criteria for trouble-free transport through the sorter. If, for example, bank notes were fed from the stack which have paper clips or pins attached thereto, and, thus, may damage subsequent building blocks, such a bank note will not be transported to the subsequent building block 12 as indicated by the arrow 82, but fed via the branching bank note conveying section 31*a* into a reject magazine 29*a* with the aid of a directing gate 83*a*. The construction and operation of the reject magazine will be apparent from the description of the manual reprocessing magazine to be dealt within connection with the last building block 18. Since the rejection of bank notes is necessary in special cases only, e.g., if bank notes are provided with paper clips or pins, rejects are an extremely rare occurrence. Nevertheless, it is expedient to identify such cases and keep such bank notes away from the subsequent building blocks, because a bank note not rejected is very likely to cause malfunctions or damage while passing through the subsequent building blocks, which unnecessarily interrupts the continuous flow of bank notes through the sorter.

As shown in FIG. 6, one conveying section 32*b* of the revenue stamp conveying system is disposed above the bank-note sorter 20. As indicated by the arrows 84, the revenue stamp is received from the revenue stamp conveying section 32*a* of the preceding building block 10 and fed to the subsequent building block 12 via the conveying section 32*b*.

FIG. 6 also shows that light paths 86, 85 are provided respectively in the conveying section 32*b* of the revenue stamp conveying system and in the sections 30*b*, 30*c*, and 31*a* of the bank note conveying system. Their functions will be explained in detail below in connection with the description of the information-processing system.

The operation of the bank-note feeder 20 is as follows.

Figure 7:
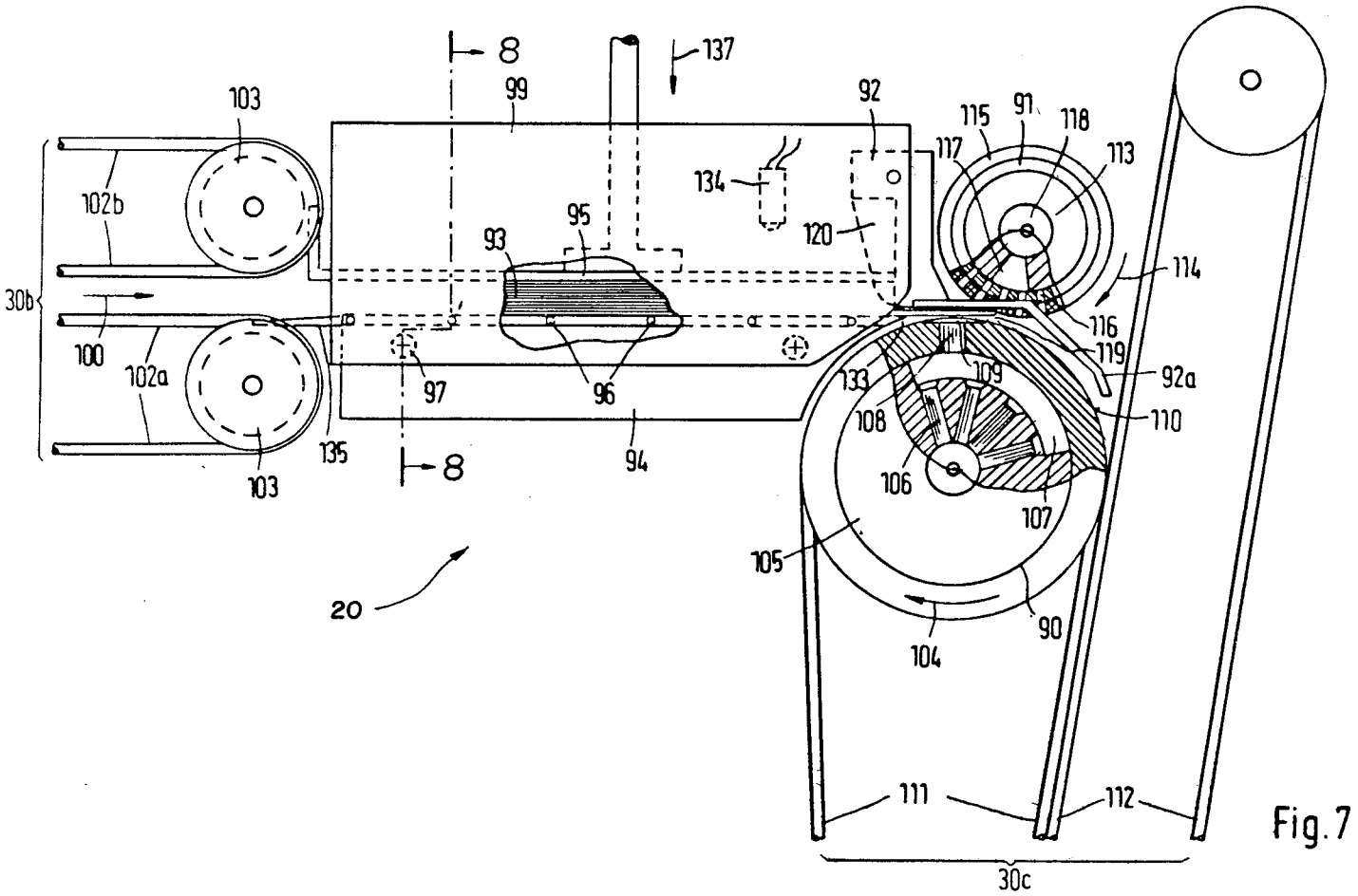
FIG. 7 shows the feeder.
Figure 8:
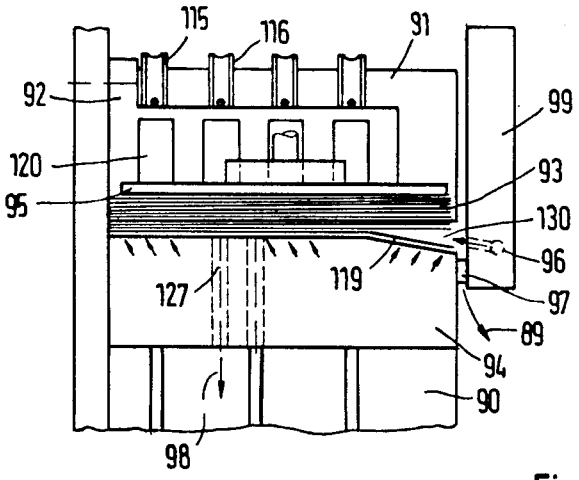
FIG. 8 is a section taken along line 8—8 of FIG. 7.
Figure 9:
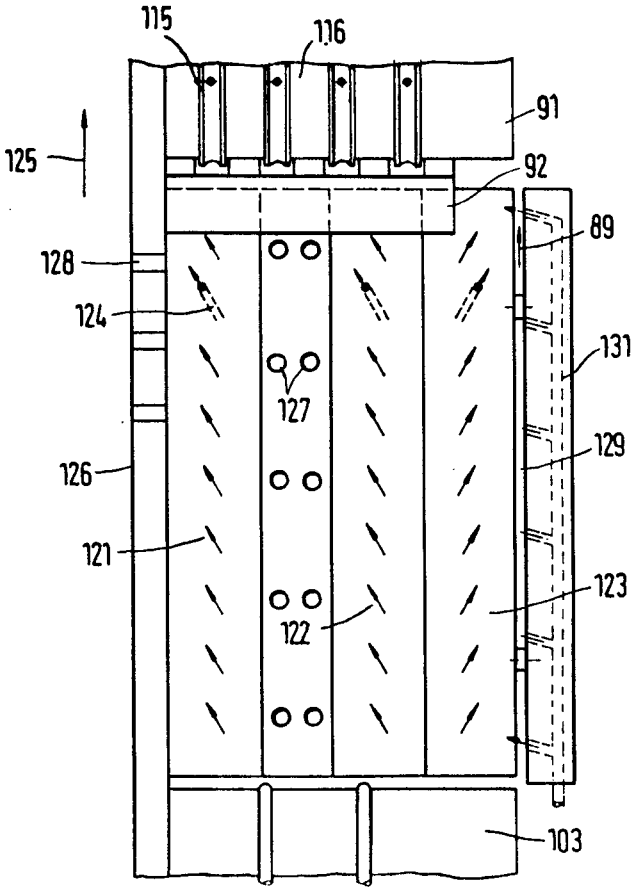
FIG. 9 is a top view of the feeder.

The feeder 20 shown in FIGS. 7, 8 and 9, consists essentially of a feed drum 90, a retaining drum 91 with a retaining rake 92, an air-conducting plate 94 for supporting a banknote stack 93 and transporting the individual bank notes to the feed drum 90, a pressure plate 95 forming the banknote stack, and an air blast plate 99 attached to the airconducting plate 94 and having several blast openings 96.

The stack of bank notes to be separated is supplied from the direction of the arrow 100 by the bank note conveying section 30*b*, consisting of the belts 102*a*/102*b* and the pulleys 103.

Figure 7A:
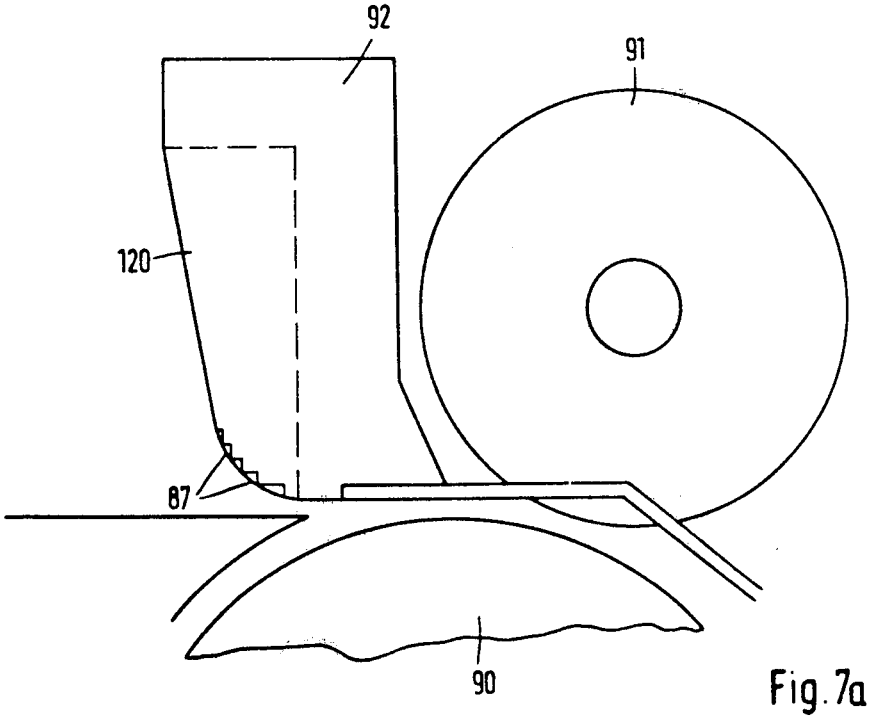
FIG. 7*a* is a side view of the retaining rake.

As shown in FIG. 7, the feed drum 90 rotates in the direction of the arrow 104 on a fixed, concentric rotary slide valve 105. This rotary slide valve has serveral passages 106 which end in an area of opening 107. The area of opening communicates with a vacuum pump (not shown) through the passages 106. The feed drum 90 has only one axial row of suction ports 108 formed in a rubber strip 109. The rubber strip 109, which is flush with the cylindrical surface 110 of the feed drum 90, serves to increase the friction during the sucking of the bank note. The area of opening 107 of the rotary slide valve 105 releases the suction air until, and is adapted so that, the respective bottommost bank note 119 is sucked up with certainty in the region of its leading edge and can be released again after about a quarter turn of the feed drum 90 and passed on to the belts 111, 112 of the bank note conveying section 30*c* following the feeder. To prevent the withdrawal of two bank notes at a time, a retaining drum 91 rotating on a fixed rotary slide valve 113 is provided above the feed drum 90, as shown in FIG. 7. The retaining drum 91 rotates against the feed direction in the direction of the arrow 114. It is designed as a suction drum and carries suction rings 115 arranged side by side and having suction ports 116 evenly distributed along their circumference, as shown in FIG. 8. Since the fixed rotary slide valve 113 has only one port 117, which communicates with a vacuum pump (not shown) through a hollow shaft 118, all bank notes not to be withdrawn and already located in the feed slot 133 formed by the distance between the retaining rake 92 and the feed drum 90, are sucked up by the retaining drum, which turns opposite the feed direction, and are intermittently pushed back into the stack 93. The retaining rake 92, which insures that only the lowermost bank notes in the stack 93 reach the feed drum 90 through the feed slot 133, keeps the bank notes lying further up in the stack 93 away from the retaining drum 91. To exclude the possibility of too many bank notes moving into the feed slot 133 and becoming jammed therein, or of bank notes sliding up the retaining rake 92, the latter has a roughened surface in the form of a toothing 87 at the rounded portion facing the entering stack 93, as shown in FIGS. 7*a* and 7*b*.

The toothing 87, consisting of serveral steps, is shaped so that the gullets extend parallel to the air-conducting plate 94, and the crests perpendicular to the air-conducting plate 94 and, consequently, parallel to the leading edge of the stack 93. With its crests extending parallel to the leading edge of the stack, the toothing thus cancels the feed force components which would result without a toothing at the rounded portion of the retaining rake 92. This prevents the bank notes from sliding up the retaining rake, and those bank notes lying above the feed slot 133 in front of the retaining rake 92 from sliding down.

According to the thickness and quality of the paper of the bank notes to be processed, the toothing may have a different number of steps. In FIGS. 7*a* and 7*b*, a toothing 87 with five steps is shown by way of example.

Figure 7B:
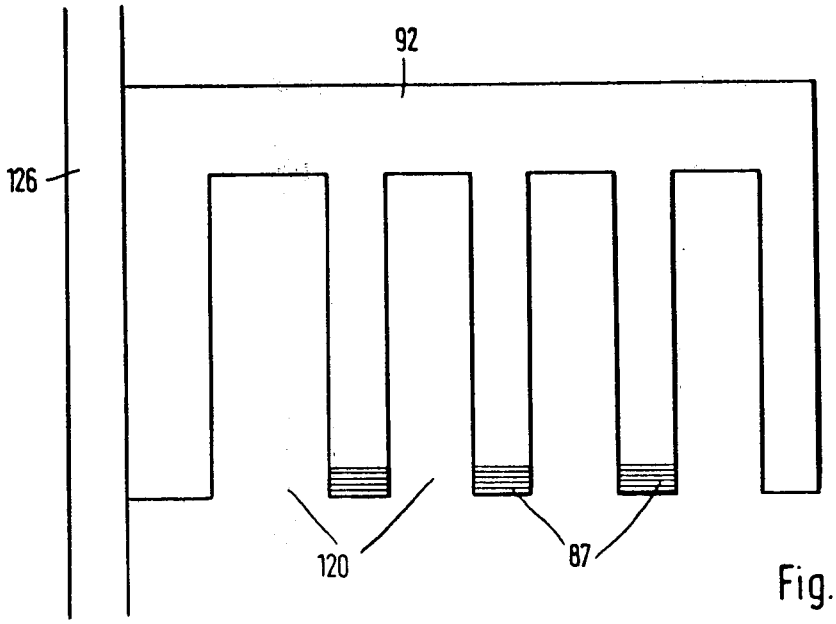
FIG. 7*b* is a front view of the retaining rake.

As can also be seen in FIG. 7*b*, the retaining rake is provided with the teeth 87 in its center portion only. The two outer ends of the retaining rake are not toothed so that dog-eared bank notes (side edges turned up) will not jam in front of the retaining rake 92 but, guided by the curved outer ends of retaining rake, slide into the feed slot. It remains to be mentioned that the retaining rake 92 has slits 120 (see FIGS. 7*b* and 8) which are arranged side by side and with which that side of the pressure plate 95 which faces the retaining drum 91 engages in the manner of comb, thus projecting beyond the leading edge of the stack 93. This prevents the leading edges of the individual bank notes from jamming at the retaining rake 92 as the stack 93 is sinking during the feeding process.

As mentioned above, the retaining drum 91 performs an important function in avoiding the withdrawal of two bank notes at a time by pushing bank notes not to be withdrawn back into the stack 93. However, if bank notes have to be fed from a stack being in a horizontal position, and if particularly limp bank notes have to be processed, the pushing back of bank notes not to be withdrawn from the stack will succeed only if the friction acting on the bank notes to be pushed back and resulting from the dead weight of the stack and from the friction between the back notes is reduced to a minimum by correspondingly loosening the stack. Furthermore, the pushing back of bank notes not to be withdrawn is facilitated by additionally stiffening the respective bank notes.

Another criterion of the fast and safe withdrawal of bank notes from the stack is the avoidance of incorrect withdrawals. To accompish, this, it is necessary to guide the bank notes to be withdrawn into a defined feed position and, in addition, relieve the bank notes of the load of the remaining stack in such a way that they can be easily fed from the bottom of the stack 93 by the feed drum 90.

The above conditions are fulfilled by two essential elements of the feeder shown in FIGS. 7, 8, and 9: the airconducting plate 94, which carries the bank-note stack 93, effects the stiffening of the lowermost bank notes, and guides the bank notes to be withdrawn into a defined feed position to be explained below. An air blast plate 99, which loosens the bank-note stack by means of a lateral air blast, insures together with the air-conducting plate 94 that the respective lowermost bank note 119 to be withdrawn is relieved of the load of the remaining stack 93.

First the construction and function of the air-conducting plate 94 will be explained in detail.

As shown in FIGS. 8 and 9, respectively, in a section taken along line 8—8 of FIG. 7 and in a top view of the feeder, the air-conducting plate 94 consists of a combination of three parallel air-conducting areas 121, 122, and 123 extending in the longitudinal direction of the plate. All areas are provided in like manner with air blast holes 124 which produce a defined air cushion over each area on the known physical principle of the hydrodynamic paradoxon. To accomplish this, compressed air is blown through the holes, inclined with respect to the direction of transport of the bank notes (direction of arrow 125), tangentially between the air-conducting plate 94 and the bank note lying thereon. Since the air stream spreads in all directions after emerging from the hole, its speed at the opening of the hole is considerable higher than that in the vicinity of the hole. As a result, a partial vacuum is created above the hole, and this partial vacuum draws the bank note toward the air-conducting plate 94. It is not until the bank note threatens to close the hole openings that the pressure above the hole increases so that the bank note is pushed away from the plate surface again. In the stationary case, a state of equilibrium is brought about in which the lowermost bank note in the stack 93 hovers at a very low altitude above the air-conducting plate 94. The tangentially emerging air stream now causes an additional feed force, whose direction corresponds to the respective direction of discharge of the holes 124.

As shown in FIG. 9, those two air-conducting areas 121, 122 of the air-conducting plate 94 which are located near a wall 126 of the building block 11 are identical with respect to the arrangement of their holes 124. Here the air blast holes generate a feed force component in the direction of the wall 126 and a feed force component in the direction of the feed drum 90 or the retaining drum 91 since they are inclined toward the wall 126, deviating from the direction of transport (arrow 125) toward the feed drum 90.

The holes 124 of the third air-conducting area 123 of the air-conducting plate 94, deviating from the direction of transport, are inclined toward the air blast plate 99, producing a feed force component in the direction of the feed drum 90 and a feed force component directed away from the wall 126 toward the air blast plate 99.

Through the divergent arrangement of the holes 124, the respective lowermost of the bank notes lying on the airconducting plate 94 are forced, by being stretched so to speak, into a plane position which increases the stiffness of these bank notes. To avoid irregularities in the plane position due to stagnation of air, vent holes 127 are provided between the air-conducting areas 121, 122 of the airconducting plate to permit any air having accumulated there to flow off (arrow 98).

Similarly, holes 128 in the back wall 126 and vent areas 129, in the air blast plate 99, insure that the longitudinal edges of the lowermost bank notes lying on the air-conducting plate 94 will not "flutter" or turn up as a result of air accumulating there. Besides having a different direction of flow, the third air-conducting area 123 of the air-conducting plate 94 differs from the other areas 121, 122 in that its surface in the area of the longitudinal edge opposite the wall 126 is bevelled toward the side further from the stack 93, whereby, as shown in FIG. 8, the bottommost bank note 119 lying on the air-conducting plate 94 is drawn from the stack downwards at its longitudinal edge as a result of the partial vacuum created there as explained above. Compressed air is selectively blown into the resulting wedge-shaped opening 130 so as to relieve the bottommost bank note 119 lying on the air-conducting plate 94 of the stack 93 lying thereon.

Besides performing the task of stiffening the bank notes over their entire area, the air-conducting plate 94 is responsible for guiding the bank notes lying in the lower portion of the stack into a defined feed position through its different feed force components. The feed position has been reached when the respective bank notes hit the vertical wall 126 with one longitudinal edge and lie with the leading edge, pointing in the direction of transport (arrow 125) in front of the retaining drum 91 above the suction ports 108 of the feed drum 90

(FIG. 8) before being grasped by the feed drum 90 and withdrawn from the stack 93.

As shown in the sectional view of FIG. 8, the last element to be explained-the air blast plate 99-is attached to one side of the air-conducting plate 94 by means of two holders 97. It has a number of air blast holes 96 arranged horizontally side by side and extending on a level with the surface of the air-conducting plate and parallel to the bevelled portion the longitudinal edge of the air-conducting plate, as shown in FIG. 8. As can be seen from FIG. 9, the air blast holes 96 are inclined in the direction of transport (arrow 125) to support the general feed action of the air-conducting plate 94. The air blast holes 96 communicate with a timed pressure source (not shown) through a common pipe 131. The timing is synchronous with the feeding, i.e. the lateral air blast is blown into the wedge-shaped opening 130 between the bank note 119 to be fed and the stack 93 thereon only during the feeding process to create a second air cushion in this opening. Thus the feed drum 90 can feed the bank note 119 from the bottom of the stack under very favorable frictional conditions.

To avoid the stagnation of air on the bevelled portion of the air-conducting plate 94, vent areas 129 are provided below the air blast holes 96 to permit the air to escape in the direction of the arrow 89.

After the description of those functional elements of the feeder which are thought necessary for a thorough understanding of the invention, the individual phases of the bank-note feeding from the entry of the stack to the dispensation of bank notes will be described. It will be assumed that the last bank note of a stack located in the feeder has just been fed from the stack. Thereafter, referring again to FIG. 7, a reflected-light path 134 positioned above the air-conducting plate 94 is interrupted, whereupon a new packet freed from the revenue stamp is transported to the air-conducting plate 94 on the conveying section **30*b*. The conveying section 30*b* is designed so that its lower belts 102*a* run slightly faster than the upper belts 102*b*. As a result, the bank notes lying in the lower portion of the stack are withdrawn a little from the stack so that the leading edges of the bank notes form a wedge pointing in the direction of transport. Like the above-explained special design of the retaining rake 92 (teeth $_{87}$), this measure serves to prevent any bank-note jam in the feed slot 133. The entry of the stack into the feeder is secured by a rake 135 extending into the lower pulley 103 and by the pressure plate 95 engaging the upper pulley 103 like a comb. The stack 93 is now advanced up to the retaining rake 92 or the retaining drum 91 by its inertia and by the air cushion of the air-conducting plate. After the introduction of the stack, a stack-pressing plate 95 is lowered in the direction of the arrow 137**, thus forming the stack by slight pressure and exerting a uniform bearing pressure during the whole feeding process.

Already during the introduction of the stack, the bank notes lying in the lower portion of the stack, because of the special characteristic of the air-conducting plate 94, are pushed along the vertical wall 126 into the feed slot 133 until their leading edges hit the suction rings 115 of the retaining drum 91. Because of the air cushion meanwhile made by the air-conducting plate 94, and of the sucking and feeding action associated therewith, the stack thus rests prepositioned in the feeder. The longitudinal edge of the bank note at the bottom of the stack, which edge is located above the bevelled portion 123 of the air-conducting plate 94, is turned down. The leading edge of the bank note 119, pointing in the feed direction, lies with its bottom side on the feed drum 90. As soon as the ports 108 of the feed drum 90 move into the area of opening 107 of the rotary slide valve 105, the leading edge of the bank note 119 at the bottom of the stack is sucked up. About at the same time, the air blast holes 96 arranged side by side in the air blast plate 94 are connected to a compressed-air source so that compressed air is additionally blown along the entire bank-note stack between the bank note to be fed and the stack lying thereon. Thus the bank note, unloaded by air cushions, can be easily withdrawn from the stack. As soon as the ports 108 have crossed the area of opening 107 of the rotary slide valve 105, the vacuum within the ports 108 is cancelled. The leading edge of the bank note separates from the feed drum and can thus enter into the following conveying section **30*c* with the belts 111, 112. When the bank note has been completely withdrawn from the stack, the compressed air flowing through the lateral air blast hole 96 of the air blast plate 99 is cut off. This insures that the next bank note to be fed can bend down at its longitudinal edge according to the bevelled portion 123 of the air-conducting plate 94** and to the partial vacuum created there.

An extension **92*a* of the retaining rake 92 guides the bank notes fed from the stack and introduces the leading edges of the bank notes into the subsequent conveying section 30*c***.

The remaining bank notes of the stack are retained or pushed back into the stack by the retaining drum 91. The range of action of the retaining air is limited to the port width 117 of the rotary slide valve 113 of the retaining drum 91.

Immediately after having been fed from the stack, as shown in FIG. 6, the individual bank notes pass through the reject sensor S O, whose function was explained at the beginning.

All those bank notes considered suitable for continued trouble-free transport on the basis of the test by the reject sensor S O, then move in the direction of the arrow 82 and enter the following building block 12 at the point indicated by the arrow 137, as shown in FIG. 6. In the building block 12, the general testing of the bank notes is carried out.

To make the individual building blocks 10–18 interchangeable and combinable in the intended manner, each building block has separate, independent conveying sections. Particularly at the crossovers (arrow 137) of the conveying systems 30, 32 from one building block to another, this results in short interruptions in the transport path where the bank notes are transported with reduced guidance for a short time and where transport disturbances would therefore be possible. To insure a smooth transfer of the bank notes, a reversible wave profile is therefore impressed on the bank notes in these areas by a special design of the pulley pairs, which profile considerably increases the longitudinal stiffness of the paper and thus prevents the leading edge of the bank note from bending before entering the conveying system of the following building block. To prevent the bank note from being crushed when entering the receiving pair of pulleys, the receiving pair of pulleys has the same protuberances as the delivering pair.

Figure 11:
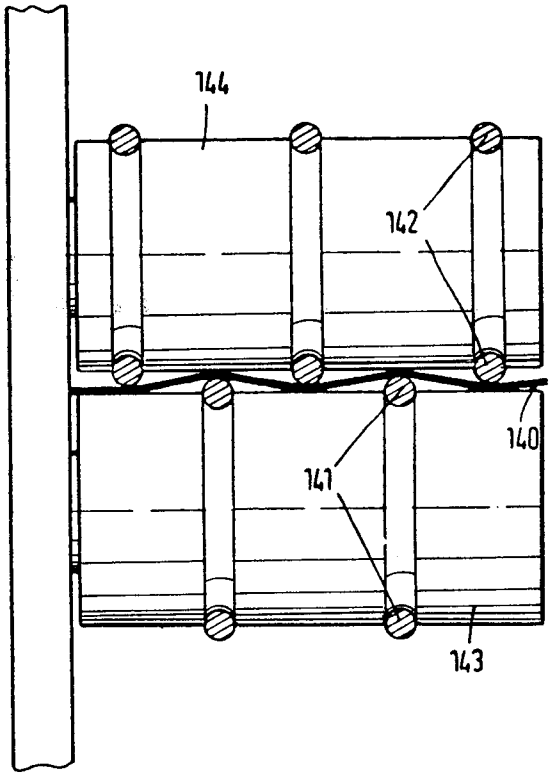
FIG. 11 shows the free-flight path in a section taken along line 11—11 of FIG. 10.
Figure 10:
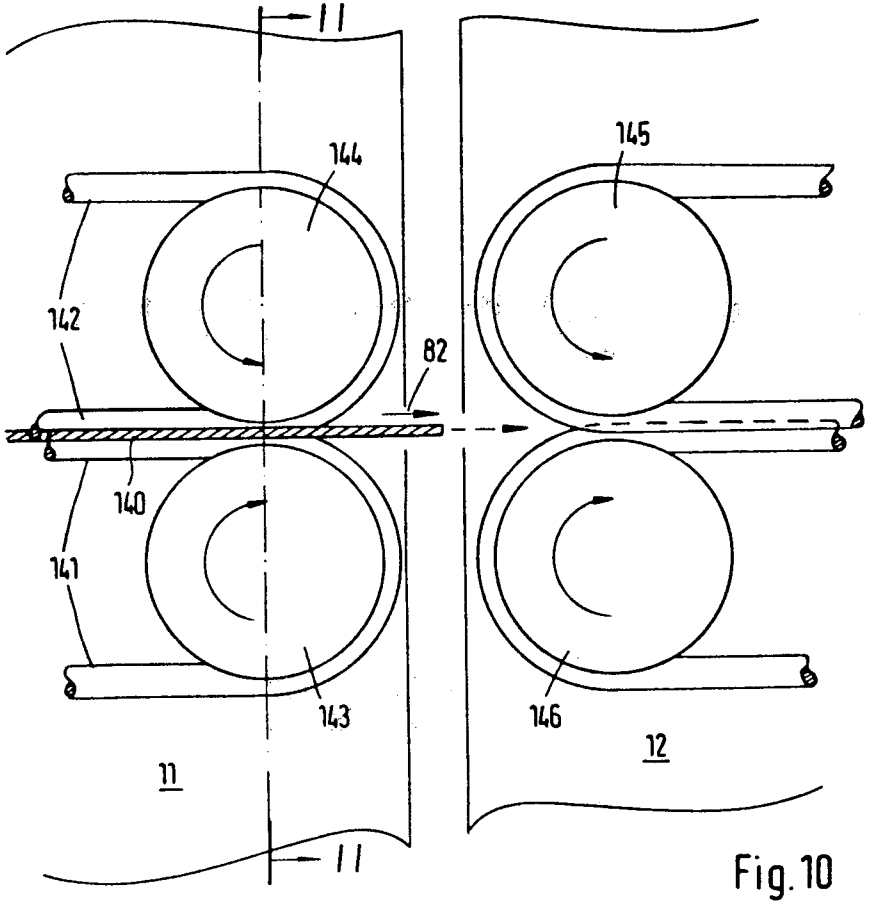
FIG. 10 shows two building blocks with a free-flight path according to a feature of the invention.

FIGS. 10 and 11 show such a guideless separation between the building blocks 11 and 12 with the pulleys 143, 144 and 145, 146, respectively. The sectional view of FIG. 11 (section taken along line 11-11 of FIG. 10)

shows one possibility of forming the protuberances of the pulleys 143, 144. The conveyor belts 141, 142 project beyond the surfaces of the pulleys 143, 144. It can also be seen, in FIG. 11, that the conveyor belts 141 of the pulley 143 are staggered with respect to the conveyor belts 142 of the pulley 144 so that the protuberances formed by the belts are in engagement. This results in the illustrated deformation of the bank note 140 during transport.

BUILDING BLOCK 12 FOR THE GENERAL TESTING OF THE BANK NOTES (FIGS. 2, 12)

Figure 12:
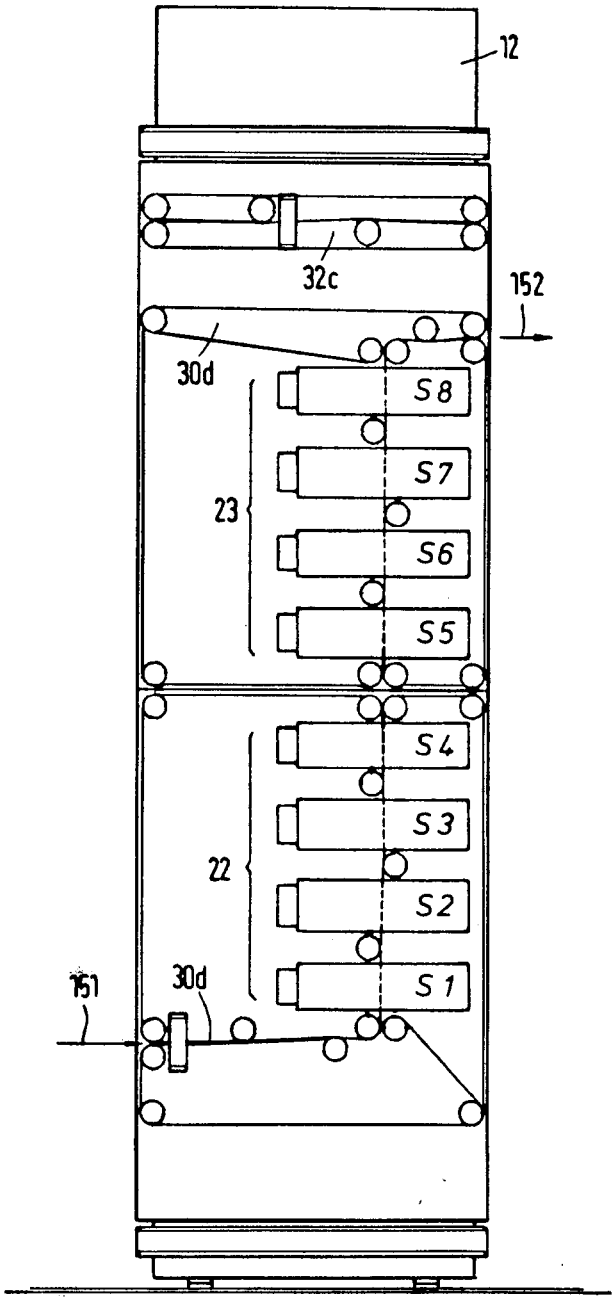
FIG. 12 shows the building block "bank-note testing"

The building block 12 shown in FIG. 12 houses the measuring section of the sorter with the sensors S1–S8. This system unit is responsible for sensing the condition of, and verifying, the bank notes. It is divided into two sections 22, 23. The first section 22 tests only those criteria which give information on the condition of a bank note, while the section 23 checks marks characteristic of the genuineness of a bank note. The individual bank notes enter the bank note conveying section **30*d* of the building block 12 in the place marked by the arrow 151, pass through the eight sensors S1–S4, S5–S8, and are forwarded to the following building block 13 in the place marked with the arrow 152**.

An essential feature of all sensors used in the building block 12 is that they have standardized, i.e. uniform interfaces. The standardization is insured by three specific interface characteristics:

the mechanical interface,
the electrical interface, and
the logic interface.

The mechanical standardization of the sensors provides for uniform external dimensions of the sensor cases irrespective of the sensor design, and for uniform mounting mechanisms such a plug arrangements and the like. This insures that theoretically, any type of sensor can be mounted at any testing point of the measuring section without additional modifications. Electrically, the sensors are designed so that they are supplied from the common power supply unit of the sorter via like connectors and like contact arrangement. To keep external disturbances away from the sensors, each sensor contains an isolated power supply of its own where the stabilized and sensor-specific voltage and current levels requred for the different sensors are conditioned.

Figure 13:
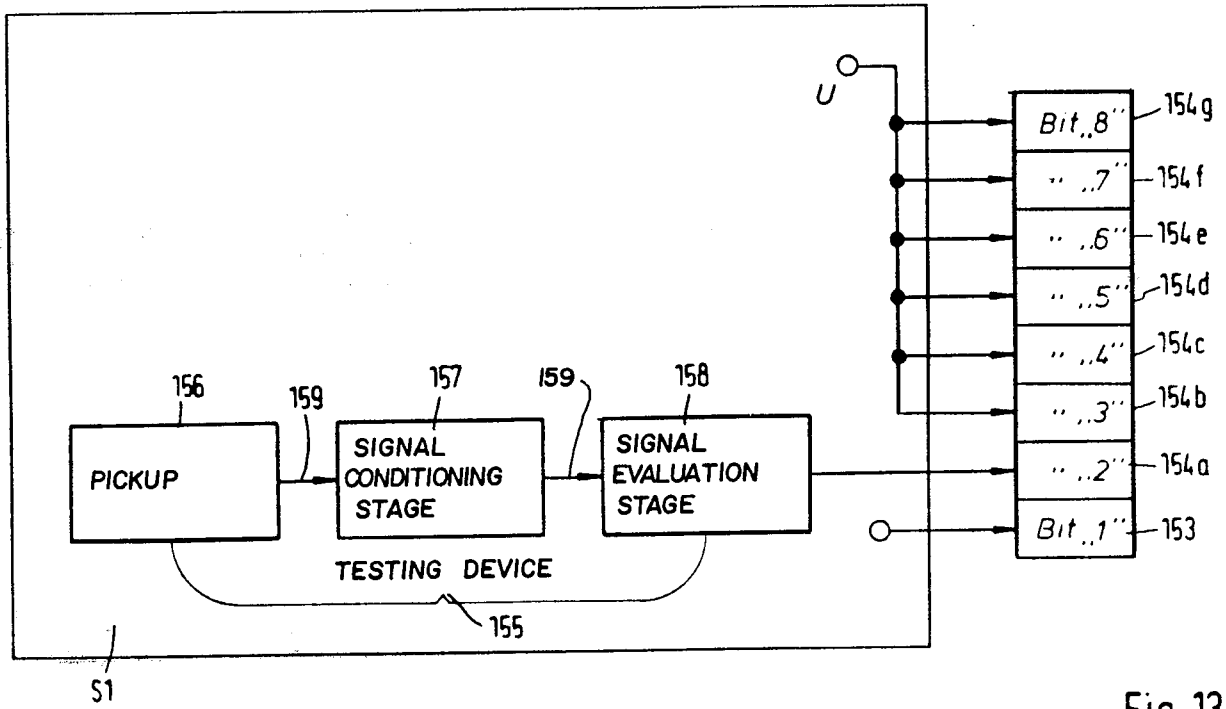
FIG. 13 is a schematic representation of a sensor.

As shown by way of example in the block diagram of FIG. 13, the logic interface of each sensor is also uniformly designed in such a way that the test information of a sensor is represented in an eight-bit test word. For simple processing, each test result is provided by the sensor as binary information (test positive/negative). An additional bit 153 is needed to check the operation. Thus it is possible to test for a maximum of seven criteria (bit "2"-bit "8") in each sensor, which may be necessary, for example, if several tests are conducted in one case.

The sensors used in the building block 12, however, measure only one secific criterion of a bank note each, so each sensor has one testing device 155, as shown in the block diagram of FIG. 13. A testing device consists essentially of a pickup 156, a signal conditioning stage 157, and a signal evaluation stage 158. The information flow within the testing device is indicated by arrows 159. The function of the pickup 156 of the testing device 155 is to sense to bank-note characteristic to be tested and convert it into an electrical signal. The signal conditioning stage 157 makes the signal of the pickup suitable for evaluation. In the last stage of the testing section 155, the signal evaluation stage 158, the signal comming from the signal conditioning stage is evaluated according to predetermined criteria and converted into a yes/no signal for further processing. Thus the interface signal of the testing section 155 has been reduced to one bit. As shown in FIG. 13, this bit is transferred to the bit position "bit 2", designated **154*a*, of the common interface of the sensor S1. In the sensor S1 shown, the remaining, unoccupied bit positions 154*b*–154*g*** are held at constant potential by a suitable connection.

In the embodiment of FIG. 12, showing the measuring section of the building block 12 comprising the sensors S1–S8, the bank notes first pass through the sensors S1–S4 for testing their condition. These sensors determine whether the bank notes must be considered circulable or noncirculable for further processing on the basis of their general appearance and of their condition. Besides the detection of holes in the bank notes, dog-ears, adhesive tapes, or other condition characteristics, the degree of contamination of the bank notes, for example, is used here to judge their condition. Since, according to the currency and the banknote type, optimum testing may be performed by very different sensors, and since devices for testing the genuineness and condition of bank notes are known in a wide variety of designs, the two sensor types (condition, genuineness) will be described separately in the following.

Figure 14:
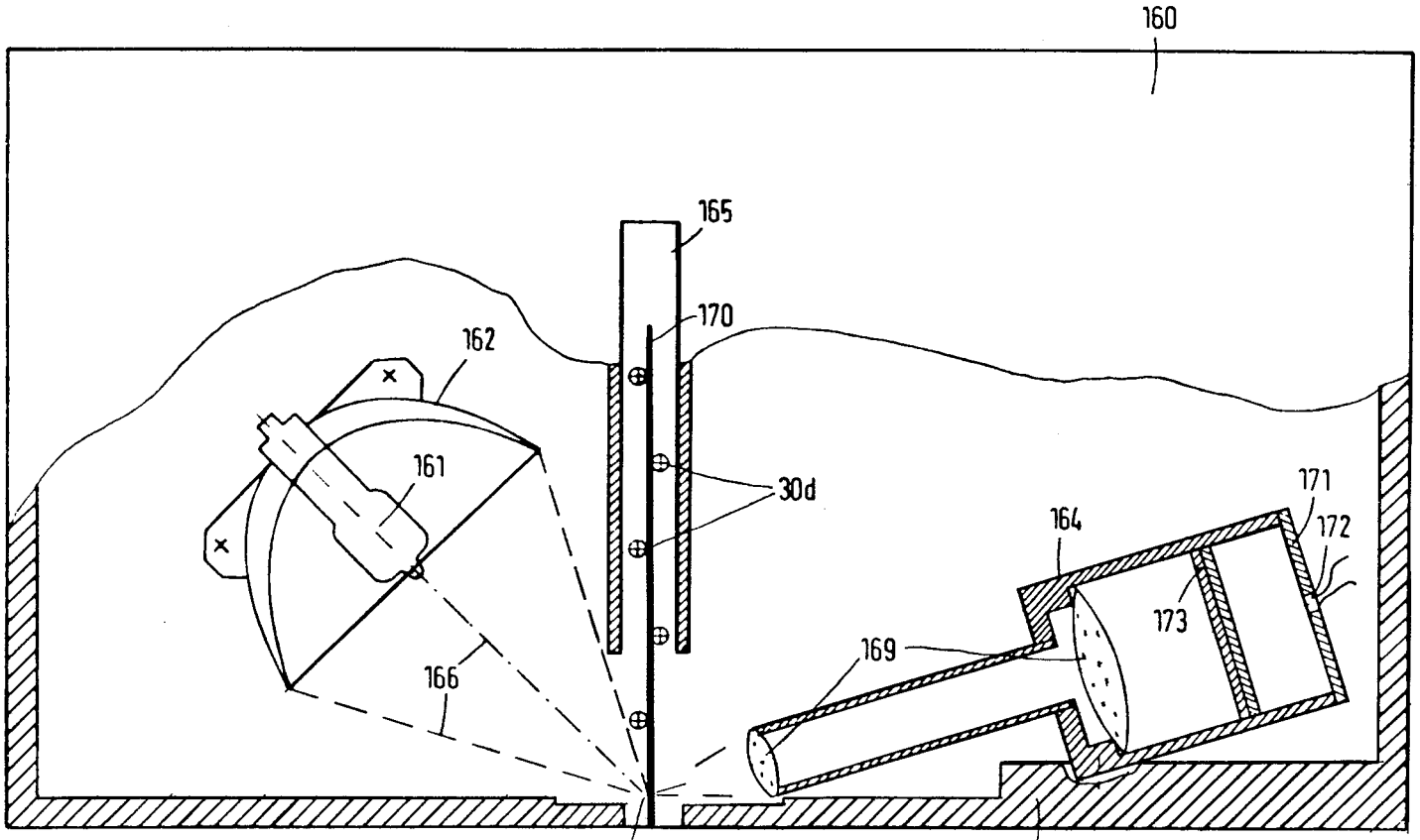
FIG. 14 shows a sensor for sensing the condition of bank notes.

Thus FIG. 14 shows a testing device with which the contamination of a bank note can be determined according to the scheme of the testing device 155 shown in FIG. 13. From the contamination, conclusions can be drawn with respect to the circulability or noncirculability of the bank note.

As shown in FIG. 14, during the contamination measurement, made by measuring the contrast at the edge of the bank note, the contaminated areas in the folds are judged relative to the uncontaminated areas and are thus used to determine the degree on contamination.

The testing device, housed in a light-tight case 160, consists of a light source 161 with an ellipsoid mirror 162, the bank note conveying system **30*d*, and a light-receiving system 164. The case 160 has a narrow feed and delivery slot 165 for the introduction and delivery of the bank notes. The ellipsoid mirror 162, as indicated by the dashed beam path 166 of the light source 161, focuses the radiation of the light source 161 on the middle of the lower edge 167 of a bank note 170, which is guided with the aid of the testing device 160**.

Figure 15:
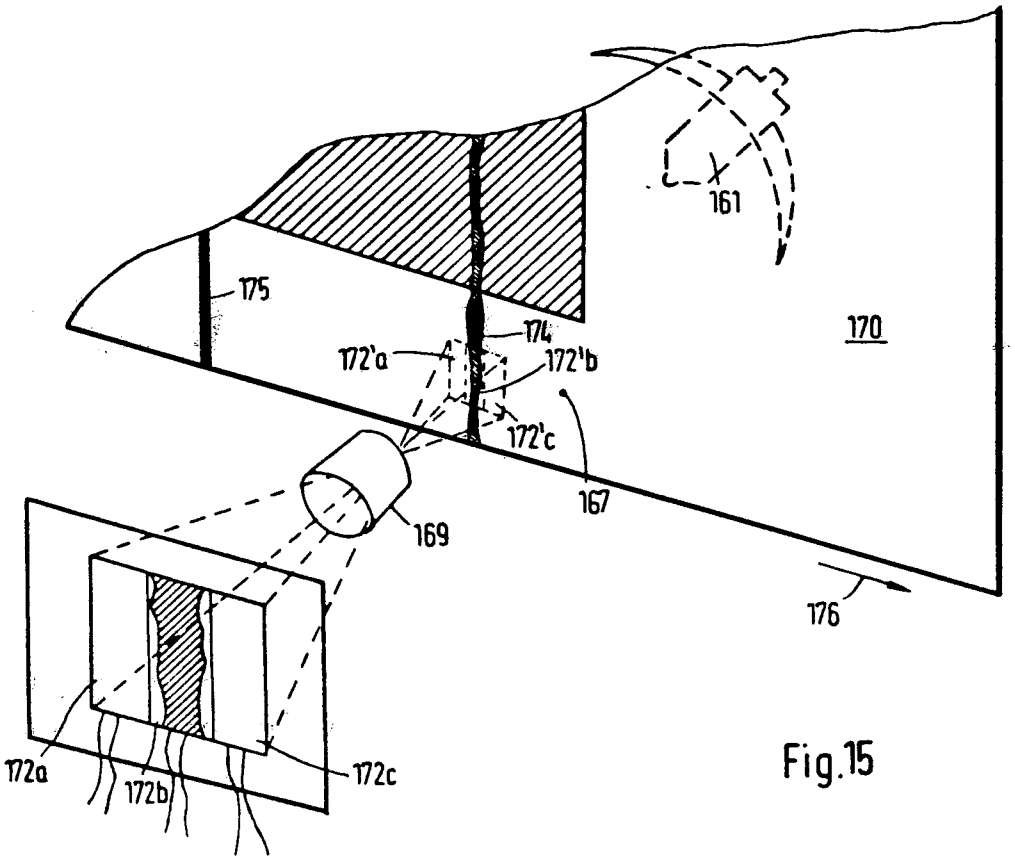
FIG. 15 shows a schematic arrangement of the sensor of FIG. 14.

The receiving system 164 is permanently mounted on a base plate 168 opposite the lights source 162. In principle, it is designed as a microscope which projects through its lens system 169 the picture elements of the lower edge of the bank note 170 enlarged upon the sensor unit 172 provided at a rear cover plate 171. As shown in FIG. 15, the sensor unit 172 consists of three photodiodes **172*a*, 172*b*, 172*c* arranged immediately side by side; in FIG. 14, they are arranged one behind the other perpendicular to the plane of the paper. A filter combination 173 disposed between the lens system 169 and the sensor unit 172** selects from the incident radiation the spectral components of the light which are best suited for evaluating the contamination.

FIG. 15 shows a part of the bank note 170 to be tested in which a contaminated fold 174 is illustrated excessively large. As can be seen from FIG. 15, such a fold 174 contrasts very well against its surrounding area especially at an unprinted bank-note edge 167. The schematically shown lens system 169 is so designed that the actually present sensor unit 172, consisting of three photo diodes 172a, 172b, 172c is so projected upon the edge of the bank note that the individual virtually present photo-diodes 172'a, 172'b, 172'c, shown by broken lines in FIG. 15, are about as wide as the contaminated fold.

A safety thread in the bank note is designated by the reference numeral 175.

When the bank note 170 moves in the direction indicated by the arrow 176, the lower edge 167 of the bank note will be gradually covered by the photo diodes 172a, 172b, 172c. The light coming from the light source 161 and passing through the bank note falls through the lens system 169 on the individual photo diodes, which generate an electric signal according to the light quantity received.

FIG. 15 shows the instant where the middle one, 172b, 172'b, of the three photodiodes is covered almost completely by a contaminated fold 174, thus receiving a considerably smaller light quantity than the neighboring photo diodes 172a, 172c and, consequently, providing a considerably smaller output signal. By relating the photo-diode signals to each other, a signal is obtained which clearly differs from that of an uncontaminated area.

Figure 16:
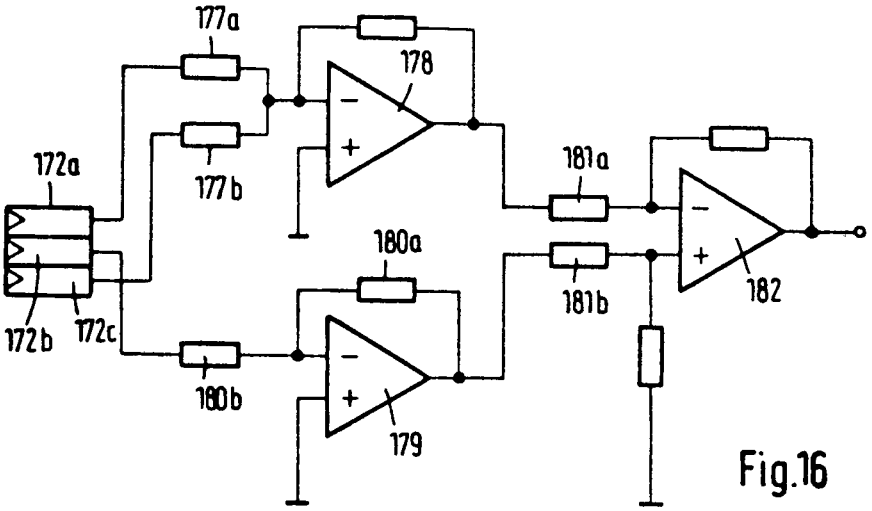
FIG. 16 shows a circuit arrangement of the sensor of FIG. 14.

FIG. 16 shows a circuit arrangement in which the output signals of the three photo-diodes are so interconnected that the difference between the sum of the signals of the two outer photo diodes 172a, 172c and twice the signal value of the middle photo-diode 172b if formed. The signals of the two outer photo-diodes 172a, 172c are combined via resistors 177a, 177b and applied to a summing stage 178. The resistors 180a, 180b of an amplifier stage 179 are chosen so that the signal of the middle photo diode 172b, which is applied to this amplifier stage, is doubled. The outputs of the summing stage and of the amplifier stage are then, respectively, fed to the two inputs of a subtracting stage 182 through resistors 181a, 181b.

Figure 17:
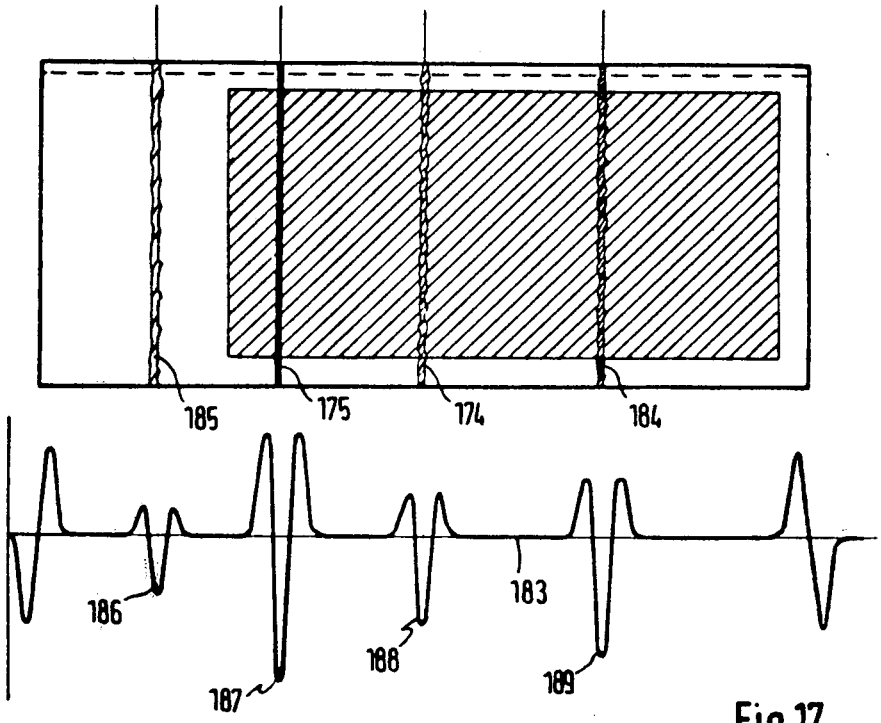
FIG. 17 shows a tested bank note with the corresponding waveform of a bank note.

The signal waveform 183 appearing at the output of the subtracting stage 182 during the passage of a bank note through the testing device is shown schematically in FIG. 17. For the sake of simplicity, the bank note 170 illustrated in FIG. 17 is shown having only three folds 174, 184, 185 varying in contamination, and the safety thread 175. The above-mentioned waveform 183 clearly shows the signal variations 186–189 which are dependent on the degree of contamination, and therefore, differ. The saftey thread 175 darkens a photo diode completely and, therefore, causes a correspondingly large signal variation 187.

The above-explained circuit arrangement (FIG. 16) thus provides a signal which takes into account only the partial contrasts at the edge of the bank note. By subtraction of the photocell signals, the paper brightnesses or opacities, which vary from one bank note to another, are not evaluated.

The waveform 183 appearing at the output of the subtracting stage 182 is fed to an evaluating unit (not shown in the figures) which consists of an intergrator summing the signal peaks, and of a following comparator which compares the output signal, summed after the passage of the bank note through the testing device and depending on the degree of contamination and the number of contaminated areas in the folds, with a presettable threshold value. The signal peaks caused by the safety thread 175 and during the entry of the bank note into, and its exit from, the testing device, are blanked. If the summed output signal of the integrator remains below a preset threshold level of the comparator, the tested bank note has been classified as usable and, thus, circulable. Otherwise, too great a number of heavily contaminated folds causes the threshold value to be exeeded, and the bank note is classified as unusable.

With the above-described testing method, a yes/no signal is thus generated for each bank note, which signal is first stored together with the results of the remaining sensors and then used to control the respective sorting gates in the subsequent units as will be explained below.

After their condition has been examined, the bank notes are tested for genuineness in the sensors S5–S8 of the second testing section 23. Substitutionally for the sensors S5–S8, a device will be described by way of example which measures the thickness differences in the area of the watermark to test a bank note for genuineness.

Figure 18:
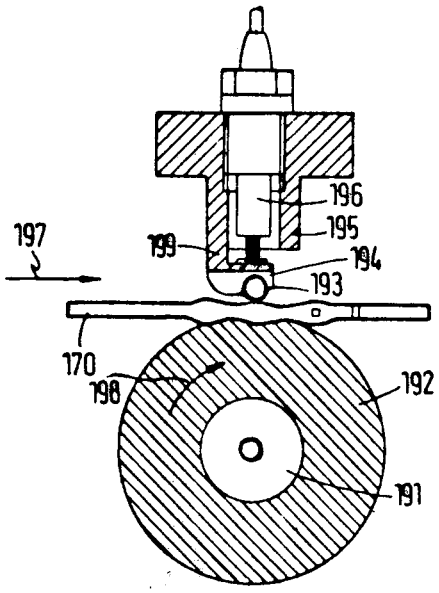
FIG. 18 shows a sensor for verification.
Figure 19:
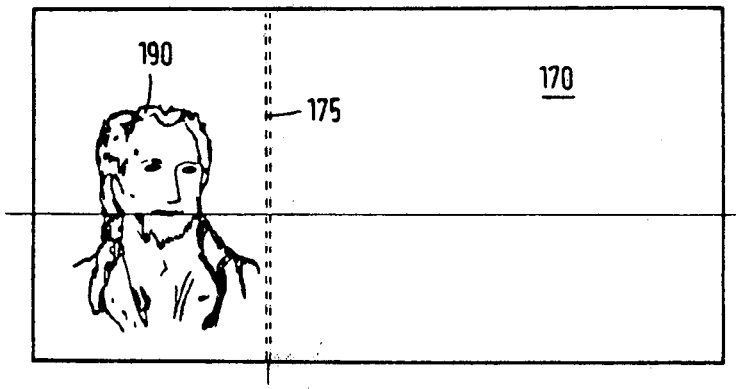
FIG. 19 shows a bank note with watermark and safety thread.

FIG. 18 shows a thickness tester with which a bank note 170 provided with a watermark 190 can be tested (see FIG. 19). The tester substantially comprises a roll 191 rotatably mounted in the housing (not shown) of the tester by means of the fixed bearing and having an elastic surface 192, a sensor 194 equipped with a sensing roll 193, and a transducer 196 which, designed as a piezoelectric transducer, is mounted rigidly relative to the fixed bearing, and is in permanent contact with the sensor 194. The sensor 194 and the transducer 196 are preferably so mounted above the roll 191, 192, which is driven by the conveyor system, that even the thinnest spot of the test piece 170 will yield a signal component capable of being evaluated.

As can also be seen from FIG. 18, the bank note 170, supplied from the direction of the arrow 197, is grasped upon reaching the point where the sensing roll 193 and the roll 191, 192, driven in the direction of the arrow 198, are standing opposite each other, and is pulled between the sensing roll 193 and the roll 191, 192. According to the thickness of the paper, the elastic material 192 of the roll 191 will be more or less compressed, and a more or less great force will act on the sensing roll 193 and, consequently, via the transducer pin 195 on the transducer 196, which force will generate a proportional voltage in the structure of the piezoelectric crystal. To permit the respective forces to act on the piezoelectric crystal of the transducer 196, it is necessary to slightly deflect a transducer pin 195 in an axial direction, i.e. in the direction of the crystal, which is made possible by the a relatively thin elastic arm 199 of the sensor and transducer mounting. Since, according to the transducer used, these deflections lie in the range of one thousandth of a millimeter even if the thickness differences amount only to a few tenths of a millimeter, they can be neglected in the following considerations. To indicate this fact, the sensor is, therefore, referred to as being "quasi-rigid".

Since piezoelectric transducers are commercially available, their operation will not be described here.

If the bank note 170 is pased between the roll 191, 192 and the sensor 194 in the direction of the arrow 197, the sensing roll 193 of the quasi-rigidly mounted sensor 194 will press it more or less deeply, depending on the thickness of the paper, into the elastic material 192 of the roll 191. Since the elastic surface of the roll acts as a spring, forces are produced which generate in the transducer 196 the desired voltage signals proportional to the thickness of the paper. These signals are conditioned, in known manner, for further processing.

The generation of the measuring signal will now be explained in more detail with the aid of FIGS. 19 and 20. FIG. 19 shows schematically a bank note 170 with different thickness changes. The portrait watermark 190 is followed by the safety thread 175.

Figure 20:
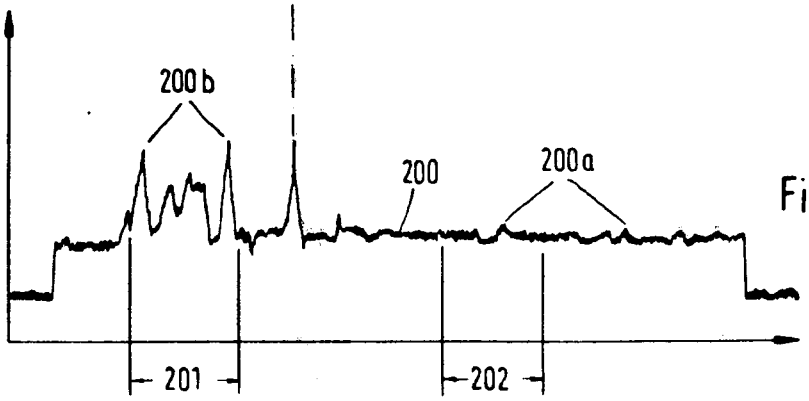
FIG. 20 shows the signal waveform of the sensor of FIG. 18.

FIG. 20 shows the output signal waveform of the transducer 196 during the measurement of the bank note 170 shown in FIG. 19. In the initial state. the signal voltage 200 of the transducer 196 is nearly zero, leaving a slight noise level out of account. After the bank note has entered the meter, the signal voltage 200 rises steeply to a level which corresponds to the thickness of the paper. Since the bank note paper partially consists of very coarse paper fibers, and since the steel intaglio influences the thickness profile of the paper, more or less, large signal voltages 200*a* are obtained in those areas where no deliberate thickness changes have been made. Since this noise, which is due to the paper cloudiness and the print, is much finer and has considerably smaller amplitudes, however, it differs quite clearly from the thickness-change signals 200*b* of the watermark area 190 and of the safety thread 175.

Thus the varying signal waveform in certain area can be used to decide on the genuineness of a bank note.

For evaluation, the signal peaks 200*b* in the area 201 of the watermark 190 are summed by means of an integrator (not shown). The output signal of the integrator is then compared with the output signal of a second integrator which integrates the signal waveform in another area, designated 202 in FIG. 20. If the watermark integrator sums more than the comparing integrator, the bank note is classified as genuine.

Another possibility of evaluating the signal 200 shown in FIG. 20 is to compare the whole waveform with a reference curve stored in a comparing circuit (not shown). The reference curve is a waveform obtained by testing a genuine bank note.

Analogously to the testing of the condition, the yes/no information of the above-described testing device (genuineness sensor) is first stored together with the information of the remaining genuineness sensors (S5–S8)-FIG. 12-in a data record belonging to the tested bank note. After a bank note has passed through all measuring sections 22–23, all results of the sensors (S1–S8; FIG. 12) are evaluated for the control of the respective sorting gates in the subsequent sorting blocks 13–18. The evaluation of the results will be explained below in connection with the description of the information-processing system. Besides testing the condition and genuineness of bank notes, the measuring sections 22, 23 in the building block 12 (FIG. 12), represented by the sensors S1–S8, checks whether the bank notes to be sorted correspond to the type of bank note being processed. Thus the value and currency of the bank note are tested, and all bank notes not corresponding to the value and/or currency of the type of bank note being processed are rejected in a manner explained below.

The sorting block 13–18 (see FIG. 2) will now be described in detail.

Figure 21:
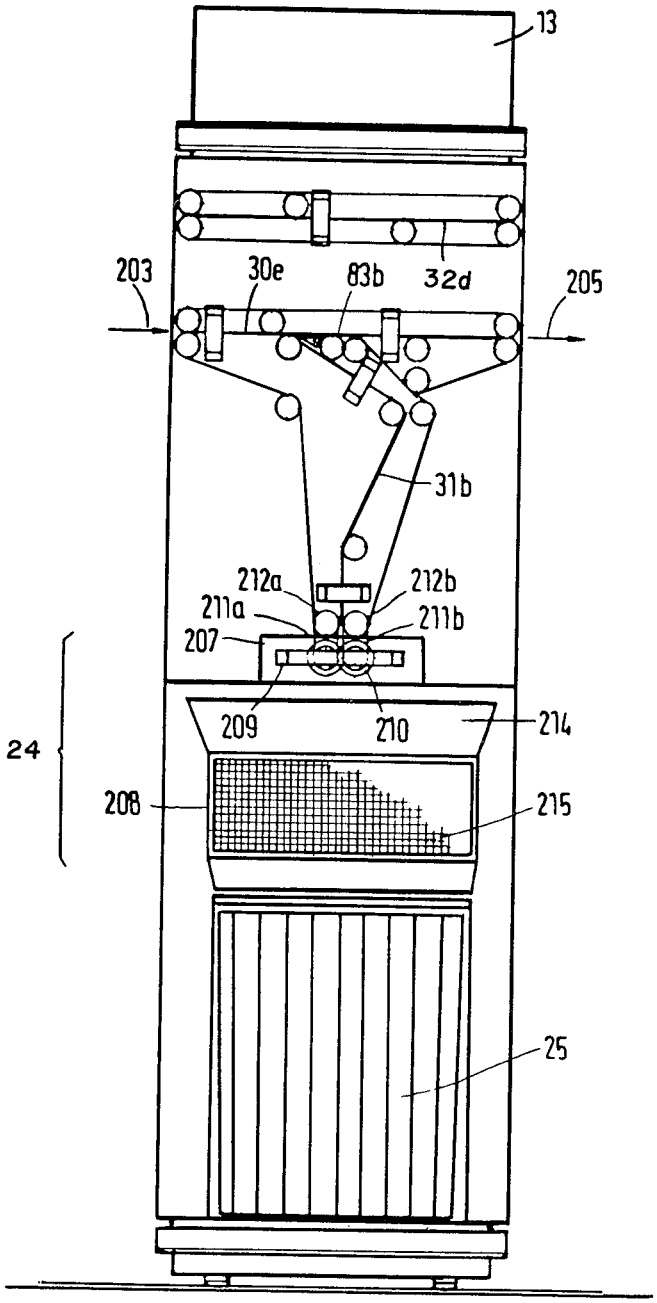
FIG. 21 shows the building block "shredder"

BUILDING BLOCK 13 FOR DESTROYING NONCIRCULABLE, GENUINE BANK NOTES (FIG. 2, FIG. 21)

The building block 13, shown in FIGS. 2 and 21, is responsible for the irreversible, complete destruction of the bank notes identified in the preceding measuring sections 22, 23 of the building block 12 as genuine but not circulable.

The tested bank notes enter the conveying section 30*e* of the building block 13 at the point marked with the arrow 203. Immediately after their entry, they reach a sorting gate 83*b* which allows the bank notes identified as circulable in the measuring section 22, 23 of the preceeding building block 12 to remain in the original conveying section 30*e* leading to the following building block 14 in the direction of the arrow 205, and directs the bank notes considered noncirculable via a branching conveying section 31*b* into the double shredder system 24 for destruction.

The shredder block 13 can be used as an alternative to or in combination with the two following building blocks 14, 15, which will be explained below. In the building blocks 14, 15, the noncirculable bank notes are stacked in selectable quantities without being destroyed.

The double shredder system 24 of the building block 13 will now be explained with the aid of FIG. 21.

It consists of two shredder systems 207, 208 arranged one on top of an other. The first shredder system 207 is formed by a pair of cutting rolls 209, 210. It receives the bank notes directly from the conveying section 31*b* and cuts them into narrow longitudinal strips. Since the cutting rolls 209, 210 are connected directly with the head pulleys 212*a*, 212*b* of the conveying section 31*b* via conveyor belts 211*a*, 211*b*, they rotate at the transport speed of the remaining system. In addition, the direct connection between the first shredder system 207 and the conveying section 31*b* insures that the bank notes intended for the building block 13 are passed through the first shredder system with certainty. Any undetected loss of bank notes is thus impossible.

The first shredder system 207 is followed by a second one, 208, which receives the longitudinal strips, supplied at the transport speed, via a filling funnel 214, and processes them into shreds of very small size. Its cutting rolls 215, as seen by the viewer, are arranged one behind the other, transversely to the cutting rolls 209, 210 of the first shredder system, and, unlike those in the first system, rotate at a slower speed. Thus a deliberate mixture of the supplied strips is achieved. To avoid jamming, the capacity of the second shredder system, because of its larger rolls, is much higher than that of first shredder system, whereby the speed difference is compensated for. The second shredder system 208 again cuts the bank-note strips both longitudinally and transversely. The shreds leaving the second shredder system are collected in a shred container 25.

Because of the minimum size of the shreds, the container contents always have a high packing density, which is of great advantage for further processing—for example, for transport to an incinerating plant. Since even the largest shreds delivered by the double shredder system 24 have an area of not more than a few square millimeters, the possibility of fraudulent use of the shredder contents can be ruled out with nearly absolute certainty.

Figure 22:
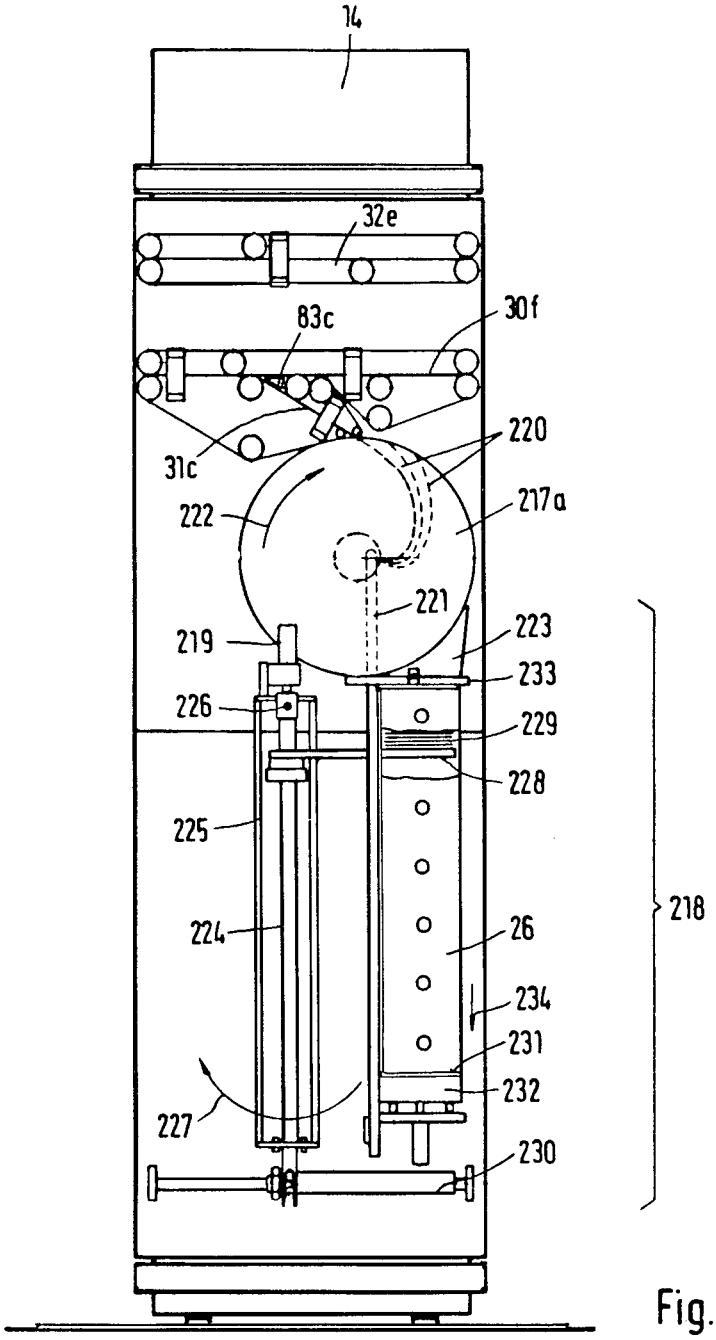
FIG. 22 shows the building block for "non-circulable bank notes"

BUILDING BLOCKS 14 AND 15 FOR RECEIVING NONCIRCULABLE, GENUINE BANK NOTES (FIG. 2, FIG. 22)

The building block 14, which as noted hereinbefore is identical in construction with building block 15, for receiving noncirculable bank notes, shown in FIG. 22, essentially comprises, besides the revenue stamp conveying section 32e and the bank note conveying sections 30f and 31c, a sorting gate 83c for diverting the noncirculable bank notes (NU-BN) as well as a stacker drum 217a and a stacking unit 218 with a receptacle 26. This stacking system is provided in duplicate (tandem operation) as an alternative to the shredder block 13 and consists of a building block 14 and a building block 15, as shown in FIG. 2. In the building blocks, as required, either all noncirculable bank notes are collected in large receptacles 26, 27 mostly holding 3,000 or 5,000 bank notes—in this case the shredder block 13 is at rest—or test series are collected at certain time intervals with the aid of which the correct operation and the sorting accuracy of the whole apparatus can be checked. During routine test runs of the sorter and during all servicing work, bypassing the shredder block 13 is unavoidable in most cases.

The duplicate design of the stacking system for noncirculable bank notes is necessary because of the sorter's high transport speed. Since it is possible to switch from the first building block 14 for noncirculable bank notes to the following building block 15 of identical construction, the full working speed can be maintained even when the receptacle 26 or 27 is being changed.

When the shredder block 13 is off, the bank notes classified as noncirculable in the measuring section 22, 23 of the building block 12 are diverted in the building block 14 by the sorting gate 83c and conveyed on the conveying section 31c to a stacker drum 217a. In the stacker drum 217a, the bank notes, supplied at a high speed are first braked and then stacked, in quantities of 3,000 or 5,000 according to type, in a receptacle 26 adjacent to the stacker drum 217a. The full receptacle 26 can be removed from the building block 14 and replaced by an empty one. During this processing phase, the bank notes considered uncirculable are routed to the receptacle 27 of the following building block 15 and stacked there.

An essential element of both building blocks is the stacker drum 217a. As shown in FIG. 22, the drum has partition walls 22a forming the individual braking pockets and bent in a spiral form. The bank notes to be stacked in this building block are transported to the stacker drum 217a on the branching bank note conveying section 31c. Because of the spiral form of the partition walls 220, the bank notes are brought to a stop from the very high transport speed over a very short distance. By means of a stripper 221, which extends vertically into the partition walls 220 of the drum 217a, the bank notes are discharged from the drum and stacked in an orderly stack on a face-like stem 228 extending into the receptacle 26.

For the correct reception of the bank notes, the stacker drum 217a must be driven in the direction of the arrow 222 at a constant angular velocity which must be chosen so that, during the so-called clock time, i.e., the time distance between the leading edges of two bank notes, the drum advances by one pocket. Thus the stacker drum is synchronized with each supplied bank note.

When receiving a bank note in one of the pockets, the stacker drum brings it to a stop from the high transport speed without damage and stacks it orderly in the receptacle disposed below it. Should a bank note intended to be stacked in the building block 14 or 15 be asynchronous with the stacker drum, reception by the stacker drum is still possible in most cases, but since the possibility of the stacker drum stacking the bank notes untidily because of their asynchronism, such bank notes are not stacked in the building blocks 14–17.

Asynchronously supplied bank notes, whose asynchronism is determined prior to their entry into the building block 14 or 15 by means explained below, must therefore be directed, by suitable gate operation, not to the stacker drum but to the last building block 18 and, thus, to the manual reprocessing magazine. This building block 18 is capable of also processing asynchronously supplied bank notes with the aid of an attachment.

As mentioned earlier, the noncirculable bank notes contained in the stacker drum 217a are discharged from the drum by means of a stripper 221 and then slide along a sheet-metal guide 223 into the receptacle 26. The fork-like stem 228, which extends into the receptacle and on which the bank notes are stacked, is connected via a screw spindle 224 with a stack follow-up unit 225, which swings in the direction of the arrow 227 about a pivot point 226 obtained by a hinge joint at its upper end. Disposed above the pivot point 226 is a motor 219 which is permanently connected with the screw spindle 224 and with which the stem 228, running in a guide (not shown) provided behind the spindle, can be lowered and raised.

According to the quantity of noncirculable bank notes to be stacked in the building block 14, the stem 228 is more or less lowered by suitable control of the motor 219 so that the stacking plane or the respective uppermost bank notes of the stack 229 resting on the stem 228 will always be positioned at the same spaced relationship from the stacker drum 217a. After the predetermined 3,000 or 5,000 bank notes have been stacked, the stack has reached about the height corresponding to the length of the receptacle 26. After switchover to the parallel building block 15, the follow-up unit 225 is now swung out in the direction of the arrow 227 by means of a pneumatic cylinder 230. Thereby, the stem 228 is withdrawn from the receptacle, so the stack 229 now rests on the bottom 231 of the receptacle with its whole weight. As a result of the increased bearing pressure, the receptacle, initially clamped in place between a spring-supported receptacle table 232 and a pressure plate 233, now forces the receptacle table 232 downwards in the direction of the arrow 234 against the spring action and can then be easily removed from the stacking unit 218. After a new, empty receptacle has been put in, and the stem 228 has been returned to its initial position, the building block 14 is ready to receive the subsequently supplied, noncirculable bank notes.

The loaded receptacles, made of stiff cardboard, are closed and sealed (not shown in the figures).

Thus, up to the destruction (possibly incineration) of the noncirculable bank notes together with the receptacle, access to the bank notes without visible destruction of the receptacle is impossible here, too.

Figure 23:
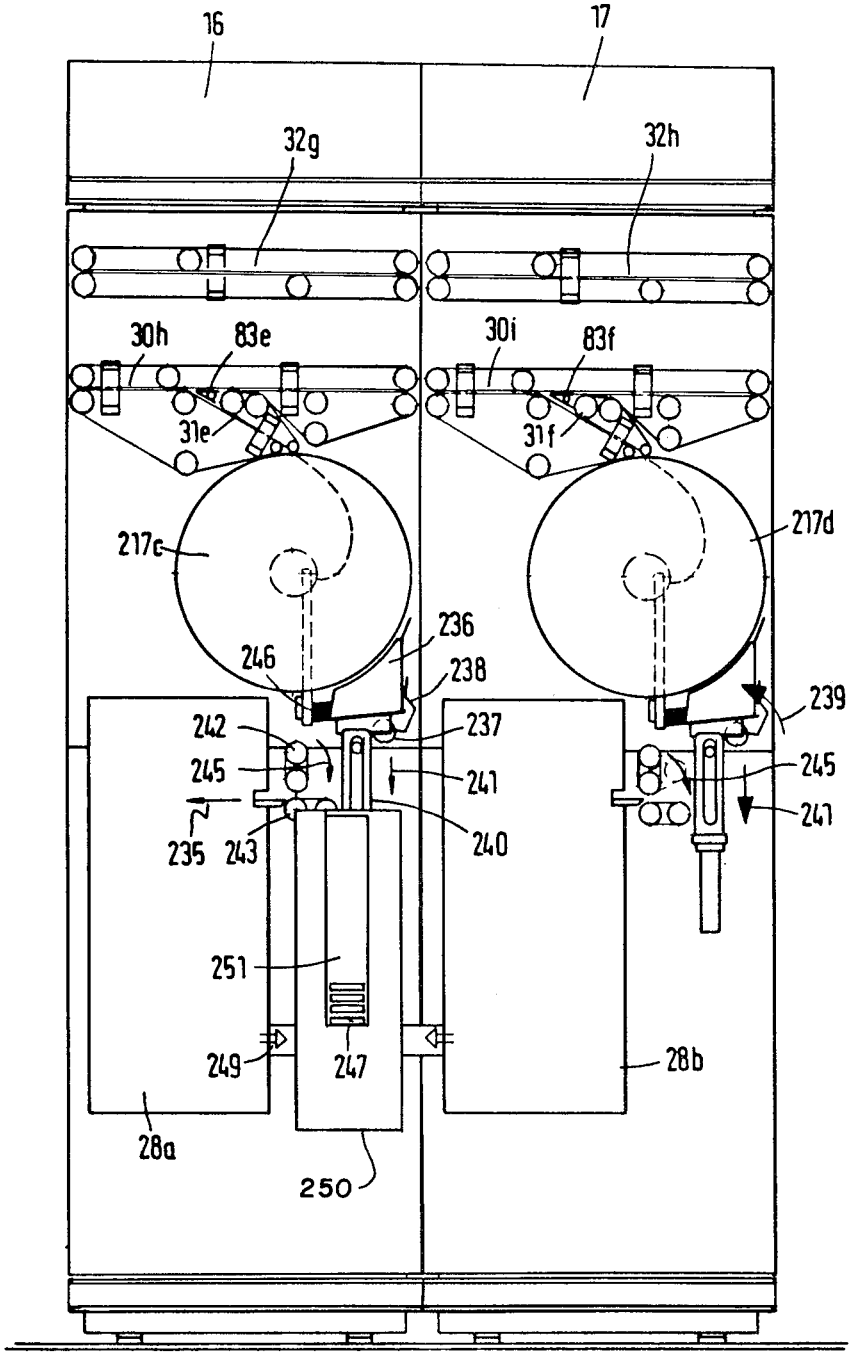
FIG. 23 shows the building block for "circulable bank notes"

BUILDING BLOCKS 16 AND 17 FOR STACKING, AND REMOVING REVENUE STAMPS FROM, CIRCULABLE, GENUINE BANK NOTES (FIG. 2, FIG. 23)

The two building blocks 16, 17, shown in FIGS. 2 and 23 and also designed for tandem operation, alternately receive those bank notes which the measuring section 22, 23 of the building block 12 has classified as genuine and circulable. Similarly to the noncirculable bank notes, these bank notes, deflected by a sorting gate 83*e* in the building block 16, are moved from their original conveying section 30*h* via the conveying section 31*e* and via another stacker drum 217*c*, already described in connection with the preceding building block 15, to a stack former 236 where they are united in small bank-note packets permitting direct use by the banks. As a rule, such bank-note packets contain one hundred bank notes. Analogously to the stacking of noncirculable bank notes, automatic switchover from one building block to the parallel building block takes place whenever one hundred bank notes have been stacked. After attainment of the intended number of items and after the switchover to the parallel building block, the packets are withdrawn from the stack former 236 and fed into the respective revenue-stamp-affixing station 28*a*, 28*b*. The packets provided with revenue stamps in the revenue-stamp-affixing stations are fed into a collector 250 which is common to both stations and from which direct further processing of the packets is possible.

Let us assume that the building block 16, for example, has just stacked one hundred bank notes. The subsequently supplied circulable bank notes are directed to the building block 17, while the building block 16 initiates the affixation of revenue stamps to the stack just formed. Already during the stacking the bank notes where so aligned in the stack former 236 that all edges of the bank notes of the stack are flush. After the 100th bank note has been stacked, a retainer 238, actuated by a moving magnet 237, is turned in the direction of the arrow 239 into the stack former 236 and presses the bank-note stack 246 together. With the aid of a pneumatic cylinder 240, the stack former 236 is then lowered in the direction of the arrow 241 until the bank-note stack 246 is on a level with a conveying system consisting of two pairs of pulleys 242, 243. After that, the bank-note stack 246 is first pressed together by rotation of the upper pair of pulleys 242, and then fed in the direction of the arrow 235 into the revenue-stamp-affixing station 28*a* belonging to the building block 16, where a revenue stamp is affixed to the stack. While a revenue stamp is being affixed to this stack, the upper pair of pulleys 245 is turned back opposite the direction of the arrow 245 so that the stack former 236 can be returned to the initial position immediately below the stacker drum 217*c*. From the revenue-stamp-affixing station 28*a* the packet, provided with a revenue stamp, moves in the direction of the arrow 249 into the collector 250. The collector 250, where the packets 247 supplied from the revenue-stamp-affixing station 28*a*, 28*b* are collected in given numbers in a packet-wide slot 251, may have a packaging unit (not shown) connected thereto which encloses a given number of packets in a package.

BUILDING BLOCK 18 FOR HANDLING MANUAL REPROCESSING CASES (FIG. 2, FIG. 24)

Figure 24:
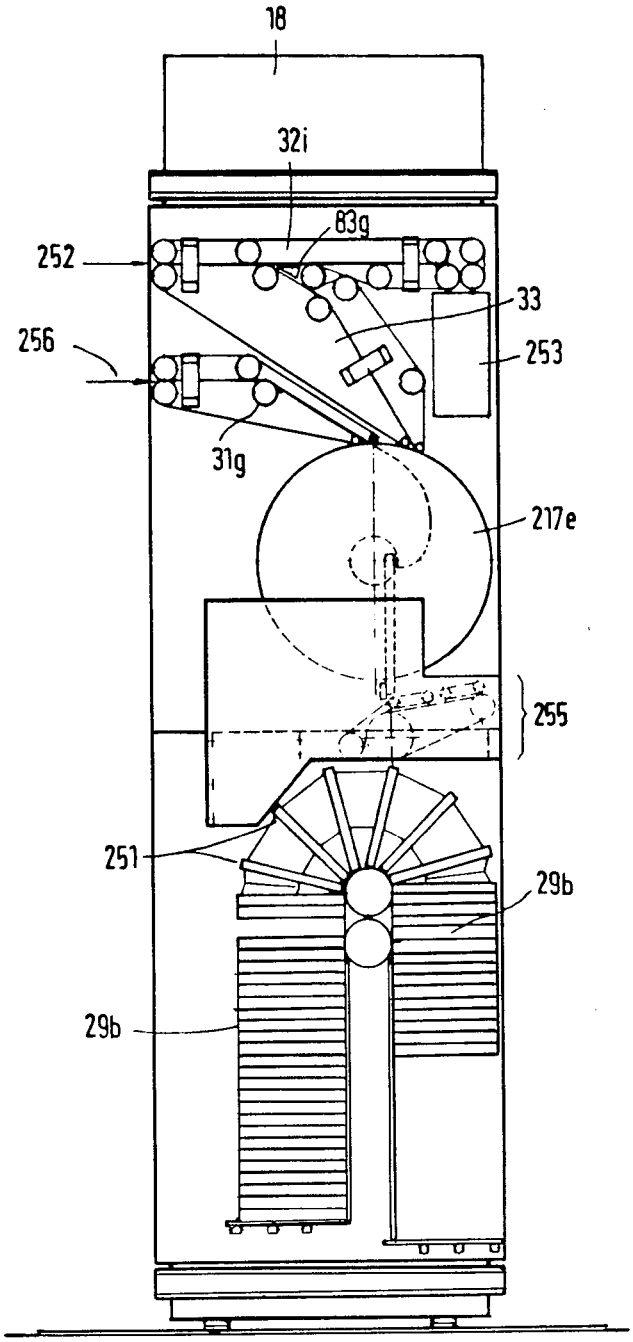
FIG. 24 shows the building block for "manual reprocessing"

The building block 18, which belongs to the conveyor unit 2 and in which the irregular bank notes and irregular revenue stamps of the packets are stacked, is shown in FIGS. 2 and 24. It comprises the following specific functional units:

- the pocket 253 for revenue stamps of rejected packets;
- the stacker drum 217*e* for bank notes and revenue stamps of rejected packets;
- the stack-forming and deflection device 255 for receiving bank notes and revenue stamps collected by the stacker drum 217*e* and forwarding them to the manual reprocessing magazine 29*b*, and
- the manual reprocessing magazine (reject magazine) 29*b* with coded pockets 251 for stacking rejected bank notes together with the corresponding revenue stamps.

The main task of the building block 18 is to receive all those bank notes having shown irregularities during processing, collect them in packets, and stack them in serparate pockets 251 of the manual reprocessing magazine 29*b*. Irregularities are present in the case of bank notes which are suspected of being counterfeits or heavily damaged and, therefore, not machine-identifiable, i.e., bank notes which cannot be unambiguously classified as noncirculable or circulable, as well as in the case of differences in the number of bank notes (excess, deficit) or in the case of bank notes moving through the conveying system asynchronously.

In all these cases, the revenue stamp belonging to the rejected packet will be transported to a pocket together with the respective bank notes. In cases where a packet contained too few or too many bank notes (excess, deficit) or in reject cases, the revenue stamp will be stacked alone. The latter cases are logged in a manner described below.

As mentioned in the introduction, the handling of the revenue stamp in this last building block 18 is of decisive importance for the general sorting procedure.

It is to be insured that in the event of irregularities with respect to a bank-note packet or to the bank notes of the packet, the revenue stamp belonging to the packet is selected and stacked, possibly together with the bank notes of the packet, immediately after the packet has been worked off and without any interruption of the fast sorting procedure.

The following deals with the mechanical peculiarities of the solution of the above-mentioned problems. The additionally necessary data-handling means will be explained in detail in connection with the description with the information-processing system of the sorter.

To be able to select or "call up" the irregular revenue stamp at any time, the revenue stamp conveying system 32, extending over the entire conveyor unit 2, is divided into four sections capable of being activated separately. The conveying sections 32*a*–32*e* of the building blocks 10–14 form the first section, the conveying sections 32*f* and 32*g* of the building blocks 15 and 16 the second and third sections, and the conveying sections 32*h* and 32*i* of the building blocks 17 and 18 the fourth and last section.

After their removal from the packets, the revenue stamps are received by the first conveying section 32*a*–32*e*, coupled directly with the revenue-stamping-removing block 10, and guided into that of the subsequent conveying systems which is still unoccupied.

Assuming an empty revenue stamp conveying system, this is the next to the last building block 17 (FIG. 2, FIG. 23). The revenue stamp remains stored in this conveying section 32*h* until the bank-note packet belonging to it has been completely worked off. If several revenue stamps are in circulation at the same time, they are stored, according to the order of their removal, in the conveying segments 32*g* and 32*f* of the building blocks 16 and 15 (third and second conveying sections) and move up as soon as a subsequent conveying section becomes free. In principle, the revenue stamp of the oldest bank-note packet being processed will be in the conveying section 32*h* of the next to the last building block 17.

When a packet has been completely worked off, i.e. when all bank notes of the packet have left the bank note conveying system 30, 31, the revenue stamp stored in the next to the last building block 17 in the conveying segment **32*h* is called up and moved in the direction of the arrow 252 into the revenue stamp conveying section 32*i* (see FIG. 24) of the last building block 18. If there were no irregularities in the packet, the revenue stamp is transported to the pocket 253 for regular revenue stamps. Otherwise, the revenue stamp is diverted from the conveying section 32*i* by a sorting gate 83*g*, transported on the conveying section 33 to the stacker drum 217*e*, and stacked on a stack-forming and deflection mechanism 255 designed as an intermediate storage. On the stack-forming and deflection mechanism 255, which will be explained in greater detail below, are lying, at this time, all those bank notes of the packet which have one or more of the above-mentioned irregularities. They were introduced into the building block 18 from the direction of the arrow 256 via the bank note conveying section 31*g* and also stacked via the stacker drum 217*e***.

Should a reject case have occurred in a packet, only the revenue stamp of the packet will be stacked on the stack-forming and deflection mechanism 255, as mentioned earlier.

After the revenue stamp has been stacked, the stack-forming and deflection mechanism 255 is activated in a manner explained below. It then conveys the collected bank notes and the revenue stamp into a pocket 251 of the manual reprocessing magazine **29*b*. The loaded pocket 251 is then automatically closed, and the next pocket in the magazine 29*b*, which has been opened, is moved below the stack-forming and deflection mechanism. The revenue stamp conveying section 321, freed by the stacking of the revenue stamp, has meanwhile received the revenue stamp originally stored in the preceding conveying section 321**, and this revenue stamp can be assigned to the bank-note packet now being processed.

MANUAL REPROCESSING MAGAZINE (SECOND REJECT MAGAZINE) (FIG. 24–FIG. 27)

Figure 25A:
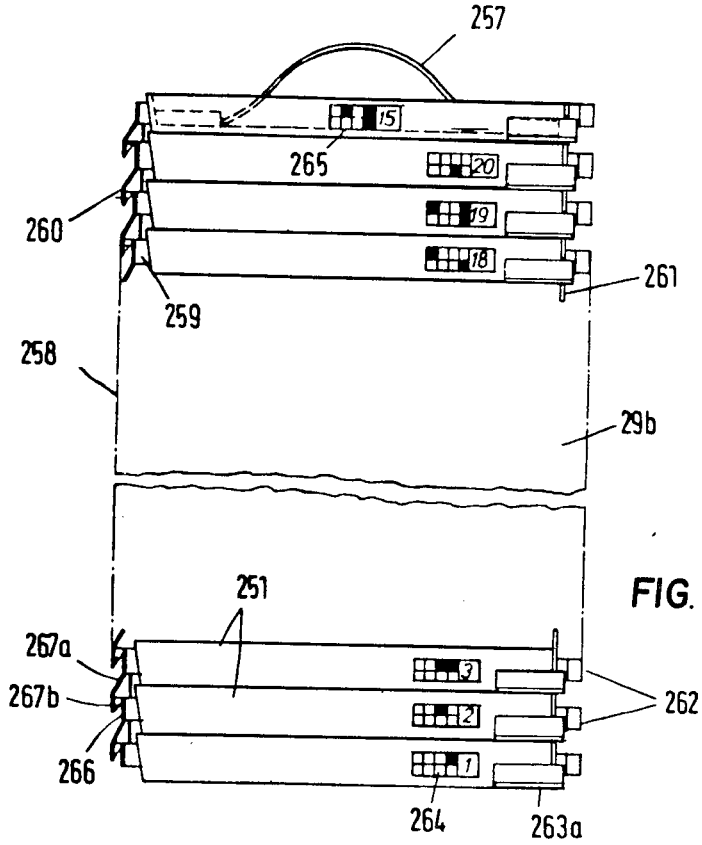
FIG. 25A shows a magazine of the manual reprocessing device in the building block of FIG. 24.
Figure 25B:
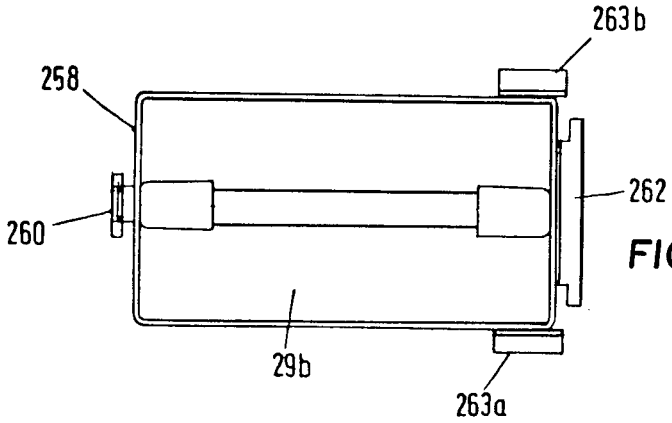
FIG. 25B is a top view of the magazine in FIG. 25A.

The manual reprocessing magazine **29*b*, shown in FIG. 25A and 25B in a side view and a top view, respectively, includes flat rectangular pockets 251. The cover of a pocket is formed by the bottom of the pocket lying on top of it. The uppermost pocket of a magazine, designated by the pocket number 15 in FIG. 25, has a fold-out handle 257, so this pocket cannot be used to stack bank notes or revenue stamps. The individual pockets 251 of the magazine are interconnected by two elements. At the end 258 of the magazine, a lock 260 attached to a separator 259 is provided at each pocket 251. In addition, a flexible tape 261 extends along the whole length of tha magazine on the side opposite the end 258 and is firmly connected with the pockets by means of T-guide pieces 262, whose function will be explained below. Furthermore, each pocket has at its front and rear side surfaces—related to the end 258—near the T-guide pieces 262, two engaging angles 263*a*, 263*b* which permit the magazine to be transported through the stacking device. Also affixed to the side surfaces are adhesive labels printed with the pocket numbers 264 and, on the last pocket, the magazine number—in FIG. 25A the pocket number 15, for example. As shown schematically in FIG. 25**, these labels also contain the coded form of the pocket or magazine number necessary for automatic identification.

Each lock 260 attached to the separator 259 is formed by a locking angle 266 and a tension spring **267*a* carrying a locking hook 267*b* of triangular section at its free end. One locking angle and one tension spring are attached jointly to each separator 259. When the pockets are closed, as shown in FIG. 25A and 25B, the locking hook 267*b* of a pocket, attached to the tension spring 267*a*, engages the locking angle 266 of the subsequent pocket and is held in place by the tension spring 267*a***.

Figure 26:
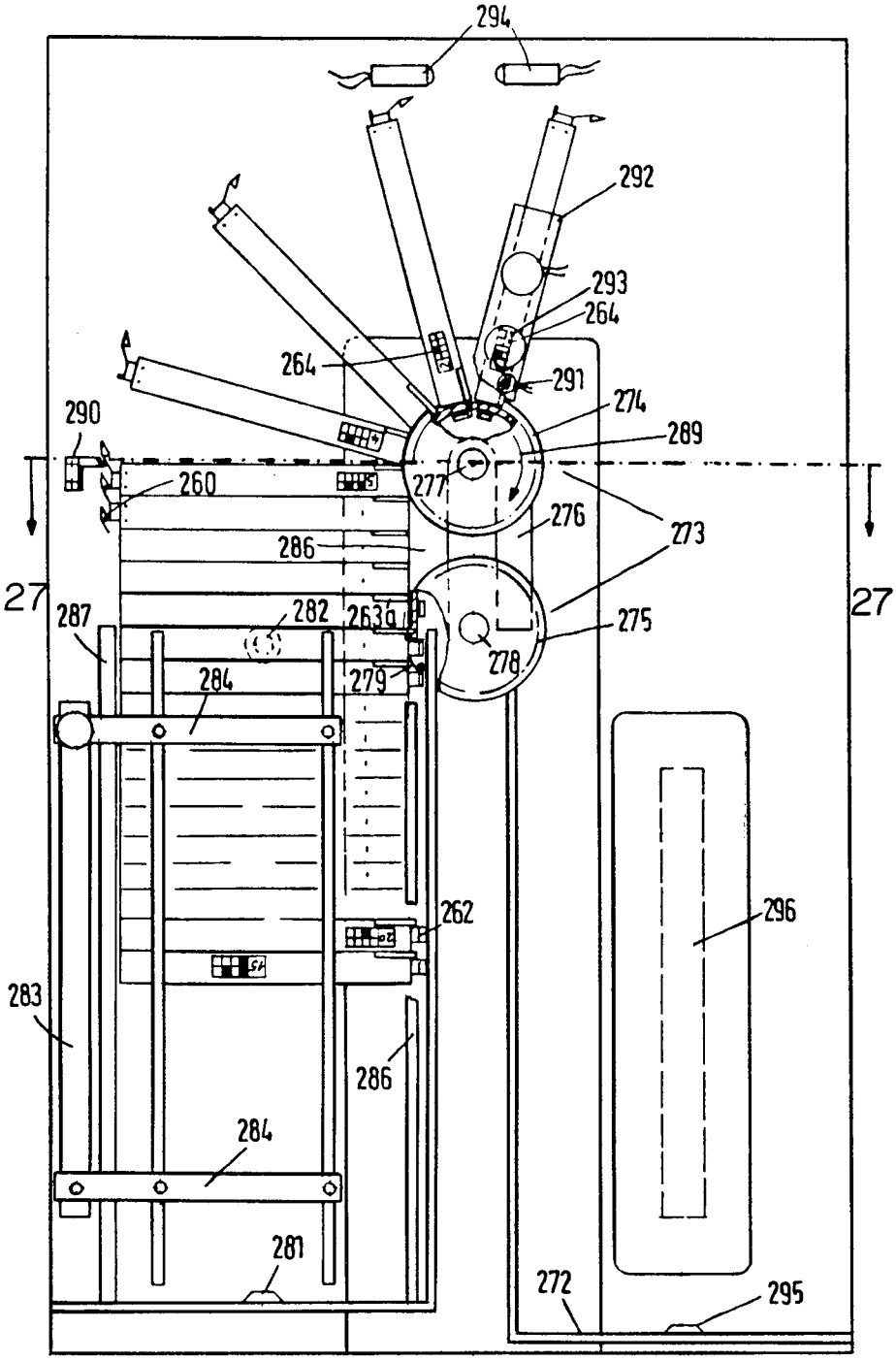
FIG. 26 shows the manual reprocessing device.
Figure 27:
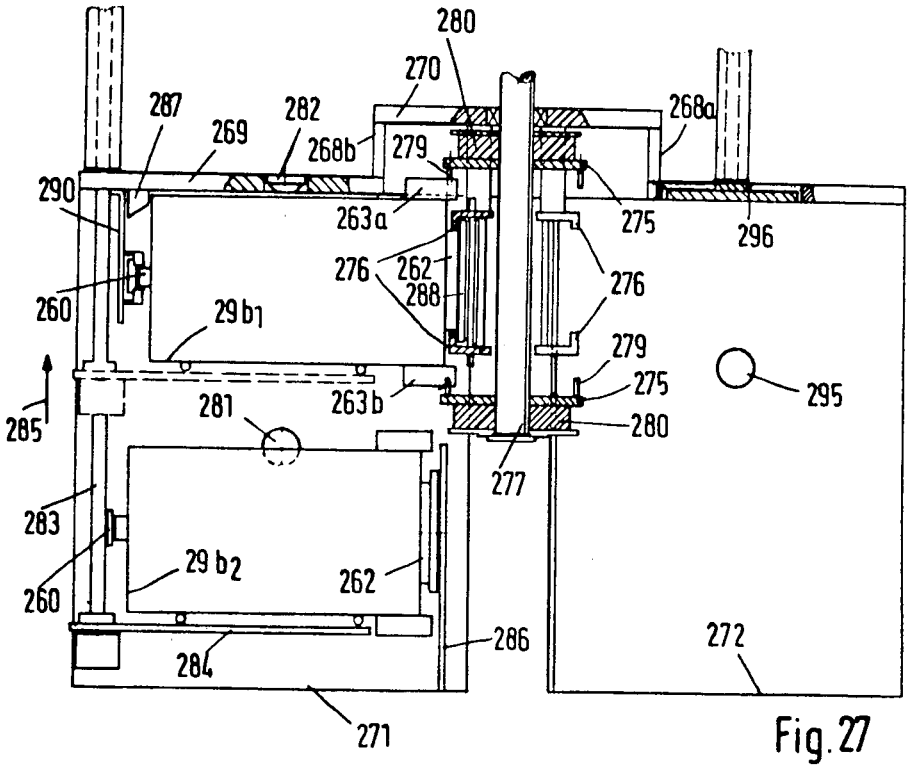
FIG. 27 is a section through the manual reprocessing device taken along line 27—27 of FIG. 26.

Prior to the description of the operation of the stacking device, the most important elements of the device will be briefly explained:

As can be seen from FIGS. 26 and 27, the manual reprocessing device includes two frame plates 269, 270 which are arranged one behind the other, separated by spacing strips **268*a*, 268*b*, and have all working parts attached or pivoted thereto. On the feed side, the feed table 271 is mounted at the lower end of, and perpendicular to, the frame plate. On the right-hand side—the delivery side of the magazine—the delivery table 272 is mounted. The main components of the stacking device are a drive system 273 and the guide strips or plates 276 mounted between the two pairs of driving wheels 274, 275 disposed one above the other. The driving system 273 is pivotally mounted in the smaller one of the two frame plates 270 and extends through an opening of the frame plate 269**.

The driving-wheel pairs 274, 275, respectively mounted on drive shafts 277, 278, carry inwardly directed engaging dogs 279 which are evenly distributed along their circumference and extend parallel to the drive shaft. The distance between the engaging dogs 279 on both pairs of driving wheels 274, 275, is equal to that between two adjacent engaging angles **263*a*, 263*b* at the magazine 29*b*, so the feed force is evenly distributed among all engaging dogs being in engagement. The whole driving system 273 is driven via the shaft of the upper driving-wheel pair 277 by means of a motor (not shown). The lower driving-wheel pair 275 is driven via timing belts 280 (see FIG. 27**).

Located between the driving wheels of the upper and lower driving-wheel pairs 274, 275 are horseshoe-shaped guide strips 276 opening downwardly onto the feeding and delivery tables 271, 272.

To illustrate how the magazines move up in a continuous sequence, two magazines $29b_1$, $29b_2$ are shown in FIG. 27. The magazine $29b_1$ is in the manual reprocessing device, while the second magazine $29b_2$ is in the waiting position and standing on the feeding table 271. Incidently, in contrast to FIGS. 25A and 25B, the magazines are fed into the device upside down so as to stand on the delivery table 272 in the position shown in FIG. 25A and 25B (handle 257 on top) after having passed through the device. By the magazine $29b_2$ in the waiting position, a switch 281 sunk in the feeding table 271 is closed. When, in addition, a switch 282 attached to the frame plate 269 approximately on a level with the lower driving-wheel pair 275 (FIG. 26) is opened because the last pocket (pocket with magazine number 15) of the magazine $29b_1$ located in the manual reprocessing device is exactly one pocket higher than the switch 282, two conditions are satisfied which put a pull-in meechanism 283 in action. By means of the cross members 284 of the pull-in mechanism, the magazine $29b_2$ is pulled from the waiting position into the manual reprocessing device.

While being pulled into the device in the direction of the arrow 285 by the pull-in mechanism 283, which is operated by a pneumatic cylinder (not shown), the magazine first slides along the front guide plate 286 standing perpendicular on the feeding table 271. Thus the magazine can be guided past the lower driving-wheel pair 275. The magazine $29b_2$ then hits a positioning strip 287 attached to the frame plate 269. The bevel of the positioning strip—shown in FIG. 27 in a top view—imparts to the magazine a right-hand motion relative to the arrow 285, so the magazine moves with its upper T-guide pieces 262 and the engaging angles 263*a*, 263*b* between the driving wheels of the lower driving-wheel pair 275. The magazine finally hits the frame plate 269 with its long side facing the device, and the rear positioning plate 288 with its T-guide pieces 262, and is now located under the guide strips 276 between the positioning plate 288 and the straight portion of the positioning strip 287 following the bevelled portion.

The magazine $29b_2$, which has just been introduced into the device, is first lifted by the lower driving-wheel pair 275. To do this, the engaging dogs 279 of the driving-wheel pair engage the engaging angles 263*a*, 263*b* attached to both sides of the uppermost pocket (FIG. 27). In this phase, the magazine is supported by the positioning strip 287 and cannot slide out of place. As soon as the first pair of engaging dogs 279 is in full engagement with the corresponding engaging angles 263*a*, 263*b*—about halfway up the lower driving-wheel pair 275—the T-guide piece 262 of the uppermost pocket is guided into the horseshoe-shaped guide strips 276, which begin at this point.

By the rotary motion of the driving system 273 in the direction of the arrow 289 (FIG. 26), the magazine is then moved on, via its T-guide pieces, through the still straight portion of the guide strips 276. Immediately after a pocket has moved with its T-guide piece 262 into the region of the curvature of the guide strips 276, it is disconnected from the following pocket by unlocking its lock 260. In this phase, the individual unlocked pockets are automatically spread at a given angle and thus open fanwise since they are alway perpendicular to the guide strips because of the T-guide pieces 262 being exactly adapted to the guide strips 276. The opened magazine is held together by the flexible metal tape 261 attached to the side opposite the lock 260.

To unlock the pockets, their locks are moved past an unlocking mechanism 290. This unlocking mechanism is formed, in principle, by an inclined plane via which the tension spring 267 is forced out of the locking angle 266 of the next pocket.

After passing the unlocking mechanism, the unlocked pockets move, with their guide pieces 262, into the curved portion of the guide strips 276. When a pocket reaches the loading position shown in FIG. 26 (pocket number 1) during the movement of the magazine through the circular curvature of the guide strips, the outer engaging angle 263*b* of the pocket actuates a switch 291 mounted on a holder 292. By actuating the switch 291, the feeding of the magazine is interrupted. The pocket is in the loading position. In this position, the pocket number 264, stuck on the pocket in coded form, is identified by a diode matrix 293 attached to the holder 292.

After a pocket has been loaded, this is registered by a photocell installation 294 attached to the frame plate 269 and giving the instruction to continue the transport of the magazine. The continued transport is not interrupted again until the next pocket (pocket with the number 2) has taken up the position described above. In the same manner, all pockets are guided past the loading station and then locked again.

Having passed through the driving system 273, the magazine moves unto the delivery table 272, where its bottommost pocket actuates a switch 295. As a result, a delivery mechanism 296 is caused, via a pneumatic cylinder (not shown), to eject the magazine. As soon as the magazine has left the delivery table 272, it can be transported away on a conveyor belt (not shown) for further processing.

With the delivery of the magazine, a log (manual reprocessing log) is drawn up un which the following data is recorded for further processing:

the magazine number;
the pocket numbers;
the number of bank notes stacked in each pocket, and
the irregularities which have led to the stacking.

The subsequent processing of the contents of the manual reprocessing magazine with the aid of the pertinent log will be described in connection with the information-processing system.

Before being stacked in the last building block 18 in the pockets of the magazine, the bank notes and revenue stamps are intermediately stored on the stack-forming and deflection mechanism 255 disposed above the magazine (see FIG. 24 and FIGS. 28, 29, 30). The stack forming and deflection mechanism is necessary since the building block 18 must process both heavily damaged and asynchronously supplied bank notes.

Figure 28:
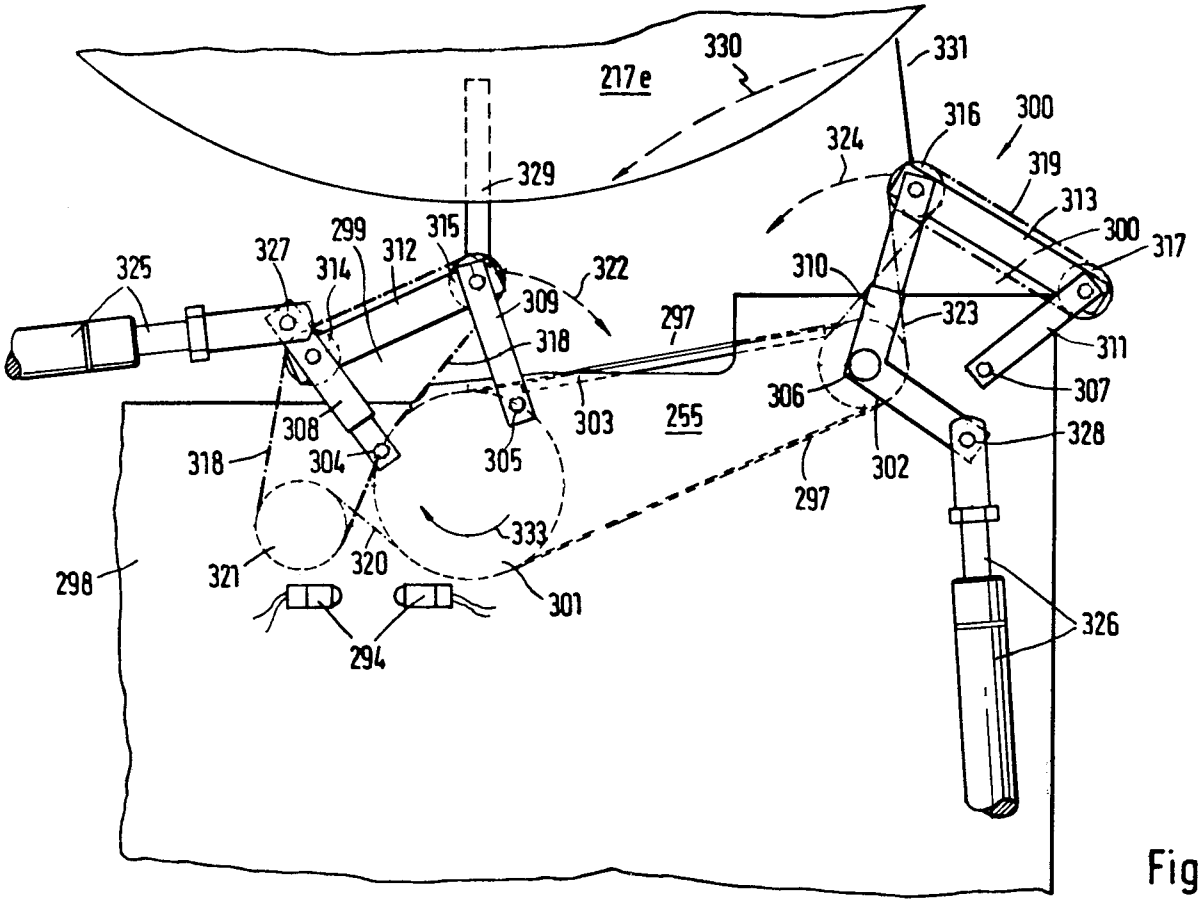
FIG. 28 shows a deflection mechanism in the rest position.

FIG. 28 shows the mechanism 255 disposed below the stacker drum 217*e*. This mechanism comprises essentially a collecting table made up of three flat belts 297 (cf. FIG. 30), and two four-bar linkages 299, 300 attached to a mount 298 on both sides of the collecting table. Located below the flat belts 297, which run over pulleys, i.e. main drive pulley 301 and idler pulley 302, is a collecting plate 303, which closes the gaps between the flat belts and thus prevents any bank notes falling on the belts in an inclined position from sliding through. This applies particularly to the stacking of revenue stamps. Each of the four-bar linkages 299, 300, shown in FIG. 28 in the position of rest, respectively has two arms 308, 309 and 310, 311 pivotally mounted on one side of the mounting plate 298 at the points 304, 305 and 306, 307, as well as cross tie 312, 313 hinged to the freely movable ends of the arms 308, 309 and 310, 311, respectively. Mounted on the hinge pins of each of the two four-bar linkages are corner pulleys 314, 315 and 316, 317, respectively, over each of which run three round-section belts 318 and 319, respectively, in corresponding grooves distributed across the entire width, as also shown in FIG. 30. The round-section belts 318, 319, which, together with the flat belts 297, take over the transport of the stacked bank notes during the working phase of the deflection mechanism 255, are staggered with respect to the flat belts 297 (FIG. 30) of the collecting table. The round-section belts and the flat belts of the collecting table are driven via the main drive pulley 301, whose shaft is connected with a motor (not shown) via a start-stop drive. The main drive pulley 301 is coupled, via a crossed belt 320 (shown schematically in FIG. 29), with an auxiliary pulley 321, over which run the above-mentioned round-section belts 319 of the four-bar linkage 299 disposed on the left-hand side of the collecting table (flat belts 297). The auxiliary pulley 321 beside the main drive pulley 301 is so positioned in relation to the corner pulley 315 of the four-bar linkage 299 that the round-section belts 318 of the four-bar linkage run in corresponding grooves of the main drive pulley 301. This insures that the round-section belts 318 are guided when the four-bar linkage is lowered in the direction of the arrow 322 into the working position. The round-section belts 319 of the four-bar linkage 300 disposed on the right-hand side of the collecting table (flat belt 297) are also driven via a crossed belt 323. This belt is connected with the pulley 302 (see FIG. 30), which, in turn, is driven with the flat belts 297, forming the collecting table, via the main drive pulley 301.

Figure 29:
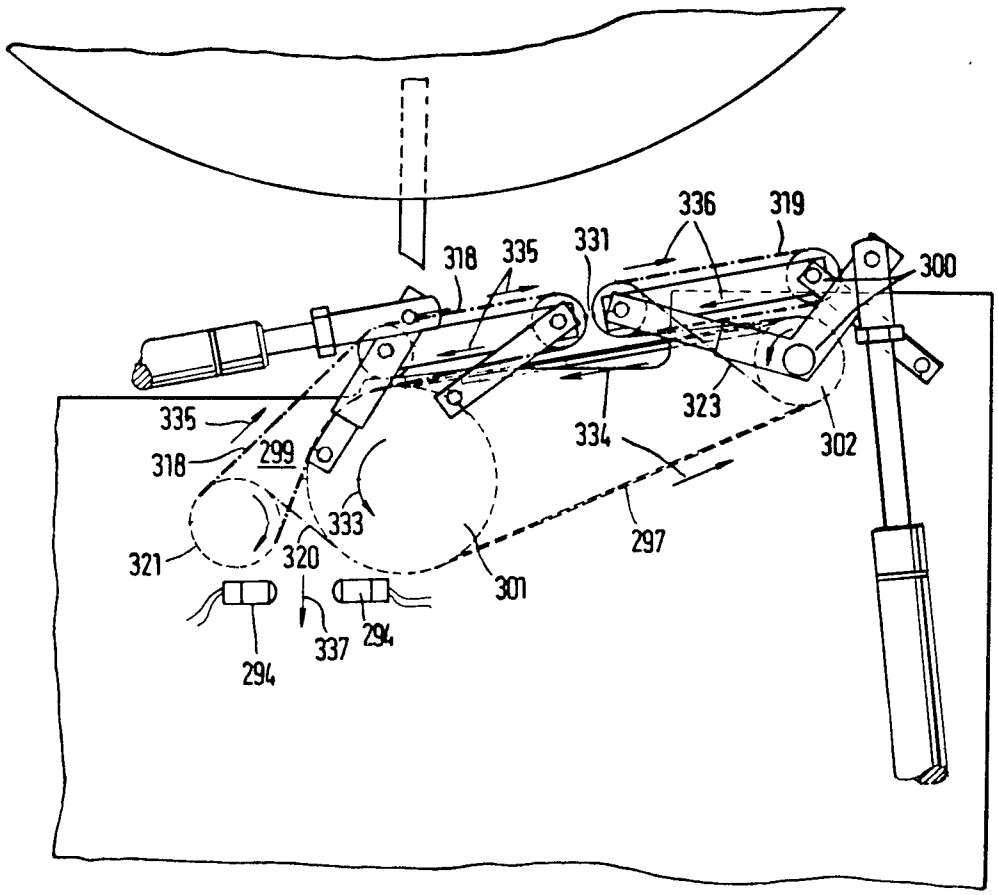
FIG. 29 shows the deflection mechanism in the working position.
Figure 30:
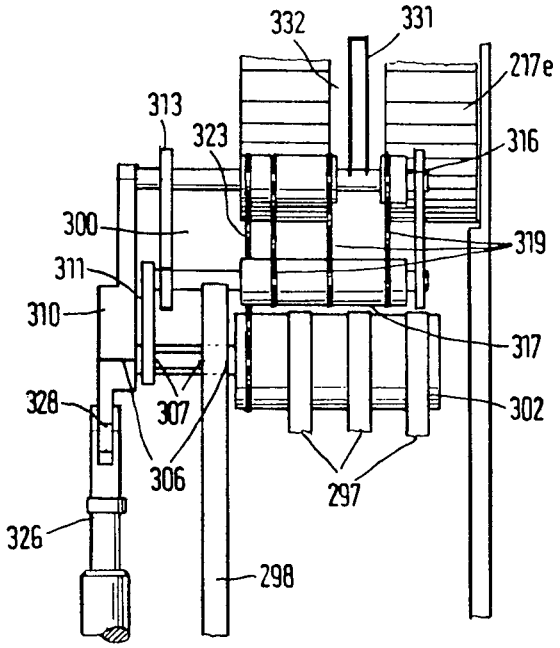
FIG. 30 is a side view of the deflection mechanism of FIG. 29.

For turning the four-bar linkages in the directions of the arrows 322, 324 into the working position shown in FIG. 29, two pneumatic cylinders 325, 326 are provided each of which has its piston pivoted to an extension of one of the arms 308, 310 at the points 327, 328, which extension acts as a lever.

In the rest position of the deflection mechanism 255 (FIG. 28), the main drive pulley 301, the flat belts 297, and the round-section belts 318, 319 are at rest, and the four-bar linkages 299, 300 are in a raised position (FIG. 28) clearing the collecting table (flat belts 297). In this phase, the bank notes discharged from the stacker drum **217*e* with the aid of the stripper 329, and finally also the revenue stamp, fall to the collecting table formed by the flat belts 297**.

When the revenue stamp, as the last element of each packet, has been placed on the collecting table, both four-bar linkages 299, 300 are turned in the direction of the arrows 322, 324 via the pneumatic cylinders 325, 326. The working pressure of the pneumatic cylinder 326 connected with the right-hand four-bar linkage 300 is twice as high as that of the pneumatic cylinder 325 connected with the left-hand four-bar linkage 299, so the right-hand four-bar linkage is turned in the direction of the arrow 324 about the pivot points 306, 307 first. After a short rotary motion, the four-bar linkage 300 presses with its round-section belts 319 on the stack lying on the flat belts 297. In order to grasp the possibly arched stack along its entire length during the compression, a hold-down member 331 designed as an extended arm is provided at the four-bar linkage. During the rotary motion of the four-bar linkage 300, this hold-down member 331 moves through (arrow 330) the area of opening 332 of the stacker drum **217*a* (see FIG. 30). In the meantime, the left-hand four-bar linkage 299, too, has been turned in the direction of the arrow 322 about the pivot points 304 and 305 until its round-section belts press the left-hand portion of the stack, already partly pressed down by the hold-down member 331, firmly against the collecting table formed by the flat belts 297. At that instant, the four-bar linkages are in the working position shown in FIG. 29, in which they clamp the stack, consisting of the bank notes and the revenue stamps, in place by pressing their round-section belts against the flat belts 297. In the next phase of the sequence, the main drive pulley 301 is set in motion in the direction of the arrow 333 (FIG. 29) via the start-stop drive. Through the above-explained coupling of the individual driving members (pulley 321, 302, crossed belts 320, 323), the flat belts 297 move in the direction of the arrow 334, the round-section belts 318 of the four-bar linkage 299 in the direction of the arrow 335, and the round-section belts 319 of the four-bar linkage 300 in the direction of the arrow 336. The stack thus moved out of the stack-forming and deflection mechanism between the round-section belts 318 and the main drive pulley 301 in the direction of the arrow 337 then passes into a pocket of the manual reprocessing magazine, which fact is detected by the photocell installation 294 (cf. FIG. 26**).

INFORMATION PROCESSING SYSTEM (FIGS. 1, 31)

After the description of the building blocks of the conveyor unit 2—the mechanical system—the information-processing system (6, 7, 8, 9) of the sorter 1 will now be explained in greater detail.

Figure 31:
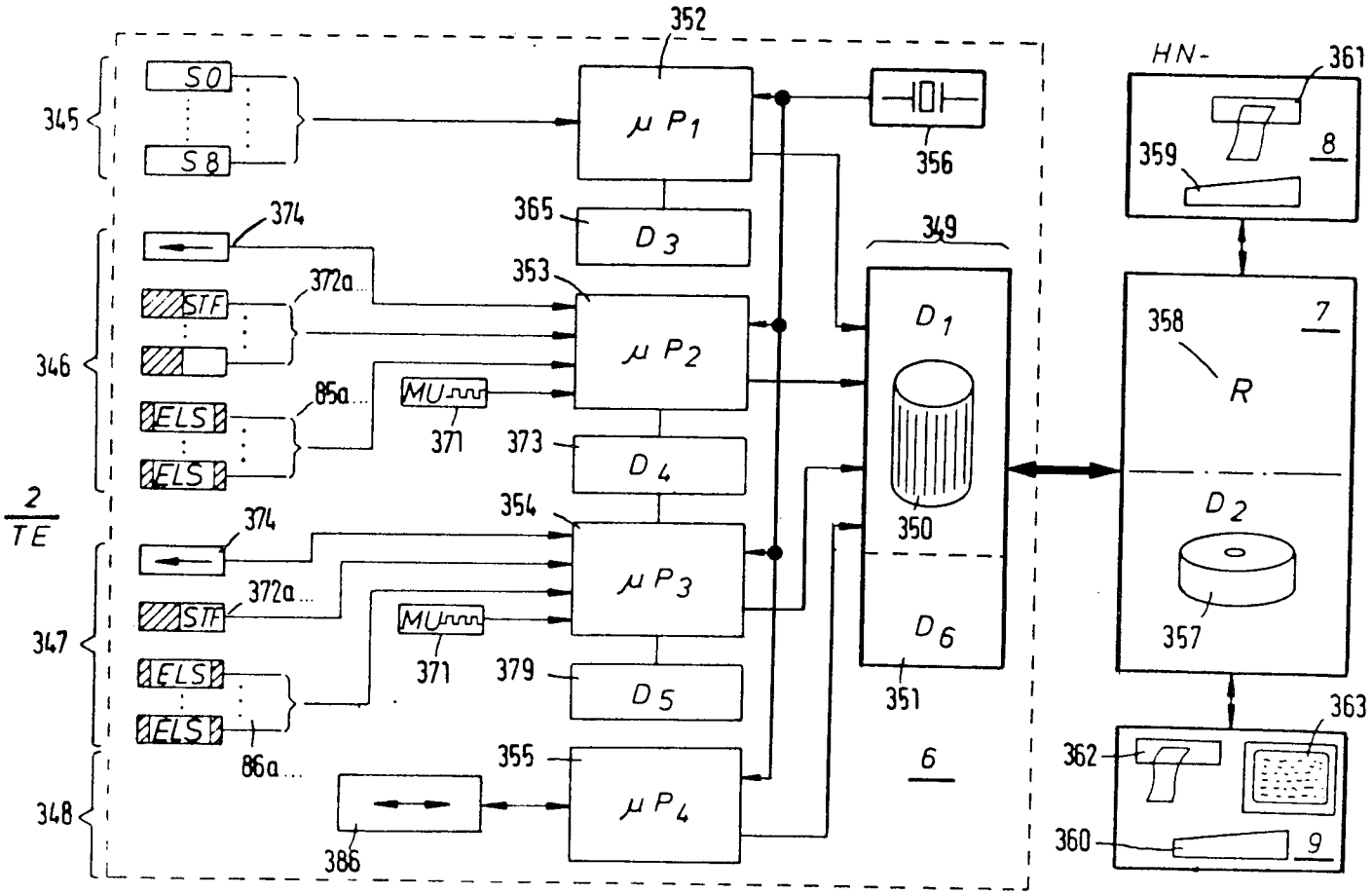
FIG. 31 is a block diagram of the information-processing system.

According to the block diagram of FIG. 1, FIG. 31 shows the conveyor control unit 6 and the system control unit 7 with the peripheral units 8, 9 as the main components of the information-processing system in detailed form.

First, the functions of the conveyor and system control units 6 and 7 will be outlined. This will be followed by a detailed explanation of the operator of both system units for performing these functions.

FUNCTIONS OF THE CONVEYOR CONTROL UNIT

The conveyor control unit must fulfill the following functions within the information-processing system:

- It receives all results of the sensors of the measuring section 22, 23 (see FIG. 2) with respect to the genuineness and condition of the bank notes, and unites these results, assigned to the tested bank note, in a data record.
- After a bank note has passed through the measuring section 22, 23, the conveyor control unit forms a so-called evaluation byte for the respective bank note by logic operations, which evaluation byte, also stored in the data record, serves to derive the stacking criteria and, thus (FIG. 2), to select one of the sorting blocks or destinations (building blocks 13–18).
- In addition, it follows each bank note in the conveying system in accordance with the destinations laid down in the data record, registering any irregularities and deviations from the prescribed transport path, and interrupting the sorting procedure, if necessary.
- It also sees to it that the assignment of the bank notes being processed and of the bank notes dealt with to the respective input packet and to the corresponding revenue stamp is preserved at any time. In the event of an objection, the revenue stamp and the bank notes concerned are collected in a pocket of the manual reprocessing magazine (2nd reject magazine).
- It controls all peripheral units working on the sequence control principle, such a the packet feeding (building block 10).

FUNCTIONS OF THE SYSTEM CONTROL UNIT

With respect to the information-processing system, the system control unit 7 performs the following functions:

- It collects the data supplied by the sorter and stores it in a permanent store.
- It edits the received data into various logs and accounting documents, such as:
  - manual reprocessing logs,
  - shift logs,
  - logs about interventions and malfunctions, statistics about the operation of the bank-note sorter.

It executes operator instructions for controlling the sequence of operations, such as:
beginning of shift,
output of information on the condition of the installation,
special debugging procedures,
end of shift.

Via the peripheral units (manual reprocessing position 8 and control console 9), it is capable of printing out the above logs and receiving instructions from the operating personnel (operator instructions).

DESIGN OF THE CONVEYOR CONTROL UNIT (FIGS. 31, 32)

To accomplish its tasks, the conveyor control unit is divided in four subsystems 345–348, as shown in FIG. 31. Each subsystem is characterized by one or more data sources, such as the sensors S0–S8 or photocell installations 85*a* . . . 86*a* . . . , and by one or more data sinks, such as data storages (files $D_1$ . . . $D_6$) or control lines for controlling the sorting gates (83*a* . . . ).

Figure 32:
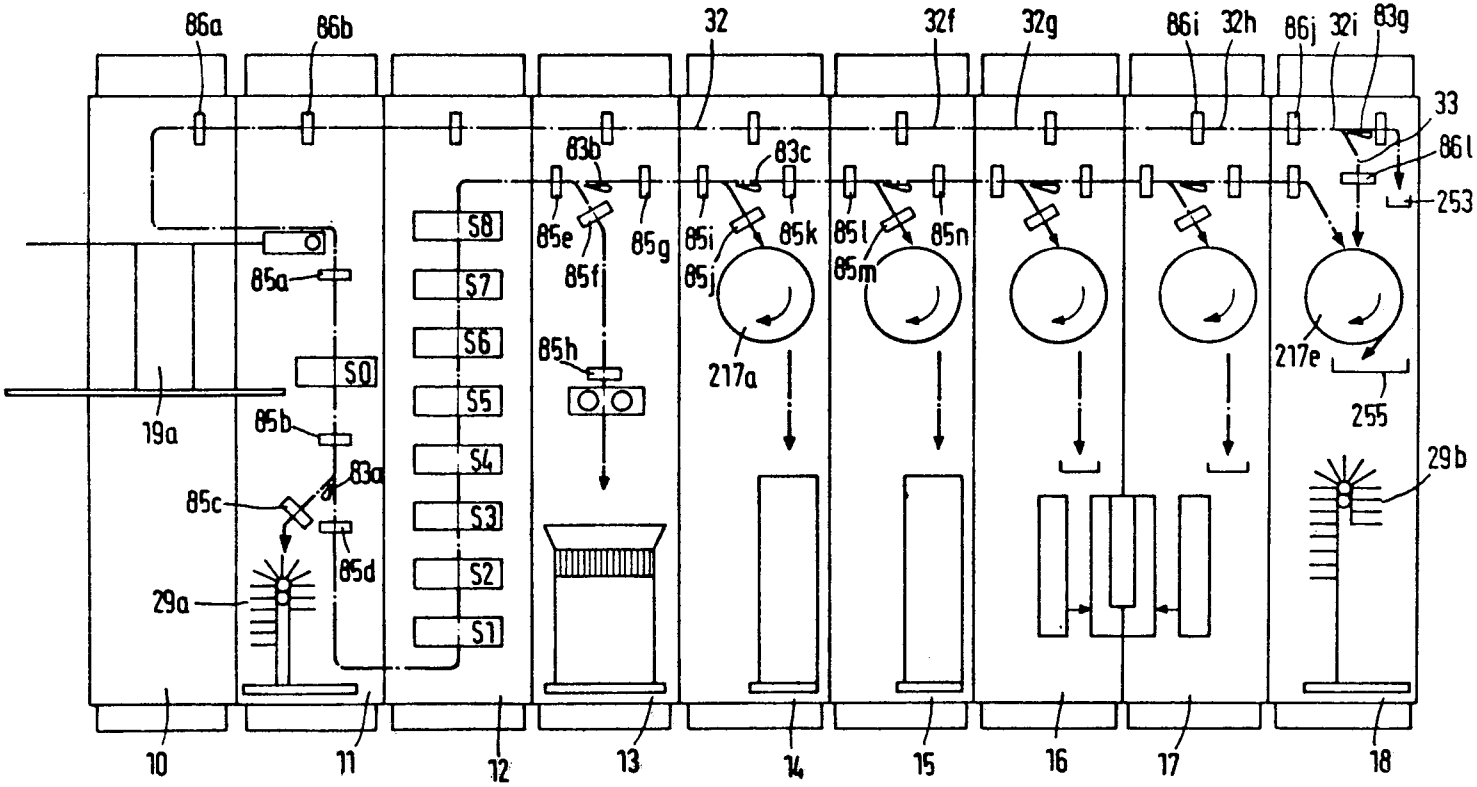
FIG. 32 shows the conveyor unit with its photocell installations and sensors.

With regard to the geometric configuration of the sorter 1, some of the data sources (photocell installations, sensors) and data sinks (control lines for gate control) must be considered part of the conveyor unit 2 (FIG. 32). From an information-processing point of view, however, the above-mentioned data sources and data sinks are elements of the subsystems 345, 346, 347, and 348 of the conveyor control unit and will, therefore, be considered in the following to belong to this unit.

A central storage unit 349 common to all systems and also accessed by the system control unit 7 as will be explained below, is a small-capacity storage which only buffers its data. It comprises a file ($D_1$) for bank-note characteristics 350 as well as a file ($D_6$) for events 351 concerning the peripheral processes of the sorter 1. This includes the message, for example, that empty manual reprocessing magazines 29*b* must be made available in order that the sorting procedure need not be interrupted.

As connecting links between the data sources and the data sinks of each subsystem 345–348, the conveyor control unit 6, designed as a multiprocessor system, includes microprocessors ($\mu P_1$ - $\mu P_4$, 352–355) which control the data flow of the respective system. All microprocessors 352–355 are clocked by a master clock 356 to permit access to the common central storage unit 349.

DESCRIPTION OF THE SUBSYSTEMS OF THE CONVEYOR CONTROL UNIT (FIG. 31)

In the following, the functions of the subsystems 345–348 of the conveyor control unit are described in the following order:

first subsystem 345: general testing of the bank notes, storing and evaluating the results;
second subsystem 346: monitoring the bank note transport;
third subsystem 347: monitoring the revenue stamp transport, and
fourth subsystem 348: control of the peripheral units of the bank-note sorter 1.

FIRST SUBSYSTEM 345 OF THE CONVEYOR CONTROL UNIT (FIGS. 31, 32, 33, 34, 35)

The first subsystem 345 collects the test results obtained for each bank note during the passage through the sensor SO (building block 11) or S1–S8 (building block 12), stores these results, and determines the destination (sorting blocks 13–18 or reject pocket 29*a*) of the bank note with the aid of these results.

The first subsystem 345 consists of a first block which acts as a data source and in which the reject sensor S0, the condition sensors S1–S4, and the genuineness sensors S5–S8 are united;
the file for bank-note characteristics ($D_1$) 350, which is used in conjunction with the other subsystems, must be considered both a data source and a data sink, and temporarily stores the data provided by the sensors S0–S8;
a decision file ($D_3$) 365, and
a microprocessor ($\mu P_1$) 352, which controls the data flow between the data sources and the data sinks within the subsystem 345.

During the passage of bank notes through the sorter, the data sources, data sinks, and the microprocessor co-operate in creating for each bank note a data record (explained below) which contains all information necessary for the sorting procedure and for logging.

Figure 33:
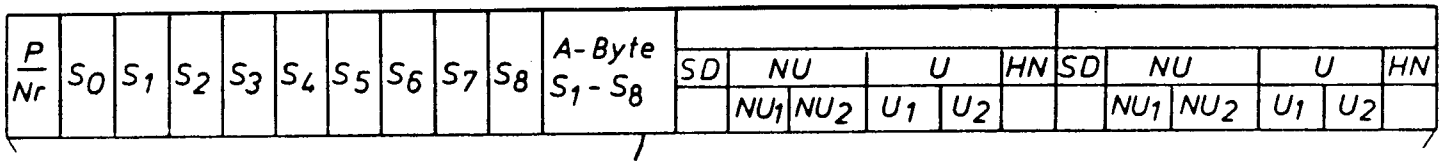
FIG. 33 shows the format of a data record.

The compilation of a data record 366, shown schematically in FIG. 33, takes place parallel to the bank-note pass.

As shown in FIG. 33, the following information is stored in each data record:

the number of the packet (P.-Nr.) to which the bank note to be sorted belongs;
the test results of the sensors S0–S8 which are stored successively according to the passage of the bank notes through the sensors;
the evaluation byte (A.-Byte), in which the results of the sensors S1–S8 are united (the A.-Byte is formed when the respective bank note has passed through the sensor S8 in the building block 12; results received from S0 were processed before);
the "stacking device required" decisions (SD, NU, U, HN), which give information on the desired destinations (building blocks 13–18) of the tested bank note, and
the "stacking device completed action" decisions (SD, NU, U, HN), which give information on the completion of the stacking of a bank note at one of desired destinations.

All data records are stored in a file ($D_1$) 350 for bank-note characteristics (FIG. 31) and kept available at least until all bank notes belonging to a packet have been processed properly or until the processing of a packet has been completed.

To permit an overlapping mode of operation of the sorter, with the last bank notes of a packet being still in the conveying section while the first bank notes of the next packet are already being fed from the packet, the file ($D_1$) 350 should be able to hold at least the data records of two bank-note packets i.e., it should have at least two hundred locations. With the two hundred fifty six locations, for example, available in the file ($D_1$) 350, it is possible to also process those cases without difficulty where the packets contain more than the permissible number of bank notes.

Figure 34:
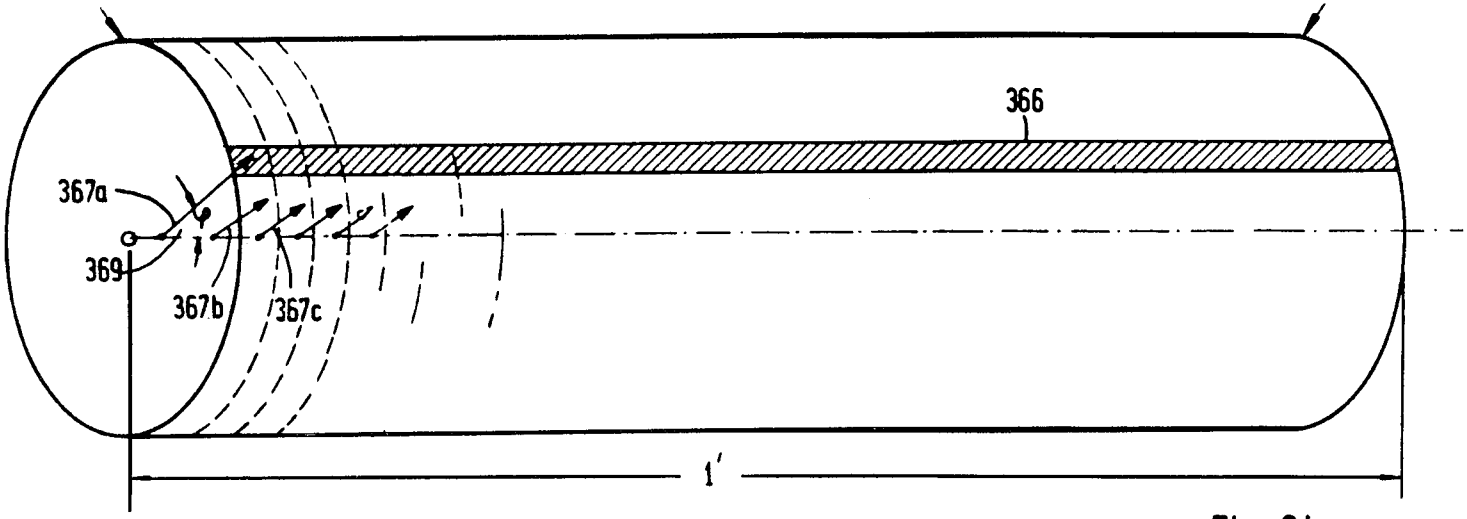
FIG. 34 shows in schematic perspective, a file for the data records (bank-note marks)

The organization of the file needed to fulfill the abovedescribed storage functions is illustrated in FIG. 34 with the aid of a three-dimensional magnetic drum.

Each point of the cylinder's surface is determined by the cylinder co-ordinates of the angle $\phi$ and the length 1'. The data of the bank notes is so arranged in records on the longitudinal lines of the surface of the cylinder that a value of $\phi$ is allotted a bank note, and a value 1' a given type of information within the data record, e.g. the measurement result of a sensor. The numbers of the tested bank notes are not contained in the data record itself. However, they are determined indirectly by the values of the angles $\phi$. Each type of information within the data record can, therefore, be allotted a pointer (e.g. 367*a* or P-Nr.) of a pointer array which pointer is unambiguously defined by the position of its pivot point on the cylinder axis (determines to which type of information a pointer belongs) and its respective angle 369 (determines the data record of the bank note). Thus the sum of the pointers 367*a* . . . , which are independent of each other, makes it possible to select any address of the drum.

The movement of the pointers 367*a* . . . is cyclic, so an initial value will be reached again automatically after two hundred fifty six steps, i.e., after the processing of two hundred fifty six bank notes and, thus, data records. Thus, when the data records of two hundred fifty six bank notes have been stored, the oldest data record on the drum is erased for the processing of a newly arriving bank note. Since the file with its two hundred fifty six locations is capable of storing its data until all bank notes belonging to a packet have been processed, continuous data management is possible.

The information belonging to a data record is thus collected by storing the data obtained during the passage of a bank note through the conveyor unit in the locations of the data records of the file which are determined by the angular positions of the respective pointers 367*a* , . . . .

The individual pointers are turned to the respective angular position by means of detecting elements which are allotted to the pointers and, distributed throughout the conveyor system, register the bank notes passing therethrough. The detecting elements are the photocell installations 85*a* . . . in the bank note conveying system and the photocell installations (not specifically shown in the drawing) in the sensors S0 to S8.

The detecting elements, designed as photocell installations, are located at those points of the conveyor system where information needed for the data record of the bank notes is obtained.

Starting from a defined initial condition, the pointer allotted to a detecting element is advanced by one as soon as the detecting element detects a bank note. To insure that in those cases where a bank note has left the conveying system before reaching a detecting element, e.g. in a preceding sorting block, the pointers 367*a* . . . are advanced correctly by subsequent bank notes, the pointers are advanced in these cases without detection of these bank notes, as will be described below. This insures that for all bank notes, the first assignment of the data record is preserved during the whole pass.

The creation of a data record 366 during the passage of a bank note through the sensors S0 . . . S8 (FIG. 32) will now be explained in more detail. It will be assumed that there is no bank note in the conveyor unit 2, that the file ($D_1$) 350 has been erased, and that all pointers 367*a* . . . are in a defined starting position.

When the photocell installation 85*a* detects a bank note immediately after the latter has been fed from a stack, that location in the file for bank-note characteristics 350 which is necessary for the creation of a new data record is reserved. This situation is illustrated by a data record 366 shown schematically on the surface of the cylinder. Starting from the above-explained pointer array of the file, this data record belongs to the bank note with the no. 1, since the pointer 367*a* of the photocell installation has jumped from "0" to "1" upon arrival of the leading edge of the bank note 1. The "zero position" is defined here as the position taken up by the pointers 367*b, c, d* etc. in FIG. 34. As first information, according to the position of the center of rotation of the pointer 367*a* on the cylinder axis, the packet number (P.-Nr.) to which the detected bank note belongs is entered in the data record 366. The bank note then passes through the sensor S0. The activation of the photocell installation (not shown) contained in the sensor S0 places the corresponding pointer 367*b* in the position "bank note 1", too, whereupon the test result of the sensor S0 is stored at the data-record location correspondingly marked in FIG. 34. It is assumed here that this is no reject case, so the bank note enters the following building block 12 of the conveyor unit 2 and passes through the sensors S1–S8. While the bank note is passing through the sensors S1–S8, the photocell installations in the sensors place the pointers allotted to them, 367*c, d,* etc., in the position "bank note 1". Then, the test results are stored at the respective locations in the data record.

When the bank note has passed through the last sensor S8, which fact is detected by the photocell installation contained in the last sensor, the following operations are performed until the entry of the bank note into the subsequent building blocks (FIG. 32):

creation of an evaluation byte (A-byte) by means of the test results of the sensors S1–S8, and derivation of the destinations (selection of one of the components 13–18) for the respective bank note by means of the evaluation byte and a decision table stored in the decision file ($D_3$) 365.

The creation of an evaluation byte consists, in principle, in a combination of the test results of the individual sensors S1–S8. The result of the sensor S0 is left out of account since, in a reject case, i.e., when the reject sensor S0 responds, the bank note is routed into the reject pocket 29*a*, thus being kept away from the remaining conveying system.

The combination of the measurement results is advantageous in that an unambiguous statement on the condition and genuineness of each bank note can thus be made with a single data word. Thus, to create the evaluation byte, the results of all sensors are so combined by logic operations that with the aid of a simple decision table, each bank note can be unambiguously assigned to one of the destinations within the sorting blocks 13–18.

In the following it will be explained how the stacking criteria are derived from the evaluation byte, comprising eight characteristics, by means of a decision table stored in the file ($D_3$) 365. For the sake of simplicity, an evaluation byte with only two characteristics will be used: a genuineness characteristic (E) and a condition characteristic (Z).

Figures 35, 36:
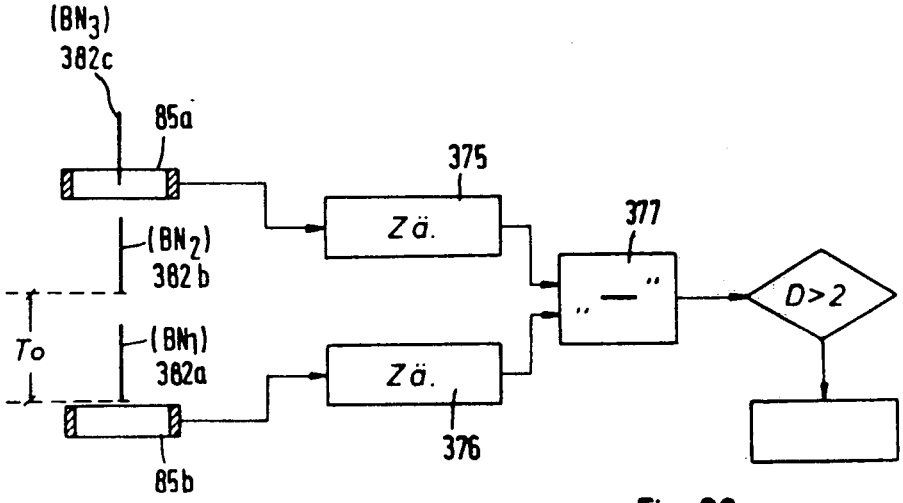
FIG. 35 shows a decision table.
FIG. 36 is a schematic representation "section contents"

As shown in the table of FIG. 35, the destinations chosen are the building blocks 16 and 17 (see FIG. 2) for circulable bank notes (U-Bst.), the building blocks 14 and 15 for non-circulable bank notes (NU-Bst.), the building block 18 for bank notes requiring manual reprocessing (HN-Bst.) and the building block 13 for shredding non-circulable but genuine bank notes (SD-Bst.). Furthermore, E=log·1 means that a bank note has been classified as genuine on the basis of its genuineness marks, and Z=log·1 means that a bank note has been classified as usable or circulabe on the basis of its condition. Bank notes not considered genuine and, consequently, suspected of being counterfeits are routed to the manual reprocessing magazine 29*b*. They must be given priority treatment in any case. Because of the selection of only two characteristics, the evaluation byte, serving as an address for the table stored in the file ($D_3$) 365, can assume four different configurations. For example, for those bank notes whose evaluation byte 370 shows the configuration Z=log·1 and E=log·1, the table specifies the destination for circulable bank notes (U-Bs.), etc.

By the use of different tables 381, any appropriate combination of the bank-note characteristics and the respective destinations can be established. It is easily possible, for example, to specify for non-circulable bank notes the building block 13 for shredding the bank notes (SD-Bst.) rather than the building blocks 14, 15 (NU-Bst.), so that the non-circulable bank notes will be destroyed rather than stacked. On the other hand, it is also possible to use further criteria for evaluation and, according to interpretation, consider them either a condition characteristic or a genuineness characteristic by the use of a corresponding table 381. Furthermore it is possible to test different types of bank notes and currencies in rapid succession by entering different decision tables and alternately selecting the same according to requirements. Thus the information-processing system, too, is adapted to the modular construction of the conveyor unit and, consequently, to the selection and combination of the building blocks and to the processing of different types of bank notes and currencies.

The desired decision table 381 is entered into the appropriate file ($D_3$) via the console 9 connected to the system control unit 6.

The destinations determined on the basis of the test results and by means of the decision table are also stored in the data record 366 of the respective bank note at the location "stacking device required" (FIGS. 32, 33).

The subgroups in the "stacking device required" decisions ($NU_1/NU_2$, $U_1/U_2$) in the data record 366 of FIG. 33 and the meaning of the "stacking device completed action" decision will be explained below.

With the explanation of the derivation of the stacking criteria or of the selection of the destinations, with the aid of the data records 366 created during the passage of the bank note through the sensors S1–S8 and specific to each bank note, the above-mentioned functions of the first subsystem 345 of the conveyor control unit 6 have been described.

It is not yet insured, however, that each bank note is tested individually and follows its path to one of the destinations, which is determined on the basis of the test. To accomplish the last-mentioned task, the conveyor control 6 includes a second subsystem 346.

SECOND SUBSYSTEM 346 OF THE CONVEYOR CONTROL UNIT 6 (FIGS. 31, 32)

The second subsystem 346 has the following functions:

It determines whether bank notes are piling up within the conveying section because of noncompliance with the clock spacing. In this case, the individual testing and the discharge of the bank notes from the conveying system is hindered or impossible. It may also happen that the association of the bank notes with their respective packets is disturbed, and that bank notes are damaged within the conveyor unit.

It sees to it that no bank note leaves the conveyor unit unregistered, i.e., disappears from the conveyor system without being registered or gets stuck anywhere in the conveyor system.

It monitors that the path determined by the "stacking device required" decisions of the data records are followed (sorting gate operation), and that the bank notes are transported through the conveyor system in synchronism with the elements coming into contact with the bank notes (sorting gates, stacking devices).

As shown in FIGS. 31 and 34, the data sources of the second subsystem 346 are the photocell installations 85*a* . . . in the bank note conveying system and a machine clock (MU) 371 for generating the clock signal which represents the reference time for all sequence of operations within the sorter. Further data sources are the pocket release indicators (STF) 372*a* . . . , which determine whether a pocket intended to receive bank notes is moving in synchronism with the bank notes being supplied, the file ($D_1$) 350 with the data records, and a file ($D_4$) 373 for checking the bank note travel time.

Data sinks of the second subsystem are the files ($D_1$) 350, ($D_4$) 373, which also act as data sources. Further data sinks are control lines 374 for controlling the sorting gates or initiating an emergency stop, for example.

The functions of the second subsystem 346 for monitoring the transport of the bank notes are fulfilled by three monitoring mechanisms during the bank note transport:

monitoring of the contents of conveying sections;

monitoring of the travel time of bank notes in the conveying system related to the clock signal of the machine clock 371, and monitoring of the path determined by the "stacking device required" decisions (sorting gate control) and of the synchronism of the bank notes to be stacked with the pockets of the respective stacking device.

MONITORING OF THE CONTENTS OF BANK NOTE CONVEYING SECTIONS (FIGS. 32, 36)

The monitoring of the contents of conveying sections is necessary to detect any pile-up of bank notes.

The continuous monitoring process, which is carried out with respect to all conveying sections limited by two photocell installations, will be explained with the example of the conveying section limited by the photocell installations 85*a*, 85*b* (FIG. 32). The geometric distance between the photocell installations and the clock spacing ($T_0$) of the bank notes - distance between the leading edge of a bank note and the leading edge of the following bank note - determine the maximum number of bank notes that may be contained between the respective photocell installations of a conveying section if the sorter is to operate correctly. Any overcrowding is detected by means of two counters which are connected to the photocell installations and whose counts are constantly compared.

For an explanation of the monitoring of the contents of conveying sections (FIG. 36), an initial condition will be assumed which is defined by the fact that no bank note has entered the above-defined conveying section yet, and that the counter 375 of the entry photocell installation 85*a* is in the "0" state, while the counter 376 of the exit photocell installation 85*b* of this conveying section is in the "1" state. If, at these count states the difference (D) between the count states is formed in a subtractor 377 common to both counters, a negative value is obtained which thus provides the information that there is no bank note in the conveying section. When the entry photocell installation 85*a* detects the first supplied bank note ($BN_1$) 382*a*, the connected counter 375 switches from "0" to "1". The difference D between the count states is now 0, which is interpreted as an indication that one bank note has entered the conveying section. Accordingly, if two of to the bank notes contained in the conveying section, the difference between the count states reaches a positive value ($D \geqq 0$).

If, for example, as shown in FIG. 36, it is possible because of the geometric conditions that the entry photocell installation 85*a* detects a maximum of three bank notes 382*a*, 382*b*, 382*c* before the exit photocell installation 85*b* detects the exit of the oldest bank note ($BN_1$) 382*a* in the conveying section, the difference between the count states must not exceed "2". If it does, the sorting procedure must be interrupted because the conveyor system is "overcrowded".

Figure 37:
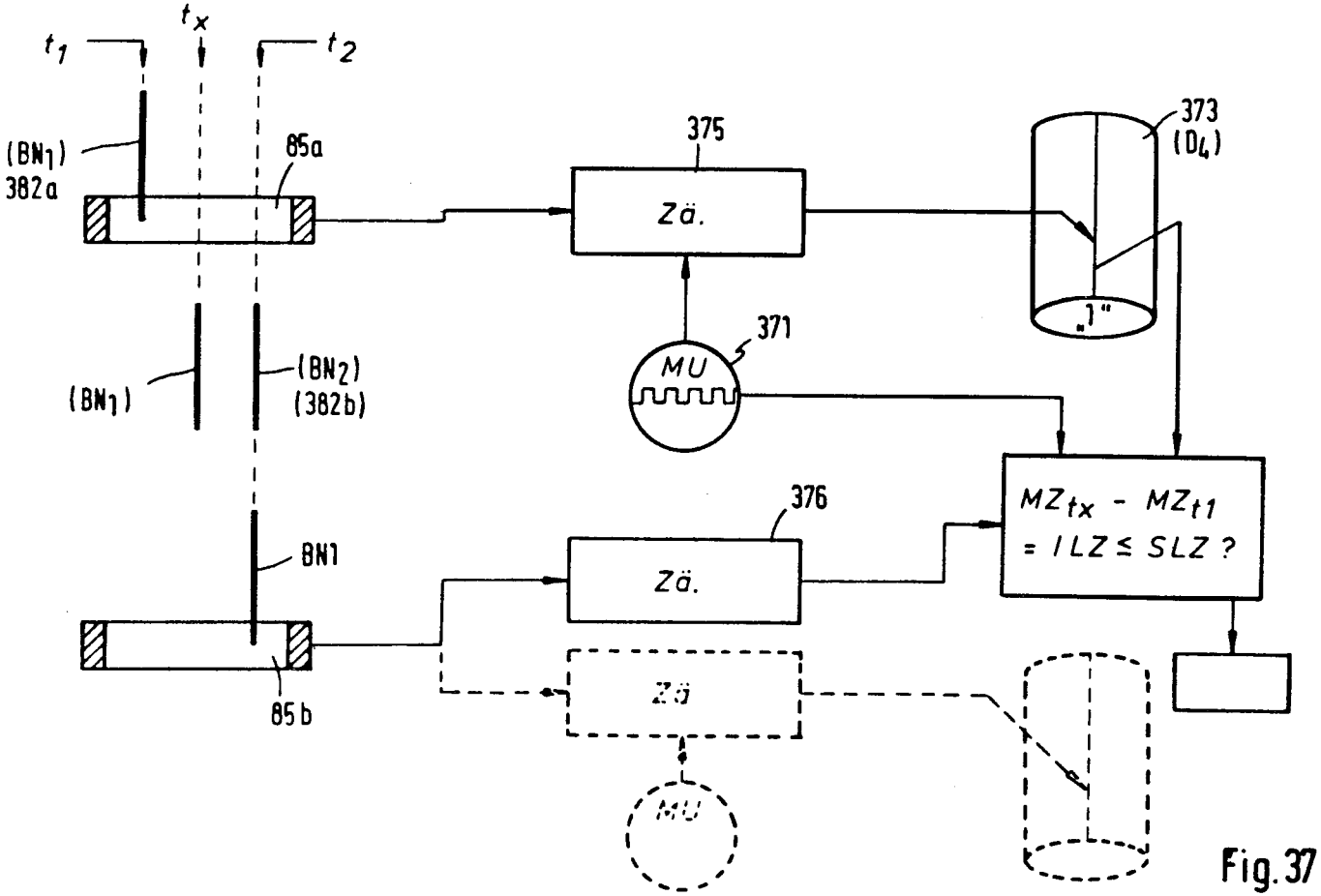
FIG. 37 is a schematic representation "travel-time supervision"

MONITORING THE TRAVEL TIME OF BANK NOTES IN THE CONVEYOR SYSTEM (FIGS. 31, 32, 37)

The monitoring of the travel time of the bank notes in the conveyor system, related to the clock signal of the machine clock 371, is necessary to insure that each bank note having entered a conveying section limited by two photocell installations leaves this section again after a predetermined "nominal travel time". The nominal travel time is again determined by the geometric dimensions of the respective conveying section.

The monitoring of the travel time of the bank note between the photocell installations 85*a* und 85*b* will now be explained with the aid of FIG. 37.

As shown in FIG. 37, starting from the above defined initial condition, the counter 375 connected to the entry photocell installation 85*a* (entry counter) is in the "0" state, and the counter 376 connected to the exit photocell installation 85*b* (exit counter) in the "1" state. The state indicated by the entry counter 375 when a bank note enters the conveying section shows at which address of the connected travel-time file ($D_4$) 373 the time indicated by a machine clock 371 at the entry of the bank note must be stored. The state of the exit counter 376 shows from which address of the travel-time file 373 the entry time, needed for the comparison, must be called to permit the travel time of a bank note having entered a conveying section to be monitored. Since all conveying sections of the whole bank note conveying system must be monitored as to the bank note travel time, the interrogation instants for the individual conveying sections are controlled by a superordinate, cyclically organized interrogation program. The program, which will not be specified here in detail, is organized so that a bank note passing through a conveying section is monitored several times at very short intervals by comparing the actual travel time with the nominal travel time so that the reaction against a travel time error can be as fast as possible. During the individual monitoring processes it is determined whether the actual travel time, formed by the difference between the machine time at the interrogation and the stored time of entry of a bank note, is shorter than or equal to the nominal travel time, which is constant for the conveying section.

The monitoring of the travel time will now be explained in detail with respect to the conveying section limited by the photocell installations 85*a*, 85*b* (FIG. 37).

Let us assume that a bank note ($BN_1$) 382*a* is passing through the entry photocell installation 85*a* of the conveying section at an instant $t_1$. With the detection of the bank note, the connected entry counter 375 switches from the state "0" to the state "1". Simultaneously, the machine time ($MZ_{t1}$) indicated by the machine clock 371 at the entry of the bank note is stored at the location "1" of the travel-time file ($D_4$) 373 connected to the entry counter 375.

To do this, in accordance with the count state of the exit counter 376 - this counter is in the state "1" - the time of entry of the bank note ($BN_1$) 382*a* is interrogated from the travel-time file 373 and deducted from the machine time ($MZ_{tx}$) indicated at the interrogation instant $t_x$ ($MZ_{tx}$-$MZ_{t1}$). The difference forms the current actual travel time (ILZ). As mentioned earlier, this actual travel time must be shorter than or equal to the nominal travel time (SLZ) ($MZ_{tx}$-$MZ_{t1} \leqq SLZ$). When the bank note (BN1) reaches the exit photocell installation 85*b* at the instant $t_2$, the connected counter 376 switches from "1" to "2". From now on, in accordance with the new count state, the second bank note (BN2) 382*b*, which has meanwhile entered the conveying system, is monitored with regard to its travel time. Thus, as a result of the specific initial states of the counters, the travel time of the respective oldest bank note in the conveying section is monitored.

If the first-mentioned bank note (BN1) 382*a* does not reach the exit photocell installation 85*b* within the nominal travel time, e.g. because it got stuck in the conveying system, the nominal travel time will soon be exceeded, which will result in an immediate interruption of the sorting procedure.

With the detection of a bank note by the exit photocell installation 85*b*, the monitoring of the travel time of the bank note in the conveying section located in front of the photocell installation has been completed. However, since the exit photocell installation 85*b* of a conveying section is also used as the entry photocell installation for the following conveying section, the travel time monitoring for the following conveying section can be initiated with the aid of a second counter connected to this photocell installation, and of an additional travel-time file, indicated by broken lines in FIG. 37.

MONITORING THE PATHS DETERMINED BY THE "STACKING DEVICE REQUIRED" DECISIONS (FIGS. 31, 32, 38, 39)

The description of the monitoring of the bank notes will be concluded by explaining how a bank note is monitored as to whether it follows the transport path to one of the sorting blocks, which path is determined by the "stacking device required" decisions. By way of example, the stacking of non-circulable bank notes in one of the building blocks for non-circulable bank notes operating in tandem will now be explained in more detail with the aid of flowcharts (FIGS. 38, 39).

Having left the measuring section and, thus, the sensors S1–S8 in the building block 12 of the conveyor unit 2, a bank note (FIG. 32), unless intended to be processed in the shredder block 13 (this is determined by the decision table), travels to the exit photocell installation 85g of the shredder block 13. With the detection of the bank note by the exit photocell installation 85g, and determined by the position of the pointer of the exit photocell installation, the "stacking device required" decision of the bank note is checked in the data record of the bank note as to whether the bank note is noncirculable (BN:=NU?); see the flowchart "stacking device selection" in FIG. 38. If circulable, the bank note is transported to the subsequent building blocks 16, 17 for circulable bank notes, which will not be described here. If, however, the bank note is non-circulable, it must first be determined which of the two building blocks 14, 15 for non-circulable bank notes is ready to stack the bank note.

In the following, the first building block 14 for non-circulable bank notes is designated "$NU_1$-Bst.", and the second building block 15 for non-circulable bank notes "$NU_2$-Bst.". To permit the selection of a building block, a so-called nominal counter ($NU_1SZ$, $NU_2SZ$) is associated with each building block 14, 15. The count of the nominal counter shows how many non-circulable bank notes have already been stacked in the respective building block 14 or 15. The difference from the nominal number, which is determined by the capacity of the receptacles 26, 27 used to stack the bank notes or by organizational rules of the bank-note processing, gives information as to whether the bank note is to be stacked in the building block being in operation or in the parallel building block.

Figure 38:
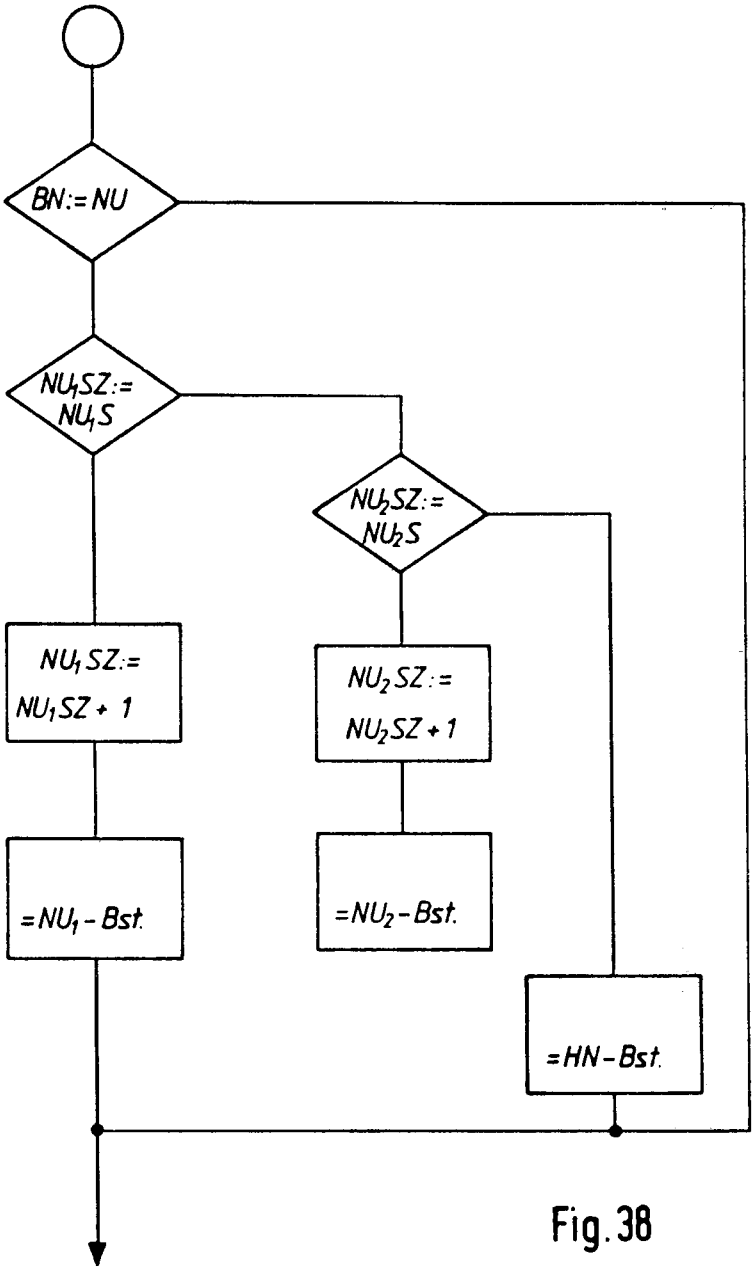
FIG. 38 is a flowchart "stacking device selection"
Figure 39:
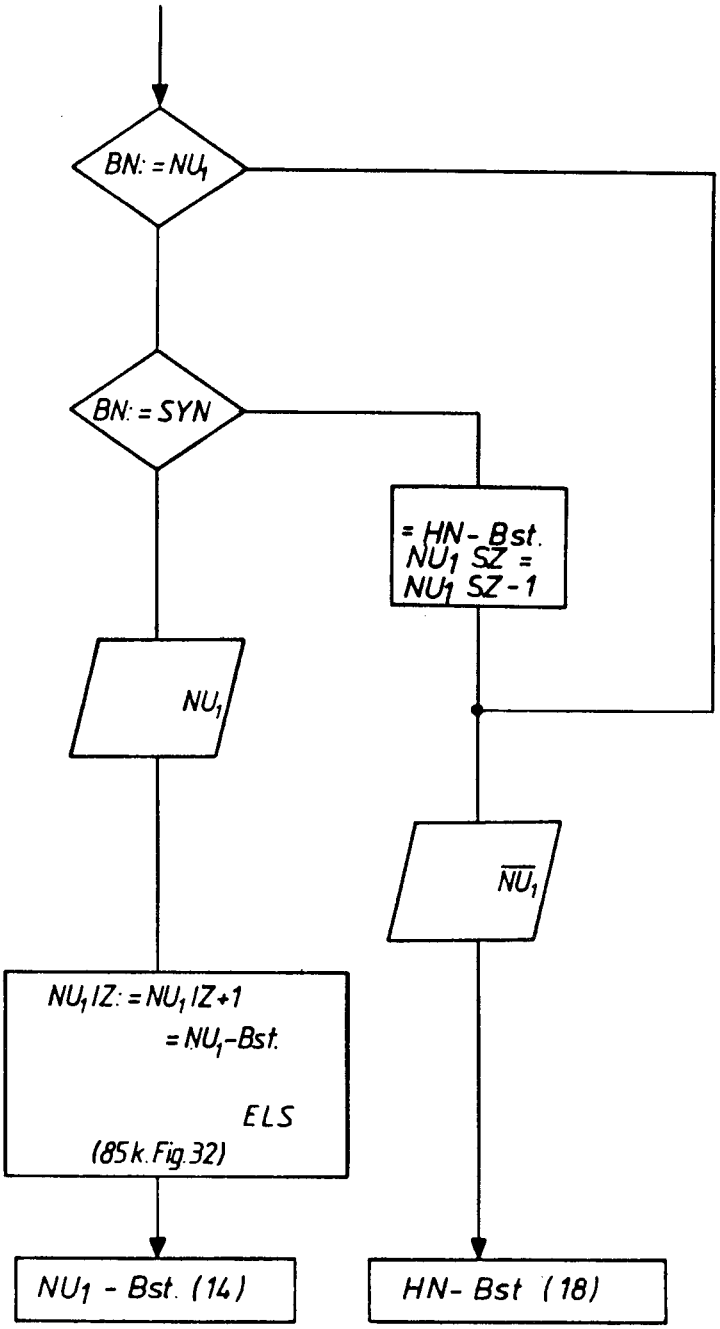
FIG. 39 is a flowchart "sorting gate control"

If, as shown in the flowchart of FIG. 38, the interrogation for the state of the nominal counter ($NU_1SZ$:-=$NU_1S$?) shows that the nominal number has not yet been reached, the counter is incremented by "1" ($NU_1SZ+1$). With the last-mentioned interrogation, the noncirculable bank note is destined to be stacked in the building block 14, which fact is stored in the data record of the bank note at the location "stacking device required" (stacking device required: $NU_1$-Bst.). If the nominal counter had already reached the nominal number, the corresponding nominal counter of the subsequent buiding block 15 is checked in a further step as to whether it, too, has reduced the nominal number ($NU_2SZ$:=$NU_2S$?). If this counter has not reached the nominal number, it is incremented by 1 ($NU_2SZ$:-=$NU_2SZ+1$). Analagously to the building block 14, the planned stacking is stored in the data record of the bank note (stacking device required=$NU_2$-Bst.). If, however, for some abnormal reason, the second nominal counter has not reached the nominal number, either, the respective bank note travels to a pocket of the last building block 18 (HN-Bst.).

During the interrogation of the respective nominal counters it is also checked whether the building blocks 14, 15 are in working order so as to be able to stack bank notes. It is checked, for example, whether the sorting gates of the building blocks have been in working order so far, and whether the stacking drum has been ready for operation so far.

After the selection of the building block 14 for a noncirculable bank note, the sorting gate control will now be explained with the aid of the flowchart shown in FIG. 39.

It is assumed that the bank note has meanwhile entered the building block 14. Immediately after its entry, the bank note is detected by the entry photocell installation **85*i* of the building block 14 (FIG. 32). With the detection it is first determined whether the bank note actually corresponds to that interpreted by the photocell installation. If the photocell installation has interpreted the bank note as the nth bank note by a jump of its pointer from n−1 to n, for example, it will be determined by interrogation of the data record of the nth bank note whether a "stacking device completed action" entry is already present or whether the nth bank note has already been processed in the shredder block 13 in this specific case. In this case, the data record of the bank note contains a "stacking device completed action" entry. If the bank note has already been stacked, the correct bank note number must be found by repeating the interrogation - and, consequently, the advance of the pointer - until the data record with the missing "stacking device completed action" entry has been reached. In this manner it is ensured that the pointer of the photocell installation 85*i* points to a data record which belongs to the bank note detected by the photocell installation. Thus, according to the flowchart shown in FIG. 39, the interrogation can now take place as to whether the supplied bank note (HN) is to be stacked in the first building block 14 for noncirculable bank notes (BN:=$NU_1$-Bst.?). If the data record of the bank note contains a "stacking device required" entry for the building block 14** ($NU_1$-Bst.), a synchronization test (BN:=SYN?) follows, which will be explained below.

If the bank note is moving in synchronism with the designated pocket of the stacker drum **217*a* of the building block 14, the sorting gate 83*c* of the building block 14 will be so activated as to divert the bank note from the original conveying section and lead it to the designated pocket of the stacker drum 217*a* ("sorting gate":-=$NU_1$-Bst., FIG. 32**).

Immediately before moving into a pocket of the stacker drum **217*a*, the bank note passes through a last photocell installation 85*j*** in the conveying section leading to the stacker drum. As a result, the following operations are performed:

- The "stacking device completed action" counter ($NU_1IZ$) is incremented by 1 (the "stacking device completed action" counter indicates how many noncirculable bank notes were actually conveyed to the first building block 14 ($NU_1IZ$:-=$NU_1IZ+1$).
- The "stacking device completed action" entry is made in the data record of the stacked bank note.
- The "stacking device required" and "stacking device completed action" entries in the data record of the stacked bank note are compared to check the correct stacking.
- The exit photocell installation **85*k* of the building block 14, which corresponds to the photocell installation 85*j*, is advanced by 1**, so this photocell installation, too, automatically registers the stacking of the bank note because of a pointer common to both photocell installations.

As can be seen from the "sorting gate control" flowchart of FIG. 39, a bank note, before being stacked, is checked for synchronism since, if the fast sorting procedure is to be maintained, a bank note can be stacked only if it moves in synchronism with the respective pocket of the selected stacking drum. The synchronism is determined - this will be explained with reference to the building block 14 - by the time interval between two signals (cf. FIG. 40), namely the signal 383 of the pocket release indicator (STF-$NU_1$) and the signal 385 of the entry photocell installation **85*i* of the building block 14**, which signal appears the moment a bank note is detected.

The pocket release indicator is a proximity detector (not shown in the figures) at the stacking device **217*a*. It generates a signal whenever a pocket of the stacking device takes up a defined position relative to those pulleys of the conveying section leading to the stacking device which are disposed directly in front of the stacking device. When the signal 383 of the pocket release indicator appears, the signal 384 of the entry photocell installation 85*i* must follow after a given time interval withing the tolerance range Δt 385** to indicate synchronism.

Figure 40:
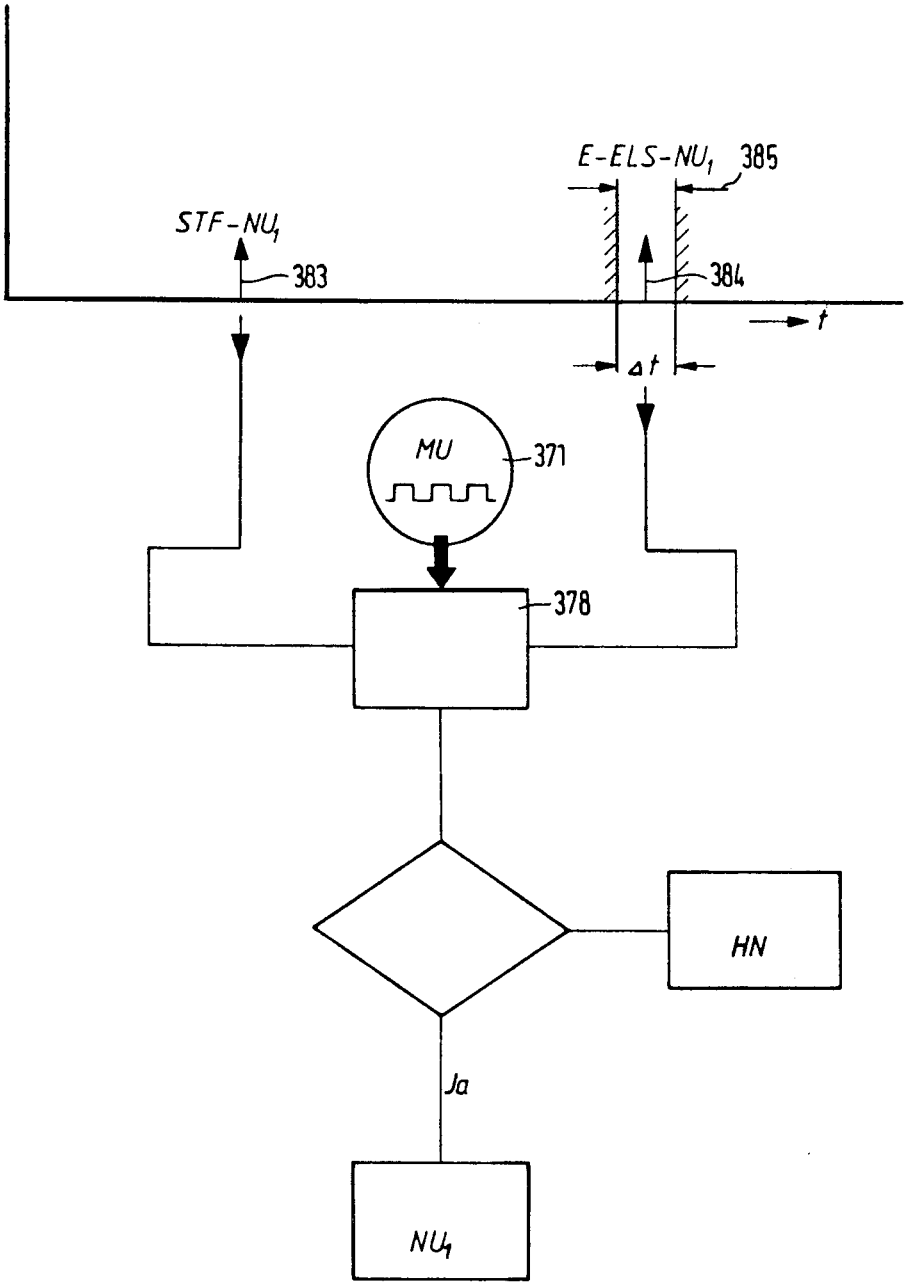
FIG. 40 is a schematic representation "check synchronism".

This is illustrated schematically in FIG. 40. The time interval between the two signals is determined with a counter 378 coupled to the clock signal of the machine clock 371. With the appearance of the signal 383, the counter 378 is released. If the bank note is moving synchronously with the pocket, the leading edge of the bank note will appear at the entry photocell installation **85*i* of the building block 14 after the predetermined time within the tolerance range Δt 385. The photocell installation 85*i* then delivers the stop signal for the counter 378**.

By means of an evaluation program it is checked whether the count reached lies withing the tolerance range Δt. A count lying outside the tolerance range indicates an asynchronously moving bank note, which is then passed to the manual reprocessing magazine of the building block 18 (NH-Bst.) by suitable activation of the sorting gate, as shown in the flowchart of FIG. 39 ("sorting gate":=$NU_1$).

Upon detection of the asynchronism, an entry is made in the data record of the bank note to the effect that the bank note is to be stacked in the building block 18 for bank notes requiring manual reprocessing (HN-Bst.) ("stacking device required":=HN-Bst.). In addition, the previously set nominal counter of the first building block 14 for noncirculable bank notes ($NU_1SZ$) is decremented by "one" ($NU_1SZ=NU_1SZ-1$), and a message concerning the event is sent to the system control unit 7 (FIG. 31), which message, stored in the permanent store 375 of the system control unit under the number of the packet, serves later to compile the manual reprocessing log.

THIRD SUBSYSTEM 347 OF THE CONVEYOR CONTROL UNIT 6 (FIGS. 31, 32)

The bank notes not processed or stacked in one of the sorting blocks 13–18 are routed to the manual reprocessing magazine of the last building block 18 of the sorter. The bank notes of a packet, together with the revenue stamp belonging to the packet, are stacked in a pocket of the manual reprocessing magazine **29*b*, as explained in connection with the building block 18**, in the following special cases:

heavily damaged bank notes,
bank notes suspected of being counterfeits,
asynchronously arriving bank notes, and
bank notes which belong to a packet containing an excess amount of bank notes (number of bank notes greater than 100).

If a packet shows a deficit or if there is a reject case in a packet, only the revenue stamp belonging to this packet will be stacked in a pocket of the manual reprocessing magazine **29*b***.

To ensure that the revenue stamp belonging to the input packet can be stacked together with the bank notes requiring manual reprocessing, it is necessary to monitor and control the transport of the revenue stamps.

The data sources of this third subsystem 347 of the conveyor control unit 6 are the photocell installations **86*a* . . . in the revenue stamp conveying system 32, the machine clock (MU) 371 for generating the machine clock signal, the pocket release indicator (STF)372 of the stacker drum 217*e*, the file ($D_1$)350 with the data records, and the travel-time files for bank notes ($D_4$)373 and revenue stamps ($D_5$)379**.

Data sinks of the third subsystem are the file ($D_1$)350 with the data records, the files ($D_4$, $D_5$)373, 379 for bank-note and revenue-stamp travel times, and control elements 374.

During the revenue-stamp transport, like during the bank-note transport, it is necessary to monitor the section contents as well as the travel times of the revenue stamps. Since the test mechanisms were described in detail in connection with the monitoring of the bank-note transport, they will not be dealt with here. Thus, the control of the revenue-stamp transport in the event of an irregularity in a packet remains to be explained with the aid of FIG. 32.

As was stated in the description of the manual reprocessing block 18, the revenue stamp of the bank-note packet being processed is in the revenue stamp conveying section 32 (FIG. 32) of the next to the last building block 17 in a waiting position behind the photocell installation **86*i*, related to the direction of transport. If there has been no error with respect to the above-mentioned test mechanisms (overcrowding of conveying sections, travel-time check), the revenue stamp held in the waiting position 32*h*** must belong to the packet being processed. Now it is first determined at what instant the last bank note of a packet has left the conveying system in the worst case, i.e., if stacked in a pocket of the last building block. The instant "packet end" is easy to determine since both the instant the last bank note of a packet is fed from the stack, and the maximum time the bank note needs to possibly cover the longest transport distance are known (monitoring of travel time).

When the instant (packet end) has been reached, the revenue stamp conveying section **32*h* of the next to the last building block 17 is activated so that the revenue stamp can be passed on to the revenue stamp conveying section 32*i* of the last building block 18. Immediately after its entry into the building block 18, the revenue stamp passes through the entry photocell installation 86*j*** of this building block, thereby initiating a check for manual reprocessing entries in all data records of the bank notes belonging to the packet just worked off.

If one of the bank notes has a manual reprocessing entry (HN) in its data record (see FIG. 33) at the location "stacking device completed action", or if manual reprocessing is required because of a deficit or excess in the packet or because the bank note has been stacked in the first reject magazine **29*a*, the revenue stamp will be diverted from the original conveying section 32*i* by suitable activation of the sorting gate 83*g* and sent, via the conveying section 33 and the stacker drum 217*e*, to the bank note(s) already collected below the stacker drum on the stack-forming and deflection mechanism 255. Together with the stacked bank notes, the revenue stamp is finally transported to a pocket of the manual reprocessing magazine 29***b*.

If the bank-note packet just worked off has no manual reprocessing entry, the sorting gate 83*g* will not be activated, so the revenue stamp will be transported to a receptacle 253 for regular revenue stamps.

Each time the next to the last revenue stamp conveying section 32*h* of the building block 17 is emptied by calling up the revenue stamp temporarily stored therein, the revenue stamps stored in the preceding conveying sections 32*g*, 32*f* automatically move up by activation of the respective conveying sections so that the revenue stamp of the "current bank-note packet" is always held ready in the next to the last conveying section 32*h*.

FOURTH SUBSYSTEM OF THE CONVEYOR CONTROL UNIT (FIGS. 31, 32)

Finally the fourth subsystem 348 of the conveyor control unit 6 will be explained, which monitors and controls the mechanical peripherals of the bank-note sorter 1. The control of the mechanical peripheral units, such as that of the manual reprocessing magazine 29*b* in the building block 18, is effected via the control elements serving as data sources or data sinks (photocell installations, switches, etc., cf. in FIG. 26 the photocell installations 294 or the switch 291) and united in FIG. 31 in a block 386 for all peripheral units, and via the file ($D_6$) 351, which also acts as a data source and data sink. The file ($D_6$) 351 contains the machine events relating to the peripherals of the bank-note sorter 1.

The mechanical peripheral units operate on the sequence control principle with relatively short switching times. With respect to information processing, each of these units is a self-contained system which, as a rule, is linked with the remaining system via only two bits, i.e., start instruction and "finished" back indication. As an example, the control of the manual reprocessing magazine will be briefly explained in the following (FIGS. 31, 24, 26).

If there are irregularities in a packet, the revenue stamp will always be stacked as the last element of the packet on the stack-forming and deflection mechanism 255 via the revenue stamp conveying section 33 and the stacker drum 217*e* (cf. FIG. 24). When the exit photocell installation 861 detects a revenue stamp in the revenue stamp conveying section 33, the stack-forming and deflection mechanism 255 is activated after a certain delay and transports any bank notes having accumulated, together with the revenue stamp, to an available pocket of the manual reprocessing (HN) magazine 29*b*. This stacking is registered by the photocell installation 294 (cf. FIG. 26), whereupon the pocket number 264 is identified via the diode matrix 293 and entered into the file ($D_6$) 351 together with the number of the packet just processed. The magazine is then moved on by means of the drive system 273 until the next pocket is in the loading position. The loading position is signalled by a switch 291 which is actuated by the engaging angle of the pocket to be loaded. This process repeats itself when the exit photocell installation 861 registers another revenue stamp.

Further peripheral units are, for example, the packet-feeding and revenue stamp-removing station in the building block 10 and the revenue-stamp-affixing station 28 in the building blocks 16, 17, which will not be described here, however.

With the fourth subsystem, all systems 345, 346, 347, 348 of the conveyor control unit 6 have been described. In conclusion the system control unit 7 with its peripheral units 8, 9 will be treated.

SYSTEM CONTROL UNIT 7 (FIG. 31)

In contrast to the conveyor control unit 6, which monitors and controls the passage of each individual bank-note packet, bank note, and revenue stamp through the conveyor unit 2, the system control unit 7 with its peripheral units 8, 9 takes care of the whole organization of the bank-note processing in a processing shift.

It is responsible for seeing that the work sequence of the bank-note processing, laid down according to organizational rules, is complied with, and takes over the communication with the operating personnel via its peripheral units.

Data sources of the system are the file ($D_1$) 350 and the file ($D_6$) 351 of the short-time store, the permanent file ($D_2$) 357, and data input devices (keyboards 359, 360) at the manual reprocessing position 8 and at the console 9. Data sinks are the file ($D_1$) 350 and the file ($D_6$) 351, the permanent file ($D_2$) 357, and data output devices (printers 361, 362 and the visual display unit 363) at the manual reprocessing positions 8 and at the console 9. A process computer (R) 359 takes over the control of the data flow between the data sources and data sinks according to the organizational rules.

Already during the processing of a bank-note packet, but not later than after the processing of the packet, the system control unit extracts from the file ($D_1$) 350, where the data records of all processed bank notes are stored, the data records belonging to the processed bank notes and stores them in the permanent file ($D_2$) 357, e.g. a disk file, specifying the associated packet and input-magazine numbers. In addition, the data of the file ($D_6$) 351 is transferred to the permanent file. With the data stored in the permanent file, the following logs are produced via the output devices (printers, visual display unit) of the peripheral units as required:

the manual reprocessing log,
the operation log,
the shift log.

The manual reprocessing log is produced whenever a magazine 29*b* in the last building block 18 of the conveyor unit 2 has been loaded, or in compliance with other organizational rules (e.g. packet end). The log is printed out by the printer 361 of the manual reprocessing position 8 and contains the following information:

- date and time of the delivery of the log,
- the number of the input magazine,
- the delivery of the processed currency and denomination,
- the number of the packet in which there was an irregularity,
- the number of the manual reprocessing magazine (2nd reject magazine 29*b*)
- the pocket number of the manual reprocessing magazine,
- the number of bank notes constituting a deficit or excess,
- the number of bank notes not corresponding to the currency or denomination processed,
- the number of bank notes suspected of being counterfeits,
- the number of bank notes in the respective pockets of the manual reprocessing magazine, the number of bank notes stacked as usable or unusable, and of shredded bank notes, and any reject case by giving the respective pocket and magazine numbers of the reject magazine (1st reject magazine 29a).

On the basis of the log, the loaded manual reprocessing magazine is subjected to final processing by hand at the manual reprocessing position 8.

For example, those bank notes in a pocket which, according to the log, belong to an "indefinite" input packet (number of bank notes in the packet could not be determined because of machine malfunction or because more than one bank note was fed from the stack at a time) are counted and sorted by hand. The result is entered under the identification number of the packet into the permanent file ($D_2$) 357 via the keyboard 359 at the manual reprocessing position 8 to complete the data of the packet.

In addition to the manual reprocessing log, an operation log is delivered via the printer 362 of the console 9 if required. The operation log gives information about any human intervention, machine malfunctions and their causes, and on special instructions or test runs.

Current machine events, such as the making available of new packet magazines or malfunctions and their location, are communicated to the operating personnel via the visual display unit 363 of the console 9, thus permitting a fast system diagnosis in the event of a malfunction.

Finally it should be mentioned that at the end of a shift (i.e. after a given number of input magazines have been processed), a shift log is produced in which the following data is recorded:

date and time of the delivery of the log, number of processed input magazines along with the respective magazine numbers, number of processed input packets, currency and denomination of the processed bank notes, information on whether the magazine contents were complete, total number of bank notes introduced into the sorter, number of bank notes stacked as usable or unusable, and of shredded bank notes, number of bank notes suspected of being counterfeits, and of bank notes of false currency or denomination, and total number of bank notes constituting a deficit or excess amount.

What is claimed is:

1. A method of automatically sorting thin sheets, such as paper bank notes, in packets, having a stack of the sheets which may include regular and irregular sheets bound by an associated band carrying specific information, of the type having the steps of withdrawing each sheet from the stack, testing each sheet according to different criteria, assigning a regular or irregular category to each sheet on the basis of a test result of the testing, directing each sheet to one of a plurality of respective target locations which is associated with at least one category assigned to the respective sheet, and separately directing the band to one of the target locations, comprising:

(a) mechanically separating the stacks and the bands;

(b) mechanically conveying the bands separately from the stacks;

(c) conveying each of the sheets over a sheet feed path to one of the target locations and conveying the band over a band feed path to a dwell position within the band feed path;

(d) maintaining the band at the dwell position within the band feed path for a period of time approximately corresponding to the time period for directing each sheet of the stack associated therewith to the respective target locations;

(e) collectively depositing the band of each packet having no irregular sheets; and (f) mechanically reuniting sheets categorized as irregular with the band of the stack associated therewith.

2. The method of claim 1, further comprising conveying a plurality of the packets into a sorter means in predetermined quantities united in locked input magazines.

3. The method of claim 2, further comprising the steps of mechanically unlocking said input magazine within said sorter means.

4. The method of claim 3, further comprising the step of mechanically feeding each pocket successively to a separating station.

5. The method of claim 4, further comprising the step of forming a data record for each sheet including a record of the category assigned to each sheet on the basis of the test result.

6. The method of claim 5, further comprising the step of generating an evaluation byte in a data processor corresponding to said record of the category assigned to each sheet on the basis of the test result.

7. The method of claim 6, further comprising storing said data record during the conveyance of each sheet of a stack of one of the target locations.

8. The method of claim 7, further comprising assigning the sheets of the regular category to a noncirculable and circulable category on a basis of the test result of the testing.

9. The method of claim 8, further comprising the step of stacking each noncirculable sheet in a lockable receptacle by means of a tandem stacking system.

10. The method of claim 9, further comprising destroying together each noncirculable sheet and locable receptacle.

11. The method of claim 1, further comprising assigning the sheets of the regular category to a noncirculable and circulable category on a basis of the test result of the testing.

12. The method of claim 11, further comprising reuniting the sheets of the noncirculable category of each stack and the band associated therewith.

13. The method of claim 11, further comprising reuniting the sheets of the circulable category of each stack and the band associated therewith.

14. The method of claim 1, further comprising the step of forming a data record for each sheet including a record of the category assigned to each sheet on the basis of the test result.

15. The method of claim 14, further comprising the step of generating an evaluation byte in a data processor corresponding to said record of the category assigned to each sheet on the basis of the test result.

16. The method of claim 15, further comprising storing said data record during the conveyance of each sheet of a stack to one of the target locations.

17. The method of claim 16, further comprising assigning the sheets of the regular category to a noncirculable and circulable category on a basis of the test result of the testing.

18. The method of claim 17, further comprising the step of timing movement of each sheet through said sheet feed path.

19. The method of claim 18, further comprising comparing the time of passage of each sheet through a discrete portion of said sheet feed path with a nominal time, and interrupting the sorting method when said nominal time is exceeded.

20. The method of claim 18, further comprising the step of stacking at least one category of the sheets in combination with the band associated with the stack in a receptacle in a timed sequence associated with the movement of the sheets.

21. The method of claim 20, further comprising the step of separately stacking assynchronously moving sheets of a stack.

22. The method of claim 1, further comprising the step of timing movement of each sheet through said sheet feed path.

23. The method of claim 22, further comprising comparing the time of passage of each sheet through a discrete portion of said sheet feed path with a nominal time, and interrupting the sorting method when said movement time is exceeded.

24. The method of claim 22, further comprising the step of stacking at least one category of sheets in combination with the band associated with its stack in a receptacle in a timed sequence associated with the movement of the sheets.

25. The method of claim 24, further comprising the step of separately stacking assynchronously moving sheets of a stack.

26. The method of claim 25, further comprising automatically counting the number of sheets passing through a discrete portion of the sheet feed path and comparing said number of sheets with a predetermined number to determine if said number deviates from said predetermined number.

27. The method of claim 25, further comprising automatically counting the number of sheets entering and leaving a discrete portion of the sheet feed path, comparing the difference in said number to determine if a predetermined difference is exceeded.

28. The method of claim 27, further comprising the step of interrupting the sorting method when said determined difference is exceeded.

29. An apparatus for inspecting and sorting pockets of bank notes, each of said packets having a plurality of bank notes which may include regular and irregular notes bound by a band, comprising: a separator for receiving and separating said bank notes and said band, feed means for successively passing each of said separated notes along a first feed path within said apparatus, conveying means for independently passing each of said bands along a second feed path within said apparatus, a testing unit disposed along said first feed path for testing each of said bank notes and generating a test signal determinative of characteristics of said bank notes, a conveyor control unit operatively connected to said testing unit for categorizing each of said tested bank notes as regular and irregular in response to said signals and for generating a control output as a function of said categorization, sorting means disposed along said first feed path for sorting said tested notes into groups of regular notes and iregular notes in response to said control output, means for reuniting said irregular notes of each of said packets with said band first associated with said packet, means for collectively depositing bands of packets having no irregular notes, and a stacking member associated with said first feed path for receiving said regular bank notes.

30. The apparatus according to claim 29, wherein said conveyor control unit includes means for categorizing said regular notes into circulable and noncirculable notes, and sorting means includes means for respectively sorting said circulable and noncirculable notes into groups, and a receiving means for receiving said noncirculable notes.

31. The apparatus according to claim 29, wherein said receiving means for receiving said noncirculable notes includes means for destroying said noncirculable notes.

32. The apparatus according to claim 31, wherein said receiving means includes a shredder.

33. The apparatus according to claim 29, further comprising a plurality of modules, each of said modules having a bank note inlet and a bank note outlet, said modules being successively connected, each of said modules having means defining a portion of a bank note conveyor system for conveying said bank notes through said first feed path and means defining a portion of a band conveyor system for conveying said bands through said second feed path.

34. The apparatus according to claim 29, further comprising means for stacking said circulable notes and fixedly banding a predetermined number of said circulable notes into a packet.

35. The apparatus according to claim 34, wherein said stacking means includes a sorting gate for diverting said circulable notes from said first feed path in response to said output of said conveyor control unit, a stack forming member for receiving each of said diverted circulable notes, means for detecting the number of circulable notes and providing a signal to said conveyor control unit to initiate banding of said predetermined number of bank notes.

36. The apparatus according to claim 29, further comprising a plurality of detectors disposed along said first feed path for detecting the position of said bank notes and for providing a signal to said conveyor control unit in response to said position.

37. The apparatus according to claim 36, wherein said conveyor control unit includes means for continuously monitoring the position of each bank note in response to said detector signal.

38. The apparatus according to claim 37, wherein said monitoring means includes a timer for monitoring the actual travel time of a bank note and means for comparing said actual travel time with a predetermined time.

39. An apparatus for inspecting and sorting packets of bank notes, each of said packets having a stack of bank notes which may include regular and irregular notes bound by a band, comprising a plurality of modular units successively connected to each other for processing the bank notes, first conveying means for passing said notes through a note feed path extending through at least some of said units, second conveying means for passing each band through a band feed path extending through at least some of said units, each intermediately disposed unit of said units having an inlet and an outlet connected respectively to an outlet and an inlet of adjacent units, a separating means disposed in one of said modular units for separating the stack and band of each packet and feeding the band to the second conveyor means and the notes of the respective stack to the first conveyor means, a testing unit disposed in one of said modular units along said note feed path for testing each of said notes and generating a test signal determinative of characteristics of each note, directing means responsive to said test signal for directing each bank note to one of a plurality of target locations within said modular units and for reuniting the notes of a packet having a selective characteristic with the band first associated therewith.

40. The apparatus according to claim 39, further comprising means responsive to said test signal for forming a data record for each note and band.

41. The apparatus according to claim 40, further comprising detecting means disposed in at least some of said units for the location of each of the notes and the band, a location counter means operatively connected to said detecting means and said directing means, and said location counter means being operative to signal said directing means.

42. A method of inspecting and sorting packets and bank notes, each of said packets having a plurality of bank notes which may include regular and irregular notes bound by a band, by passing said notes through means for separately determining a plurality of characteristics of the bank notes, comprising:

(a) removing said band from said bank notes of each of said packets;

(b) passing each of said separated bank notes over a first feed path through said determining means to identify said regular and irregular notes;

(c) passing each of said separated bands through a second feed path and holding said bands therein for a time substantially corresponding to the time period required for inspecting and sorting said bank notes first associated with said band as a packet;

(d) reuniting said each of said bands with any irregular notes of said bank notes first associated with said band as a packet; and (e) stacking and banding said regular notes.

* * * * *